US010446129B2

(12) United States Patent
Garncarz

(10) Patent No.: US 10,446,129 B2
(45) Date of Patent: Oct. 15, 2019

(54) MUSIC CONTROL DEVICE AND METHOD OF OPERATING SAME

(71) Applicant: Dariusz Bartlomiej Garncarz, Vancouver (CA)

(72) Inventor: Dariusz Bartlomiej Garncarz, Vancouver (CA)

( * ) Notice: Subject to any disclaimer, the term of this patent is extended or adjusted under 35 U.S.C. 154(b) by 0 days.

(21) Appl. No.: 16/091,965

(22) PCT Filed: Apr. 6, 2017

(86) PCT No.: PCT/CA2017/050423

§ 371 (c)(1),
(2) Date: Oct. 5, 2018

(87) PCT Pub. No.: WO2017/173547

PCT Pub. Date: Oct. 12, 2017

(65) Prior Publication Data

US 2019/0122648 A1 Apr. 25, 2019

Related U.S. Application Data

(60) Provisional application No. 62/319,176, filed on Apr. 6, 2016.

(51) Int. Cl.
*G10H 1/18* (2006.01)
*G10H 1/36* (2006.01)
(Continued)

(52) U.S. Cl.
CPC ..... *G10H 1/46* (2013.01); *G10H 1/0058* (2013.01); *G10H 1/0066* (2013.01); *G10H 7/00* (2013.01);
(Continued)

(58) Field of Classification Search
CPC ..... G10H 1/46; G10H 1/38; G10H 2240/325; G10H 1/00; G10H 2210/105; G10H 2210/155; G10H 7/008; G10H 2250/035; G10H 1/365; G10H 1/366; G10H 2210/131; G10H 2210/341; G10H 2220/155;
(Continued)

(56) References Cited

U.S. PATENT DOCUMENTS 3,083,608 A 4/1963 McKitrick
D215,674 S 10/1969 Arsenault
(Continued)

FOREIGN PATENT DOCUMENTS

CN 104021781 A 9/2014
EP 0268723 6/1988
(Continued)

OTHER PUBLICATIONS

Abelton, Learn more about Ableton Push, retrieved from https://www.ableton.com/en/push/ on Dec. 29, 2016.
(Continued)

*Primary Examiner* — Marlon T Fletcher
(74) *Attorney, Agent, or Firm* — Knobbe, Martens, Olson & Bear, LLP

(57) ABSTRACT

Disclosed methods may involve causing a music control device to associate a plurality of controls with respective ones of a plurality of parameters. Music control devices and computer-readable media are also disclosed.

28 Claims, 68 Drawing Sheets

(51) Int. Cl.

| | |
|---|---|
| ***G10H 1/46*** | (2006.01) |
| ***G10H 7/00*** | (2006.01) |
| ***G10H 1/00*** | (2006.01) |
| ***H04H 60/04*** | (2008.01) |

(52) U.S. Cl.

CPC ..... *H04H 60/04* (2013.01); *G10H 2210/155* (2013.01); *G10H 2210/571* (2013.01); *G10H 2220/096* (2013.01); *G10H 2220/106* (2013.01)

(58) Field of Classification Search

CPC ..... G10H 1/20; G10H 2210/136; G10H 2210/201; G10H 2210/235; G10H 2210/295; G10H 2250/615

See application file for complete search history.

(56) References Cited

U.S. PATENT DOCUMENTS

| | | | | |
|---|---|---|---|---|
| D244,214 | S | 5/1977 | Ross | |
| 4,054,868 | A | 10/1977 | Rose | |
| D275,669 | S | 9/1984 | Genaro | |
| D284,285 | S | 6/1986 | Lindhe | |
| D319,631 | S | 9/1991 | Twyford | |
| 5,060,272 | A | 10/1991 | Suzuki | |
| 5,125,314 | A | 6/1992 | Chihana | |
| 5,237,327 | A | 8/1993 | Saitoh et al. | |
| 5,260,508 | A | 11/1993 | Bruti et al. | |
| D342,737 | S | 12/1993 | Kawase | |
| D347,835 | S | 6/1994 | Zarnowitz | |
| 5,559,301 | A | 9/1996 | Bryan, Jr. et al. | |
| 5,572,239 | A | 11/1996 | Jaeger | |
| 5,608,807 | A * | 3/1997 | Brunelle | H04H 60/04 381/118 |
| 5,678,539 | A | 10/1997 | Schubert et al. | |
| 5,908,997 | A | 6/1999 | Arnold et al. | |
| 5,930,375 | A | 7/1999 | East et al. | |
| 5,959,610 | A | 9/1999 | Silfvast | |
| D420,353 | S | 2/2000 | Amai | |
| D429,233 | S | 8/2000 | Komiyama | |
| D444,460 | S | 7/2001 | Kitazawa | |
| 6,438,241 | B1 * | 8/2002 | Silfvast | H04H 60/04 307/112 |
| 6,728,382 | B1 | 4/2004 | Silfvast | |
| D500,307 | S | 12/2004 | Ishizaki | |
| D500,493 | S | 1/2005 | Velazquez | |
| D532,420 | S | 11/2006 | Oikawa | |
| D555,712 | S | 11/2007 | Sato | |
| D578,514 | S | 10/2008 | Mazur | |
| D584,282 | S | 1/2009 | Ishizaki | |
| 7,518,055 | B2 * | 4/2009 | Zartarian | H04H 60/04 84/615 |
| D605,604 | S | 12/2009 | El-Kiss | |
| 7,786,371 | B1 | 8/2010 | Moates | |
| D626,115 | S | 10/2010 | Suzuki | |
| D637,645 | S | 5/2011 | Koursaris | |
| 7,945,060 | B2 | 5/2011 | Terada et al. | |
| D641,733 | S | 7/2011 | Jenkins | |
| D648,324 | S | 11/2011 | Medas | |
| D665,778 | S | 8/2012 | Langlois | |
| 8,249,278 | B2 | 8/2012 | Ito et al. | |
| 8,269,718 | B2 | 9/2012 | Iwamura | |
| D689,486 | S | 9/2013 | O'Donnell | |
| 8,552,280 | B2 | 10/2013 | Ishida | |
| D715,265 | S | 10/2014 | Kuramoto | |
| D738,348 | S | 9/2015 | Kouthoofd | |
| D741,282 | S | 10/2015 | Kouthoofd | |
| 9,192,110 | B2 | 11/2015 | Standerfer et al. | |
| 9,263,017 | B2 | 2/2016 | Lifshitz et al. | |
| D771,020 | S | 11/2016 | O'Donnell | |
| D771,595 | S | 11/2016 | Medas | |
| D778,345 | S | 2/2017 | Katsumata | |
| D815,064 | S | 4/2018 | Garncarz | |
| 2002/0065570 | A1 | 5/2002 | Fujita et al. | |
| 2003/0188628 | A1 * | 10/2003 | Caillavet | G10H 1/0066 84/645 |
| 2004/0206226 | A1 * | 10/2004 | Negoescu | G10H 7/006 84/600 |
| 2006/0180007 | A1 | 8/2006 | McClinsey | |
| 2006/0195801 | A1 | 8/2006 | Iwamura | |
| 2006/0215857 | A1 | 9/2006 | Hirano | |
| 2008/0069282 | A1 | 3/2008 | Terada et al. | |
| 2008/0080720 | A1 | 4/2008 | Jacob et al. | |
| 2009/0028359 | A1 | 1/2009 | Terada et al. | |
| 2009/0301289 | A1 * | 12/2009 | Gynes | G10H 1/0066 84/645 |
| 2010/0064883 | A1 | 3/2010 | Gynes | |
| 2010/0242713 | A1 * | 9/2010 | Prado Lopez | G10D 13/021 84/723 |
| 2011/0019841 | A1 | 1/2011 | Fujita | |
| 2011/0029865 | A1 | 2/2011 | Gilland et al. | |
| 2011/0203445 | A1 * | 8/2011 | Stanger Ramirez | G10H 1/0066 84/645 |
| 2013/0087037 | A1 * | 4/2013 | Dreher | G10H 1/0066 84/645 |
| 2013/0233156 | A1 * | 9/2013 | Kapp | G10H 1/0091 84/626 |
| 2013/0335449 | A1 | 12/2013 | Johnson et al. | |
| 2014/0053712 | A1 * | 2/2014 | Dreher | G10H 1/0033 84/645 |
| 2015/0029115 | A1 | 1/2015 | Hlatky et al. | |
| 2015/0029145 | A1 | 1/2015 | Hlatky et al. | |
| 2015/0068391 | A1 | 3/2015 | Friesen | |
| 2015/0078584 | A1 * | 3/2015 | Moon | G10H 1/46 381/104 |
| 2016/0019874 | A1 | 1/2016 | Yoshikawa | |
| 2018/0190250 | A1 * | 7/2018 | Hiskey | G10H 1/0066 |
| 2019/0122648 | A1 * | 4/2019 | Garncarz | G10H 1/0058 |

FOREIGN PATENT DOCUMENTS

| | | |
|---|---|---|
| JP | D2008-27370 | 6/2009 |
| JP | D2013-7601 | 10/2013 |
| WO | WO 2015160728 A1 | 10/2015 |

OTHER PUBLICATIONS

Abelton, Using Push, retrieved from https://www.ableton.com/en/manual/using-push/ on Dec. 29, 2016.

Abelton, Using Push 2, retrieved from http://www.ableton.com/en/manual/using-push-2/ on Dec. 29, 2016.

Akai Professional, Advance 25, 2015, retrieved from http://www.akaipro.com/product/advance-25 on Dec. 29, 2016.

Analogue Haven, Fader Fox, webarchive Dec. 30, 2007, (online), site visited Oct. 23, 2018. Available from internet https://www.web.archive.org/web/20071230183603/http://www.analoguehaven.com/faderfox/Id2/> (2007).

Youtube, Livid Modular Controller, posted Nov. 4, 2011 (online), site visited Oct. 23, 2018. Available from internet, https://www.youtube.com/watch?v+IFDoJFYSYcQ> (2011).

Arturia, BeatStep User's Manual, 2013-2014.

Arturia, BeatStep Pro user's Manual, May 30, 2016.

B&H Explora, Feeltune Rhizome Groove Production Hardware, retrieved from http://www.bhphotovideo.com/explora/video/news/feeltune-rhizome-groove-production-hardware on Dec. 29, 2016.

Canadian Intellectual Property Office, Examiner's Report in industrial design Application No. 167808, dated Nov. 8, 2016.

Elektron, Analog Drive, retrieved from http://www.elektron.se/products/analog-drive/ on Dec. 29, 2016.

Elektron, Analog Four, retrieved from https://www.elektron.se/products/analog-four on Dec. 29, 20126.

Elektron, Analog Heat, retrieved from https://www.elektron.se/products/analog-heat/ on Dec. 29, 2016.

Elektron, Analog Keys, retrieved from https://www.elektron.se/products/analog-keys/ on Dec. 29, 2016.

Elektron, Analog Rytm, retrieved from https://www.elektron.se/products/analog-rytm/ on Dec. 29, 2016.

(56) References Cited

OTHER PUBLICATIONS

Elektron, Analog Rytm User's Manual, 2014.
Elektron, Legacy Products, retrieved from https://www.elektron.se/legacy-products/ on Dec. 29, 2016.
Elektron, Octatrack, retrieved from https://www.elektron.se/products/octatrack/ on Dec. 29, 2016.
Eventide, H3000 Ultra-Harmonizer Instruction Manual, 1989-1996.
Native Instruments, Maschine, 2016, retrieved from https://www.native-instruments.com/en/products/maschine/production-systems/maschine/ on Dec. 29, 2016.
Native Instruments, Traktor Kontrol D2, 2016, retrieved from https://www.native-instruments.com/en/products/traktor/dj-controllers/traktor-kontrol-d2/ on Dec. 29, 2016.
Teenage Engineering, OP-Z, 2016, retrieved from https://www.teenageengineering.com/products/op-z on Dec. 29, 2016.
Wikipedia, Korg Trinity, Oct. 25, 2016, retrieved from https://en.wikipedia.org/wiki/Korg_Trinity on Dec. 29, 2016.
Wikipedia, Korg Triton, Nov. 21, 2016, retrieved from https://en.wikipedia.org/wiki/Korg_Triton on Dec. 29, 2016.
Wire Realm, Akai AFX MIDI Conroller review, posted on Oct. 13, 2014 [online], site visited on Sep. 12, 2017, available from internet, URL: http://www.wirerealm.com/guides/akai-afx-fx-controller-for-serato-df-review (2014).
Amazon, Zoom g3 Guitar Effects Pedal, first available Jul. 11, 2011 [online], site visited on Sep. 12, 2017, available from internet, URL: https://www.amazon.co/uk/Zoom-G3-Guitar-Effects-Pedal/dp/B005BRFBPQ/ref=sr_1_27?ie=UTF8&qid=1505222835&sr=8-27&keywords=MIDI+CONTOLLER+WITH+SCREEN (2011).

* cited by examiner

170

102
MASTER
AUX
TRACKS MODE
PATCH
FRONT
INST
BACK
MIX
Click
FX
LOOP
NO/-
+/YES
SEQ
TRACK 1
TRACK 2
TRACK 3
TRACK 4
MIX
EQ
SCENE
AUTO
MORPH
SHIFT
PRESET
UNDO
TEMPO
Turn:
Adjusts Value
Click:
Multiple Clicks Change button states
Click
Opens Mix
BUTTON STATES
134
Click:

102

(This example just shows the same vertical editors in each track as if the same Mixer model was loaded in all 4 tracks.)

(If transport is playing:
Launches Scene on next bar
If transport is stopped:
Launches Scene immediately

MUSIC CONTROL DEVICE AND METHOD OF OPERATING SAME

CROSS-REFERENCE TO RELATED APPLICATIONS

This application is the U.S. National Phase of International Application No. PCT/CA2017/050423 entitled MUSIC CONTROL DEVICE AND METHOD OF OPERATING SAME, filed Apr. 6, 2017 and published on Oct. 12, 2017 as WO 2017/173547, which claims the benefit of, and priority to, U.S. provisional patent application No. 62/319,176, filed Apr. 6, 2016, the entire contents of which are incorporated by reference herein.

FIELD

This disclosure relates generally to music control devices.

BACKGROUND

Music control devices, which may also be referred to as music production centers or music synthesizers, for example, can function as synthesizers, mixers, samplers, sequencers, or other functions, or as combinations of two or more thereof.

SUMMARY

One embodiment is a scalable live-music composition, sound-design, and live-performance musical instrument that may also function as a mixer. The embodiment may also be described as an integrated multi-track synthesizer and sequencer platform, which may be composed of modules that may function as individual components or together as one. In some embodiments, the modules include one "main" module and up to three "expand" modules (which may also be referred to as "add" modules). Each module may include four tracks, and each track may contain synthesizer/instrument, mixer, effects, looper, control, sequencer elements, or elements of combinations of two or more thereof. Such elements may include virtual analog, sampling, and external control instruments, effect, and sequencer models.

In some embodiments, external instruments can integrate as seamlessly as internal instruments. External instruments can be controlled using one or more musical instrument digital interface ("MIDI"). Some embodiments may include an EXP-A input/output ("I/O") expansion card (which may allow the device to integrate a studio without an external laptop or other external computer), and in such embodiments, external instruments or effects processors can also be mixed, controlled, or both using a Control Voltage/Gate ("CV/Gate" or "CV") method, for example. In some embodiments having four modules with 16 tracks, up to four different I/O expansion cards can be added.

Generally, each module in one embodiment physically includes track buttons, a high-resolution thin-film transistor ("TFT") screen, eight push encoders, eight buttons, a powerful processor, and one I/O expansion and one digital signal processor ("DSP") expansion slots. The DSP may be sealed, and may facilitate additional models (such as additional instrument or effects models, for example). Some or all of the push encoders and buttons may be colorable according to a red-green-blue ("RGB") color model.

In one embodiment, the "main" module includes: four synthesizer tracks plus the main mixer for the system; track buttons; a high resolution TFT screen; eight RGB push encoders; eight RGB buttons; a powerful processor; one I/O expansion and one DSP expansion slot; system and common navigation and mode controls; transport; power; main outputs; headphone output; a MIDI input; a MIDI output; a universal serial bus ("USB") device and host; and secure digital ("SD") card storage.

In such an embodiment, each "expand" module may add: an additional four synthesizer tracks and track buttons; a high resolution TFT screen; eight RGB push encoders, eight RGB buttons; a powerful processor; and one I/O expansion and one DSP expansion slot. The output of each "expand" module may be mixed in the "main" module.

Such embodiments may therefore have different sizes depending on the number of "expand" modules, and such embodiments may be expandable by adding additional "add" modules. Such embodiments may be disassembled for travel (to fit into carry-on luggage, for example) or reconfiguration.

In some embodiments, integrated multitrack sequencers, loopers, scenes, and automation may facilitate producing, performing, and jamming with a studio or live music control device.

According to one embodiment, there is provided a method of controlling a music control device comprising a display and a plurality of controls, the method comprising: producing a first at least one track-part selection signal representing user selection of a first track part from a plurality of track parts of at least one of a plurality of tracks of music-generating elements associated with the music control device; producing a first at least one parameter subset selection signal representing user selection of a first selected subset of parameters from a plurality of subsets of parameters in the first track part; causing the music control device to associate the plurality of controls with respective ones of a plurality of parameters in the first selected subset of parameters; and causing the music control device to vary at least one of the plurality of parameters in response to user actuation of a respective at least one of the plurality of controls associated with the at least one of the plurality of parameters.

According to another embodiment, there is provided a method of controlling a music control device comprising a display and a plurality of controls, the method comprising: producing a first at least one track-part selection signal representing user selection of a first track part from a plurality of track parts of at least one of a plurality of tracks of music-generating elements associated with the music control device; in response to the user selection of the first track part of the at least one of the plurality of tracks, causing the display to display a timeline comprising representations of respective ones of a plurality of parameters associated with respective ones of a plurality of steps in the at least one of the plurality of tracks; causing the music control device to associate the plurality of controls with respective ones of the plurality of parameters; and causing the music control device to vary at least one of the plurality of parameters in response to user actuation of a respective at least one of the plurality of controls associated with the at least one of the plurality of parameters.

According to another embodiment, there is provided a method of controlling a music control device comprising a display and a plurality of controls, the method comprising: causing the music control device to associate the plurality of controls with respective ones of a plurality of model elements associated with the music control device; when the plurality of controls are associated with the respective ones of the plurality of model elements, causing the music control device to vary at least one simulated interconnection between a pair of the plurality of model elements in response to user actuation of at least one of the plurality of controls; causing the music control device to associate the plurality of controls with respective ones of a plurality of parameters of at least one of the plurality of model elements; and when the plurality of controls are associated with the respective ones of the plurality of parameters, causing the music control device to vary at least one of the plurality of parameters in response to user actuation of a respective at least one of the plurality of controls associated with the at least one of the plurality of parameters.

According to another embodiment, there is provided a music control device configured to implement any one of the methods.

According to another embodiment, there is provided a music control device comprising means for implementing any one of the methods.

According to another embodiment, there is provided at least one computer-readable medium comprising codes stored thereon that, when executed by at least one computer, cause the at least one computer to implement any one of the methods.

According to another embodiment, there is provided a music control device comprising: the at least one computer-readable medium; and at least one computer in communication with the at least one computer-readable medium.

Other aspects and features will become apparent to those ordinarily skilled in the art upon review of the following description of illustrative embodiments in conjunction with the accompanying figures.

BRIEF DESCRIPTION OF THE DRAWINGS

FIGS. 6 to 47 illustrate user interfaces of the music control device of FIG. 1.

DETAILED DESCRIPTION

Figure 1:
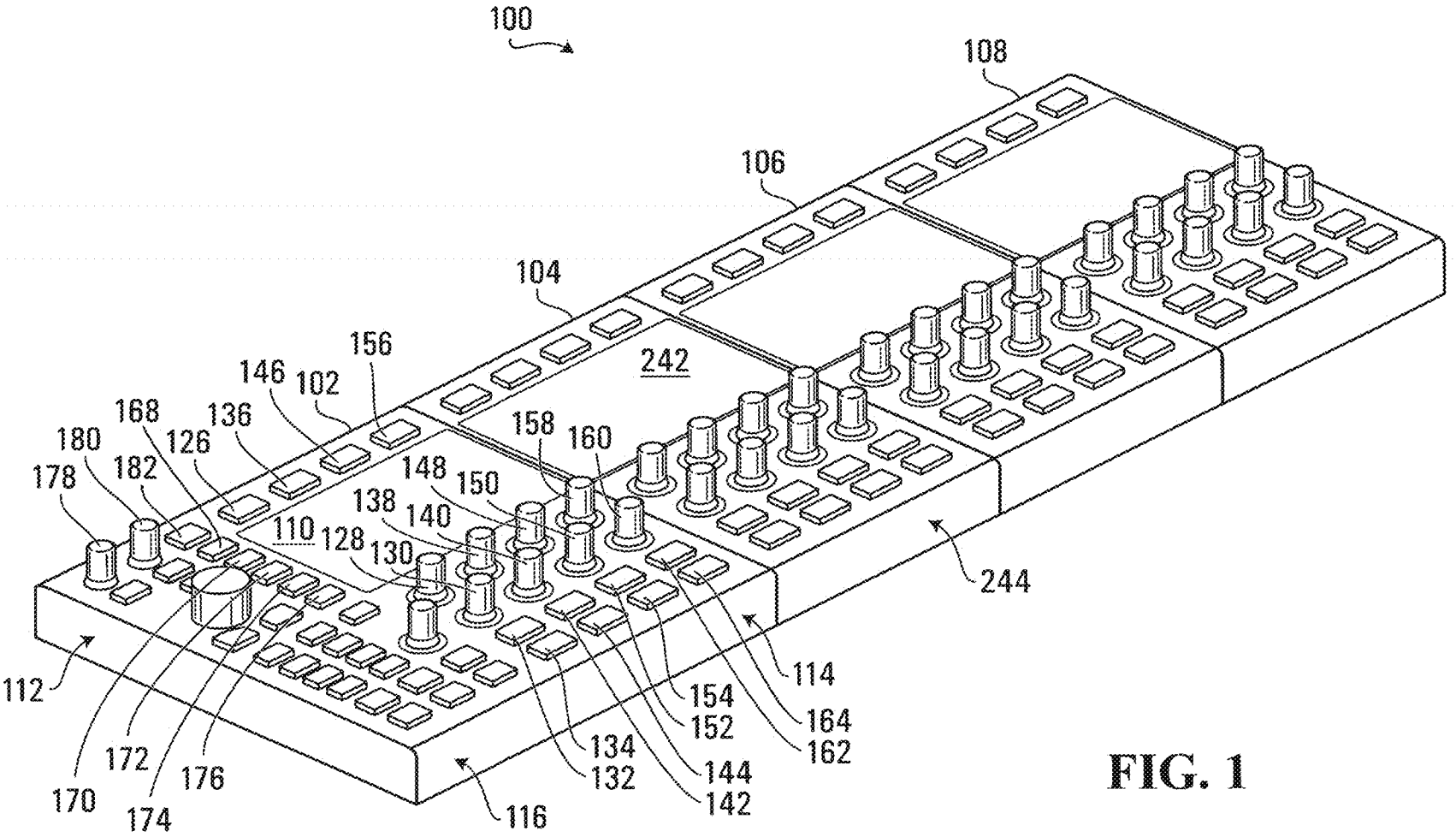
FIG. 1 is a perspective view of a music control device according to one embodiment.

Referring to FIG. 1, a music control device according to one embodiment is shown generally at 100. The music control device 100 includes a main module 102 and expansion (or "expand" or "block" or "add") modules 104, 106, and 108. The main module 102 and the expansion modules 104, 106, and 108 are detachable from each other and attachable to each other in a chain of modules including the main module 102 as shown in FIG. 1. The music control device 100 may operate as described below with only the main module 102, or with one, two, three, or more expansion modules. Ganging structure may permit the modules to be attached to each other as shown in FIG. 1 and to be detached from each other. Such a ganging structure may transmit power and signals between the modules to allow the modules to operate and cooperate as described herein for example.

Figure 48:
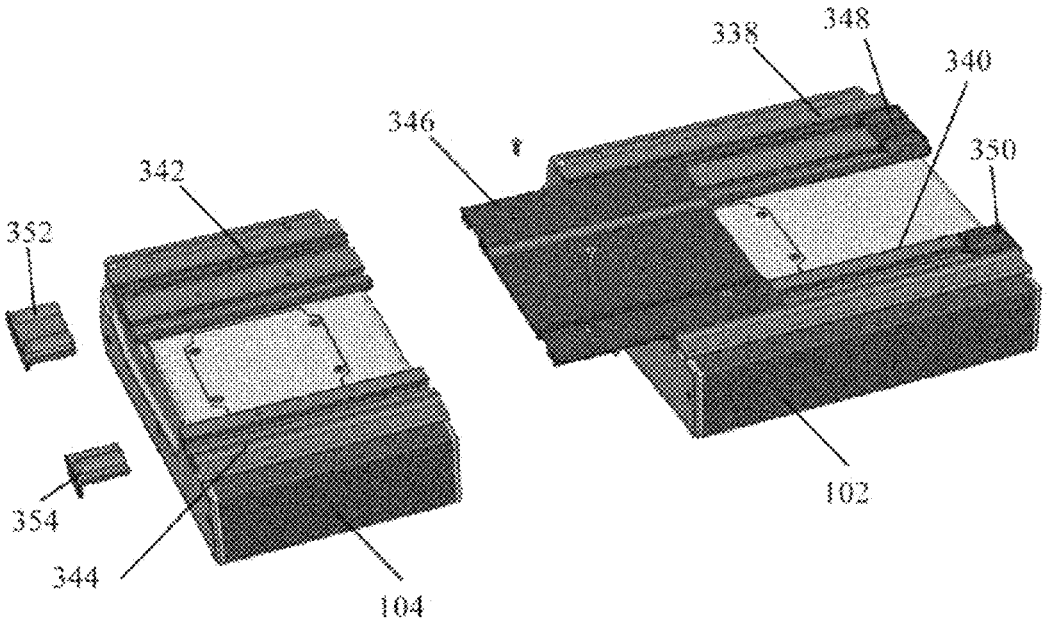
FIGS. 48 and 49 illustrate a ganging structure according to some embodiments.
Figure 49:
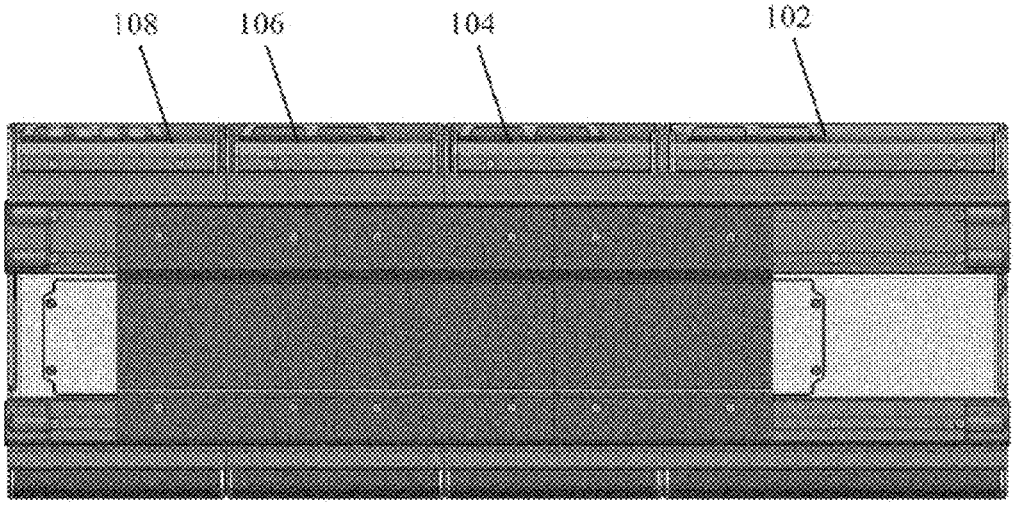

FIGS. 48 and 49 illustrate a ganging structure according to some embodiments. FIG. 48 illustrates rails 338 and 340 on a bottom side of the main module 102 and rails 342 and 344 on a bottom side of the expansion module 104. A joining body 346 may be fastened (by screws, for example) to the rails 338, 340, 342, and 344 to join the main module 102 to the expansion module 104. The rails 338, 340, 342, and 344 may also receive end bodies 348, 350, 352, and 354 respectively. FIG. 49 illustrates a similar ganging structure joining the main module 102 and the expansion modules 104, 106, and 108 to each other. Molded rubber feet may be added to the rails to elevate the music control device from a surface such as a table, for example.

Figure 2:
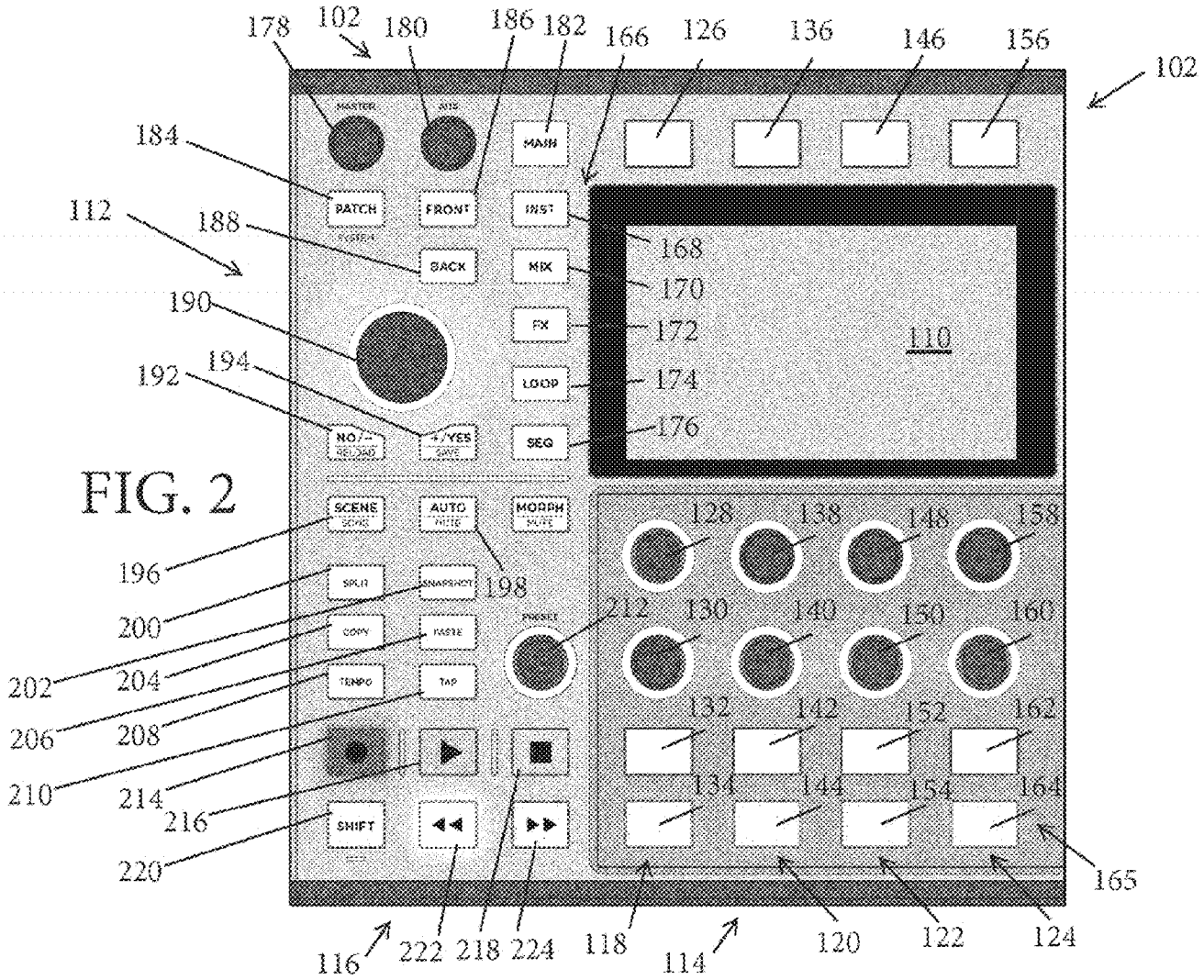
FIG. 2 is a plan view of a main module of the music control device of FIG. 1.

Referring to FIGS. 1 and 2, the main module 102 includes a display screen 110 and a plurality of user inputs shown generally at 112. Display screens in alternative embodiments may be different sizes, and larger for example. The user inputs 112 include a plurality of display-column-associated user inputs shown generally at 114, each in a respective column aligned with a respective column in the display screen 110. The user inputs 112 also include a plurality of general user inputs shown generally at 116, which are outside of columns aligned with columns of the display screen 110.

The display-column-associated user inputs 114 are positioned in one of a first column shown generally 118, a second column shown generally at 120, a third column shown generally at 122, and a fourth column shown generally at 124, each aligned with a respective column of the display screen 110. In the first column 118, the display-column-associated user inputs 114 include a track selection user input 126 in a row of track selection user inputs above the display screen 110, and user inputs 128, 130, 132, and 134 in first, second, third, and fourth rows respectively below the display screen 110. In the second column 120, the display-column-associated user inputs 114 include a track selection user input 136 in the row of track selection user inputs above the display screen 110, and user inputs 138, 140, 142, and 144 in the first, second, third, and fourth rows respectively below the display screen 110. In the third column 122, the display-column-associated user inputs 114 include a track selection user input 146 in the row of track selection user inputs above the display screen 110, and user inputs 148, 150, 152, and 154 in the first, second, third, and fourth rows respectively below the display screen 110. In the fourth column 124, the display-column-associated user inputs 114 include a track selection user input 156 in the row of track selection user inputs above the display screen 110, and user inputs 158, 160, 162, and 164 in the first, second, third, and fourth rows respectively below the display screen 110.

The track selection user inputs 126, 136, 146, and 156 and the user inputs 132, 134, 142, 144, 152, 154, 162, and 164 are push-button user inputs that a user may push or click to make selections or changes as described below, and may also be illuminated in a plurality of different colors as described below. Color schemes may be customizable in some embodiments, and some embodiments may have dark and bright settings to facilitate use in environments with different lighting, for example. The user inputs 128, 130, 138, 140, 148, 150, 158, and 160 are rotatable user inputs that may be rotated to make selections or changes as described below, and that a user may push or click to make selections or changes as described below. As described below, the user inputs 128, 130, 132, 134, 138, 140, 142, 144, 148, 150, 152, 154, 158, 160, 162, and 164 may control parameters or simulated interconnections and may thus function as controls shown generally at 165.

The general user inputs 116 include track-part selector inputs shown generally at 166 and including an instrument track-part selector user input 168, a mixer track-part selector user input 170, a sound effects track-part selector user input 172, a looper user input track-part selector 174, and a sequencing track-part selector user input 176. The track-part selectors 166 are aligned with respective rows of the display screen 110. Although the display-column-associated user inputs 114 are aligned with respective columns of the display screen 110 and the track-part selectors 166 are aligned with respective rows of the display screen 110, alternative embodiments may include differently aligned user inputs. Further, alternative embodiments may include shortcuts as alternatives to the track-part selector inputs 166.

The general user inputs 116 also include a master volume user input 178, an auxiliary volume user input 180, a main menu selection user input 182, a patch selection user input 184, a front selection user input 186, a back selection user input 188, a scrolling user input 190, a "NO" user input 192, a "YES" user input 194, a scene selection user input 196, an automation selection user input 198, a split user input 200, a snap shot user input 202, a copy user input 204, a paste user input 206, a tempo user input 208, a tap user input 210, a preset user input 212, a record user input 214, a play user input 216, a stop user input 218, a shift user input 220, a reverse user input 222, and a forward user input 224.

Figure 61:
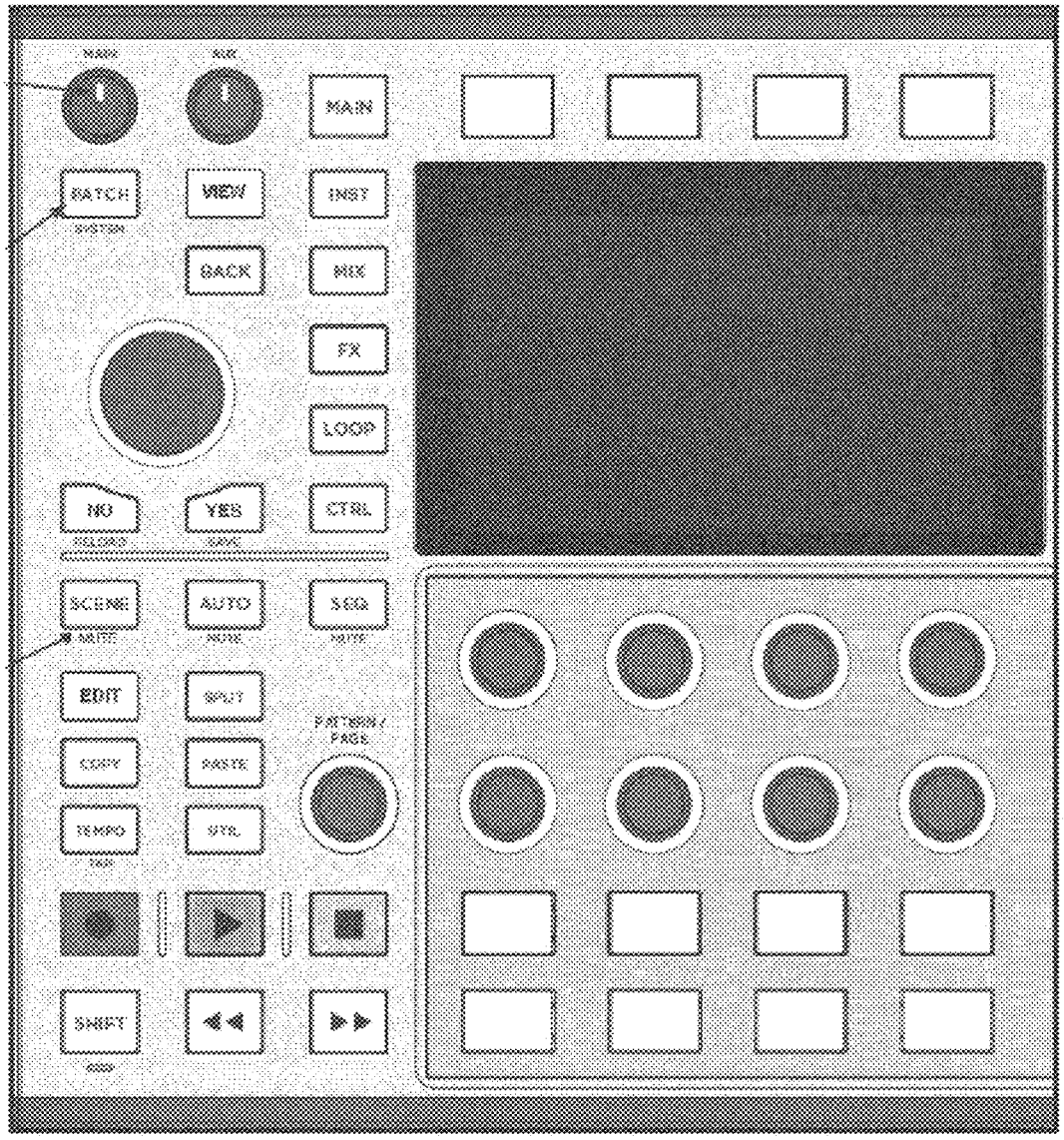
FIG. 61 is a plan view of a main module of a music control device according to another embodiment.

FIG. 61 illustrates a main module of a music control device according to another embodiment. The main module of FIG. 61 includes some user inputs having positions and functions that are similar to positions and functions of corresponding user inputs of the main module 102. For example, the main module of FIG. 61 includes some user inputs having positions and functions that are similar to positions and functions of the controls 165, of the track-part selector inputs 166, and of the track selection user inputs 126, 136, 146, and 156. The main module of FIG. 61 also includes some different user inputs than the main module 102. For example, the main module of FIG. 61 does not include a front selection user input, but does include a back selection user input, and in embodiments such as the embodiment of FIG. 61, a "back" panel (as described below, for example) may be selected by user selection of the back selection user input, and a "front" panel (as described below, for example) may be selected by user deselection of the back selection user input. In general, different modules such as those described herein may be interchanged or varied in other ways. Therefore, reference herein to the music control device 100 may be understood as reference to other music control devices such as other music control devices described herein, for example.

Figure 3:
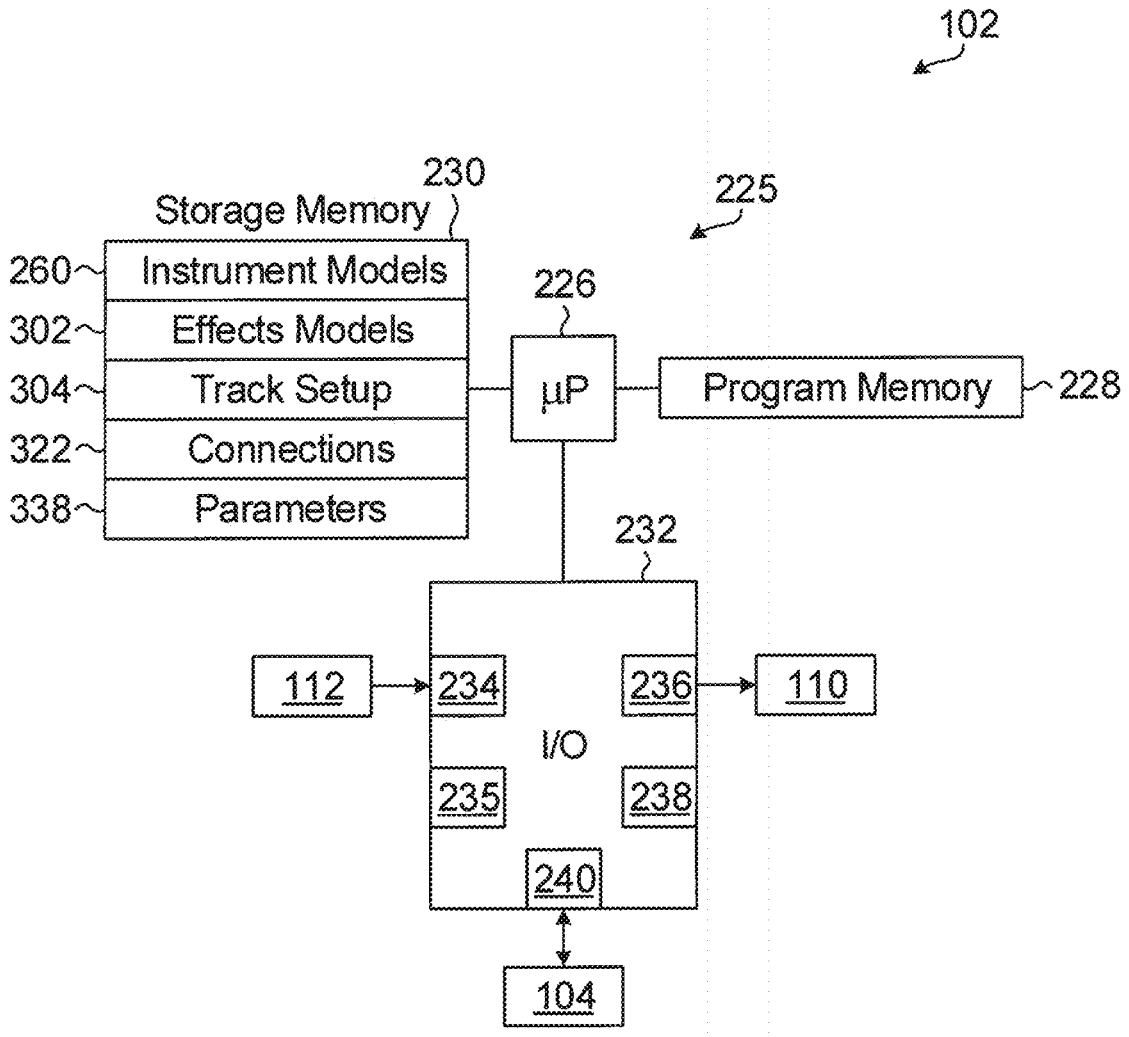
FIG. 3 is a schematic view of the main module of FIG. 2.

Referring to FIG. 3, the main module 102 includes a processor circuit shown generally at 225 and including a microprocessor 226. Although one microprocessor 226 is shown, the processor circuit 225 may include one or more microprocessors such as a master processing unit ("MPU") that may communicate and synchronize between the various other processors and digital signal processor ("DSP") modules in a connected system. One embodiment includes an A7 or A9 microprocessor from Apple Inc. and a digital signal processor, for example. The processor circuit 225 also includes a program memory 228, a storage memory 230, and an input/output ("I/O") module 232, all in communication with the microprocessor 226. The program memory 228 includes programs code that direct the microprocessor 226 to implement functions of the main module 102 as described below. The storage memory 230 includes various stores storing information as described below. The program memory 228 and the storage memory 230 may be implemented on one or more of the same or different computer-readable storage media, which in various embodiments may include one or more of a read-only memory ("ROM"), random access memory ("RAM"), a hard disc drive ("HDD"), secure digital ("SD"), flash memory, and other computer-readable or computer-writable storage media.

The I/O module 232 includes an input interface 234 to receive input signals from the user inputs 112, an input interface 235 to receive input signals from one or more musical instruments external to the music control device 100, an output interface 236 to produce output signals to control the display screen 110, an output interface 238 to produce audio output signals, and an input/output interface 240 (a peripheral component interconnect ("PCI") connector, for example) to communicate with the expansion module 104. In alternative embodiments, the processor circuit 225 may be partly or fully implemented using different hardware logic, which may include discrete logic circuits or an application specific integrated circuit ("ASIC") for example.

Figure 4:
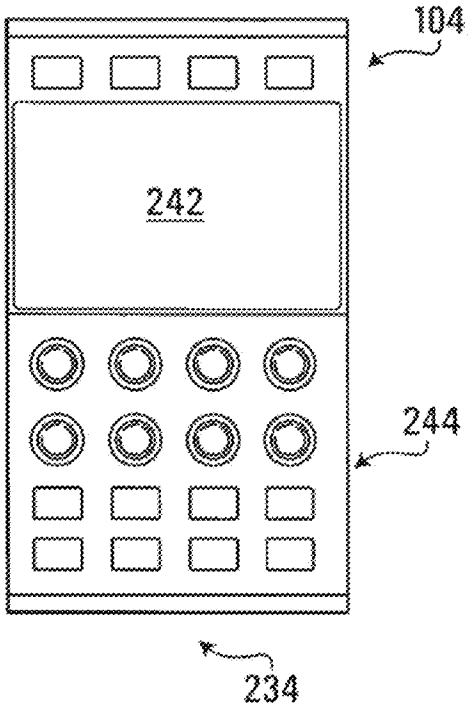
FIG. 4 is a plan view of an expansion module of the music control device of FIG. 1.

Referring to FIGS. 1 and 4, the expansion module 104 includes a display screen 242 and a plurality of display-column-associated user inputs shown generally at 243, each in a respective column aligned with a respective column in the display screen 242. Display screens in alternative embodiments may be different sizes, and larger for example. The display-column-associated user inputs 243 are substantially the same as the display-column-associated user inputs 114. Therefore, user inputs in the display-column-associated user inputs 243 corresponding to the user inputs 128, 130, 132, 134, 138, 140, 142, 144, 148, 150, 152, 154, 158, 160, 162, and 164 may likewise control parameters or simulated interconnections and may thus function as controls shown generally at 244. Further, when the expansion module 104 is attached to the main module 102 as shown in FIG. 1, the display screen 242 may extend the display screen 110 because columns of the display screen 242 may function as additional columns of the display screen 110, and the display screens 110 and 242 may collectively function as a display having columns of the display screens 110 and 242. Further, when the expansion module 104 is attached to the main module 102 as shown in FIG. 1, the display-column-associated user inputs 243 may extend the display-column-associated user inputs 114 because the columns of the display-column-associated user inputs 243 may function as additional columns of the display-column-associated user inputs 114, and the display-column-associated user inputs 114 and the display-column-associated user inputs 243 may collectively function as user inputs or controls in columns associated with respective columns of the display screens 110 and 242 collectively.

Figure 5:
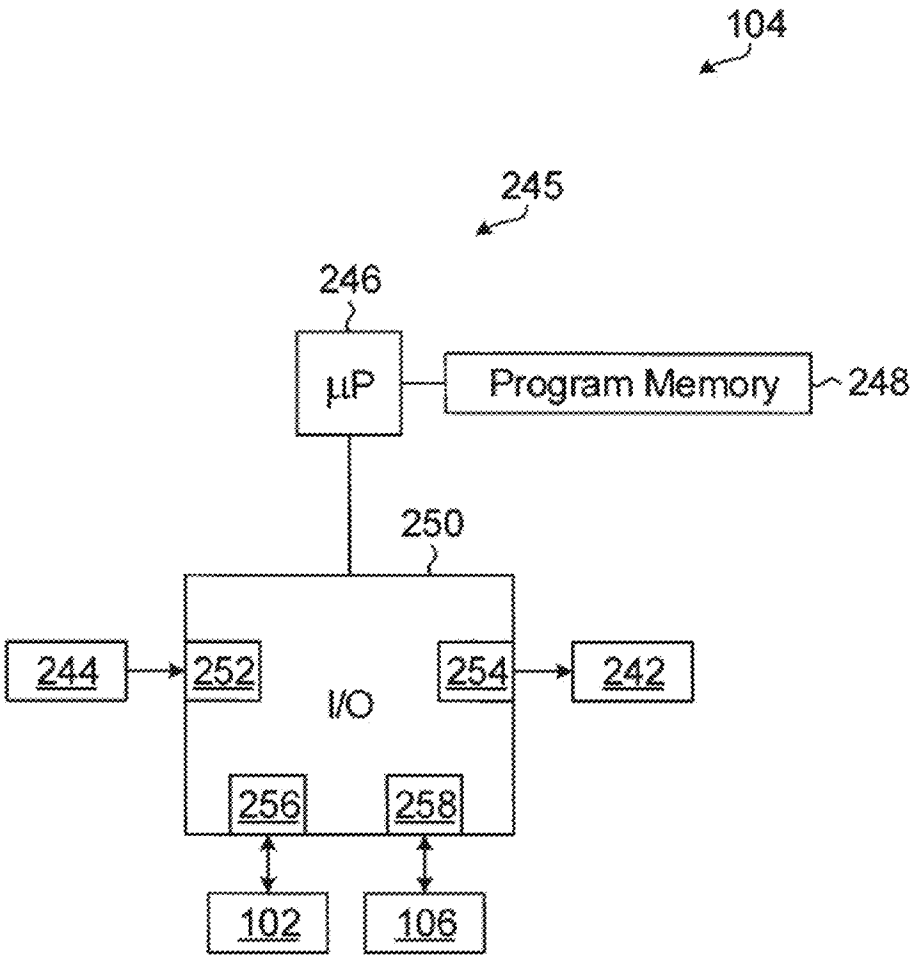
FIG. 5 is a schematic view of the expansion module of FIG. 4.

Referring to FIG. 5, the expansion module 104 includes a processor circuit shown generally at 245 and including a microprocessor 246. Again, although one microprocessor 246 is shown, the processor circuit 245 may include one or more microprocessors such as an A7 or A9 microprocessor from Apple Inc. and a digital signal processor, for example. The processor circuit 245 also includes a program memory 248 and an I/O module 250 in communication with the microprocessor 246. The program memory 248 includes program instructions for directing the microprocessor 246 to perform functions of the expansion module 104 as described below, and the program memory 248 may be implemented on one or more of the same or different computer-readable storage media, which in various embodiments may include one or more of a ROM, RAM, HDD, SD, flash memory, and other computer-readable or computer-writable storage media.

The I/O module 250 has an input interface 252 for receiving inputs from the display-column-associated user inputs 243, and an output interface 254 for producing output signals to control the display screen 242. The I/O module 250 also has an input/output interface 256 (a PCI connector, for example) to communicate with the main module 102, and an input/output interface 258 (a PCI connector, for example) to communicate with the expansion module 106. In alternative embodiments, the processor circuit 245 may be partly or fully implemented using different hardware logic, which may include discrete logic circuits or an ASIC for example. The expansion modules 106 and 108 are substantially the same as the expansion module 104.

Figure 50:
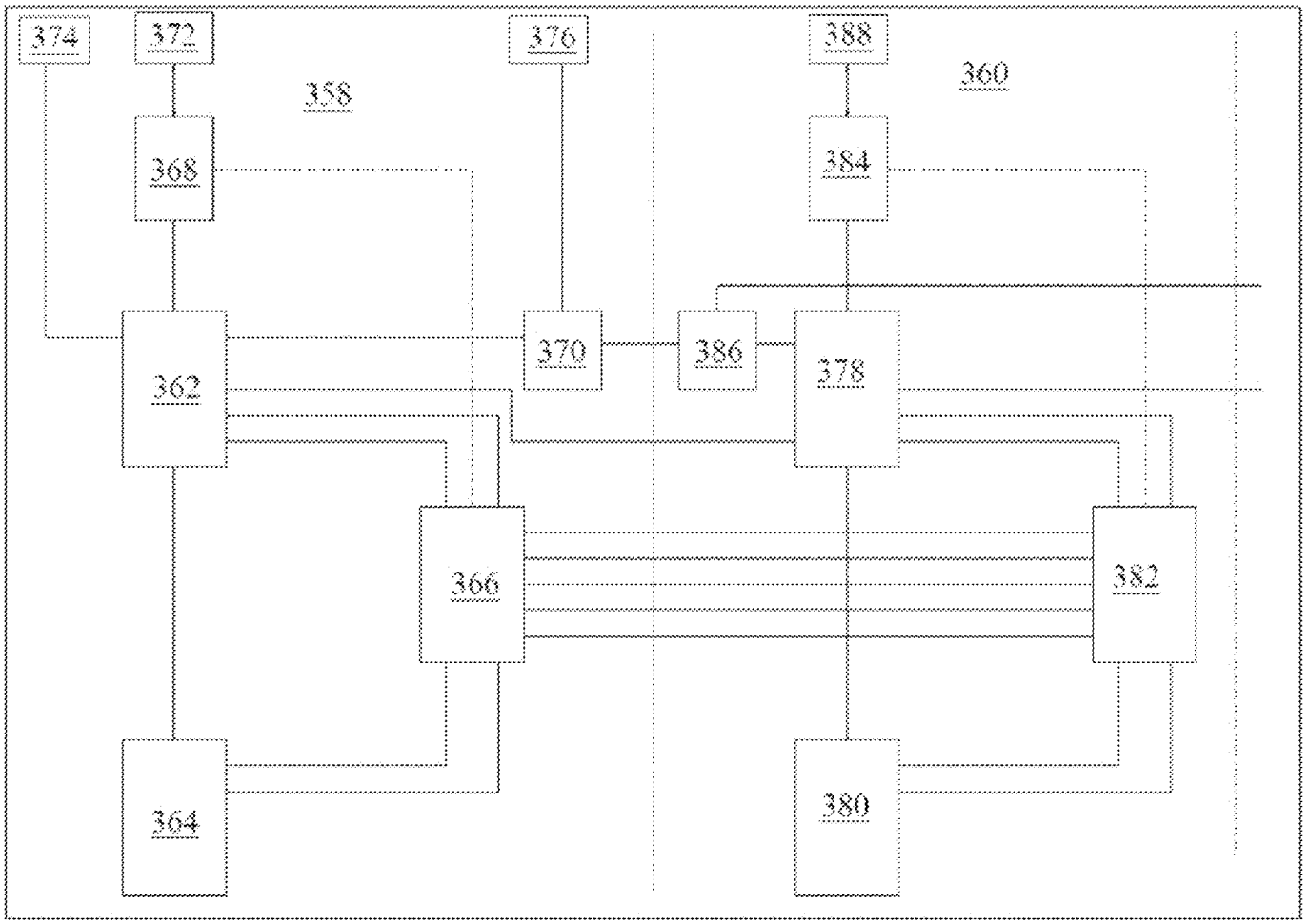
FIG. 50 is a schematic view of a main module and an expansion module according to another embodiment.

Referring to FIG. 50, a music control device according to another embodiment is shown generally at 356 and includes a main module 358 and one expansion module 360. The main module 358 may be similar to the main module 102 and includes a central processing unit ("CPU") 362, a digital signal processor ("DSP") 364, a field-programmable gate array ("FPGA") 366, a microcontroller unit ("MCU") 368, and a universal serial bus ("USB") hub 370. The CPU 362 is in communication with the DSP 364 using a serial connection and a general-purpose input/output ("GPIO") connection, and the CPU 362 is also in communication with the MCU 368 using a serial connection and a GPIO connection. The MCU 368 is in communication with user interface ("UI") elements 372. A USB function port of the CPU 362 is in communication with a type B USB port 374. The FPGA 366 is in communication with the CPU 362 using a serial peripheral interface ("SPI") connection, a GPIO connection, and a digital audio connection, and the FPGA 366 is also in communication with the DSP 364 using an SPI connection, a GPIO connection, and a digital audio connection. The FPGA 366 may be connected to the MCU 368 using an optional link. A USB host port of the CPU 362 is in communication with the USB hub 370, which is in communication with a type A USB port 376.

The expansion module 360 may be similar to the expansion module 102, 104, 106, or 108 and includes a CPU 378, a DSP 380, an FPGA 382, an MCU 384, and a USB hub 386. The CPU 378 is in communication with the DSP 380 using a serial connection and a GPIO connection, and the CPU 378 is also in communication with the MCU 384 using a serial connection and a GPIO connection. The MCU 384 is in communication with UI elements 388. The FPGA 382 is in communication with the CPU 378 using an SPI connection, a GPIO connection, and a digital audio connection, and the FPGA 382 is also in communication with the DSP 380 using an SPI connection, a GPIO connection, and a digital audio connection. The FPGA 382 may be connected to the MCU 384 using an optional link. A USB function port of the CPU 378 is in communication with the USB hub 386. The FPGA 366 and the FPGA 382 are connected to each other using a clock connection, a digital audio connection, a GPIO connection, a serial link, and possibly another connection. A USB connection may connect the USB hub 386 to another expansion module on a side of the expansion module 360 opposite the main module 358, and a GPIO connection, and possibly another connection, may connect the CPU 378 to the other expansion module. In that way, the music control device 356 may be expanded by adding additional expansion modules to each other.

Figure 6:
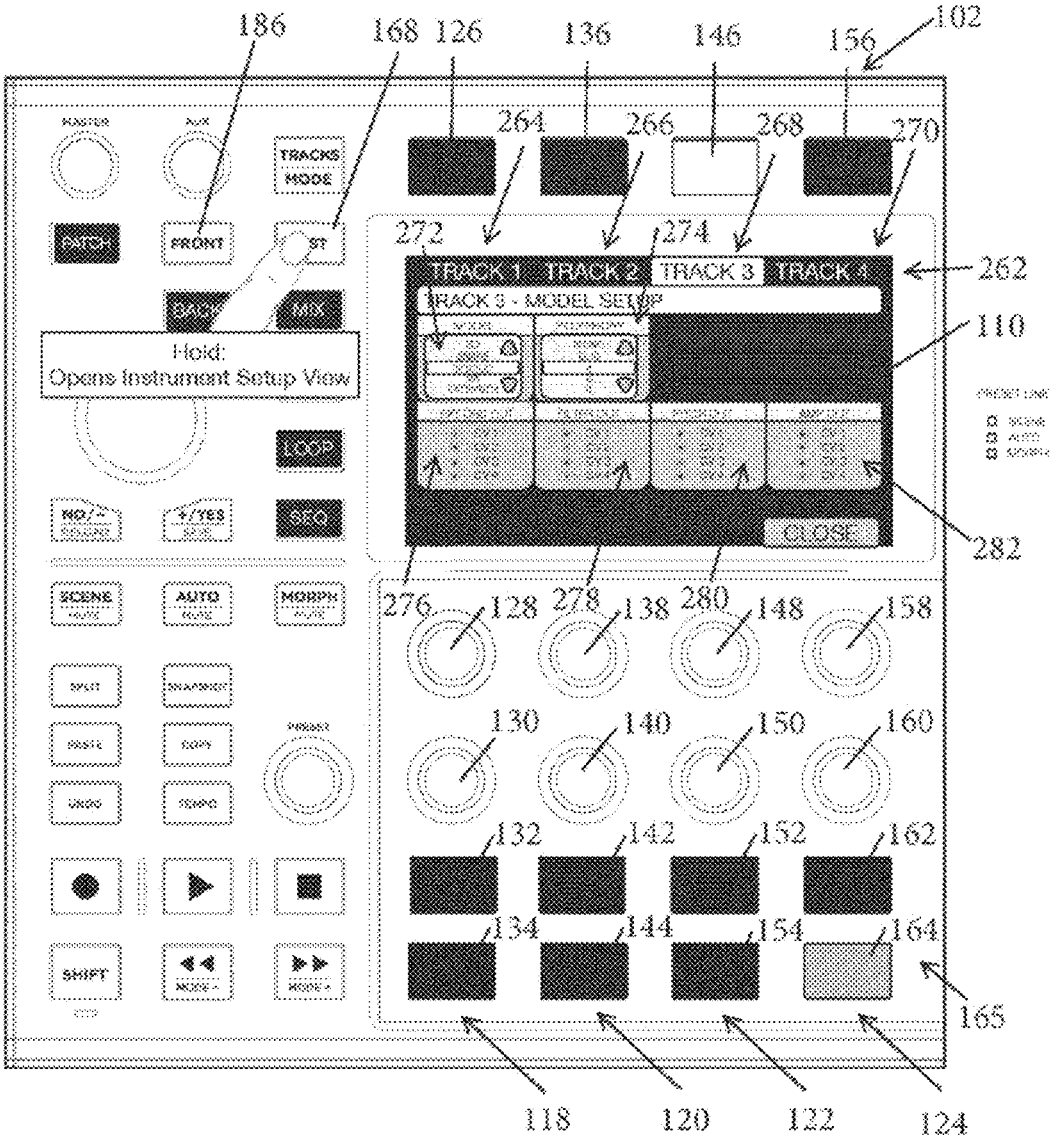

Referring back to FIG. 3, the storage memory 230 includes an instrument models store 260, which stores definitions of elements of models of musical instruments that may be synthesized by the music control device 100. Referring to FIG. 6, selecting the front selection user input 186 and then holding the instrument track-part selector user input 168 for a predetermined period of time (such as one or two seconds, for example) causes the display screen 110 to display an instrument setup view.

In the instrument setup view, the display screen 110 includes a track icon row shown generally at 262 and including a track icon shown generally at 264 and identifying a first track ("TRACK 1") in the first column 118, a track icon shown generally at 266 and identifying a second track ("TRACK 2") in the second column 120, a track icon shown generally at 268 and identifying a third track ("TRACK 3") in the third column 122, and a track icon shown generally at 270 and identifying a fourth track ("TRACK 4") in the fourth column 124. The track icons 264, 266, 268, and 270 are aligned in the same columns as the track selection user inputs 126, 136, 146, and 156 respectively, so the track selection user inputs 126, 136, 146, and 156 are thus aligned with respective icons on the display screen 110 and indicating respective tracks.

In general, a track includes one model element, or a collection of more than one model element, such as sources of music or elements of sources of music that modulate sources of music. For example, a musical instrument external to the music control device 100 may be a model element of a track, and input signals from such an external musical instrument may be received at the input interface 235 (shown in FIG. 3) as described above. An instrument may also be a control for an external music device, and the external music device may be controlled by the instrument using a musical instrument digital interface ("MIDI") output signal, for example.

A model element of a track may also include one or more model elements in a track part of the track. Model elements may be defined according to parameters (such as parameters of a tone generator, a file player, a mixer, an amplifier, a filter, a signal processor, or a control generator such as an envelope, a low-frequency oscillator ("LFO"), or a sequencer, for example) and according to settings (such as model type, model memory, or processing allocation, for example).

A track may include model elements of an instrument track part, and model elements of an instrument track part may include one or more of a polyphony tone generator simulated by the music control device 100, a filter simulated by the music control device 100, an envelope simulated by the music control device 100, a low-frequency oscillator ("LFO") simulated by the music control device, and an amplifier simulated by the music control device 100. Collectively, such model elements of an instrument track part of a track may define a musical instrument synthesized by the music control device 100.

Further, a track may also include model elements of a mixer track part, and collectively, such model elements of a mixer track part of a track may define a mixer synthesized by the music control device 100. In general, such a mixer module may receive one or more actual or simulated inputs from one or more other model elements in the track and produce an output by varying, combining, or otherwise modulating the one or more inputs.

Further, a track may also include model elements of a sound effects track part, and collectively, such model elements of a sound effects track part of a track may define a sound effects module synthesized by the music control device 100. In general, such a sound effects module may receive one or more actual or simulated inputs from one or more other model elements in the track and produce an output by applying one or more sound effects to the one or more inputs.

Further, a track may also include model elements of a looping track part, and collectively, such model elements of a looping track part of a track may define a looping module synthesized by the music control device 100. In general, such a looping module may record and repeat a music produced by the track over a period of time.

Further, a track may also include model elements of a sequencing track part, and collectively, such model elements of a sequencing track part of a track may define a sequencing module synthesized by the music control device 100. In general, such a sequencing module may be used to compose melodies for the instrument track part of the track using duration, delay, and MIDI effects parameters, for example.

In general, each of the model elements of all of the track parts have of a track may have one or more parameters, and such parameters may be varied as described below. Further, the model elements of all of the track parts have of a track collectively define an audio output of the track according to parameters of the model elements. The music control device 100 may combine audio outputs of all of the tracks of the music control device 100 to produce an audio output signal at the output interface 238 (shown in FIG. 3).

As shown in FIG. 6, a user may actuate the track selection user input 146, which produces a track selection signal in the music control device 100 representing user selection of TRACK 3 as indicated by the track icon 268. In response to such a track selection signal, the display screen 110 displays a plurality of track setup icons, each associated with one or more of the controls 165 (namely the user inputs 128, 130, 132, 134, 138, 140, 142, 144, 148, 150, 152, 154, 158, 160, 162, and 164 in the embodiment shown in FIG. 6).

In the embodiment shown in FIG. 6, the display screen 110 displays an instrument model track setup icon shown generally at 272 in a column and row of the display screen 110 corresponding to the column and row of the user input 128 among the controls 165. The display screen 110 thus associates the instrument model track setup icon 272 with the user input 128. The instrument model track setup icon 272 lists various different instrument models stored in the instrument models store 260 (shown in FIG. 3). Rotation of the user input 128 varies the selected instrument model as shown in the instrument model track setup icon 272, so user actuation of the user input 128 thus controls the instrument model associated with the selected track. Likewise, the user input 138 is associated with a polyphony track setup icon 274 on the display screen 110, and user actuation of the user input 138 varies a polyphony setting of the selected track. The user inputs 130, 140, 150, and 160 are associated with other track setup icons shown generally at 276, 278, 280, and 282 respectively, and again user actuation of the user inputs 130, 140, 150, and 160 varies track setup parameters indicated in the track setup icons 276, 278, 280, and 282 respectively. The display screen 110, as shown in FIG. 6, illustrates a view that may be described as a "horizontal" view because the track setup icons 272, 274, 276, 278, 280, and 282 are aligned horizontally in the display screen 110 in association with a selected track and in association with respective ones of the controls 165.

Figure 7:
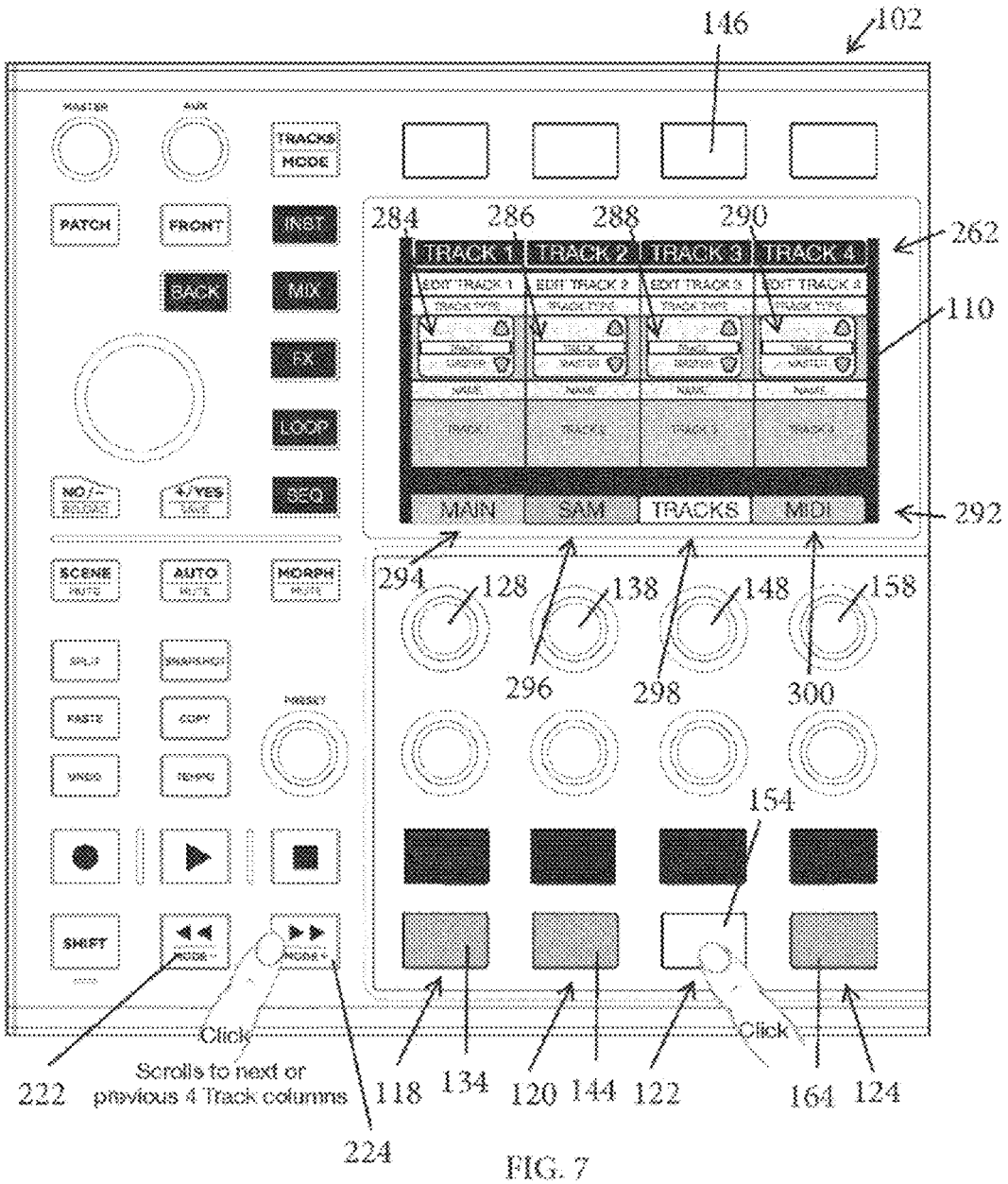

Referring to FIG. 7, the selected track may be de-selected by actuating again the track selection user input 146. When no track is selected, as shown in FIG. 7, the display screen 110 track setup icons in each of the columns 118, 120, 122, and 124 associated with each of the tracks identified in the track icon row 262. For example, the display screen 110 includes a track-type track setup icon shown generally at 284 in the first column 118 and more generally in a column and row of the display screen 110 corresponding to the column and row of the user input 128 among the controls 165. The track-type track setup icon 284 is thus associated with the user input 128. Further, the track icon row 262 associates the first column 118 with TRACK 1, so the track-type track setup icon 284 is associated with TRACK 1 by appearing in the first column 118. User actuation of the user input 128 varies the track type of TRACK 1. Likewise, a track-type track setup icon shown generally at 286 in the second column 120 is associated with TRACK 2 and with the user input 138, a track-type track setup icon 288 in the third column 122 is associated with TRACK 3 and with the user input 148, and a track-type track setup icon shown generally at 290 in the fourth column 124 is associated with TRACK 4 and with the user input 158 such that user actuation of the user inputs 138, 148, and 158 varies the track type of TRACK 2, TRACK 3, and TRACK 4 respectively.

In FIG. 7, the display screen 110 illustrates a view that may be described as a "vertical" view because each track may be controlled by user inputs and display regions in columns associated with each of the tracks. The reverse user input 222 and the forward user input 224 may be used to stroll the display screen 110 backwards and forwards among sets of four tracks.

Further, in FIG. 7, the display screen 110 includes a tab selection row shown generally at 292 including a tab icon shown generally at 294. The tab icon 294 is in a column and row of the display screen 110 corresponding to the column and row of the user input 134 among the controls 165. The track-type track setup icon 284 is thus associated with the user input 134. Further, the tab icon 294 has the same color as the user input 134, so the track-type track setup icon 284 is thus further associated with the user input 134. Likewise, the tab selection row 292 includes a tab icon shown generally at 296 in the second column 120 and associated with the user input 144, a tab icon shown generally at 298 in the third column 122 and associated with the user input 154, and a tab icon shown generally at 300 in the fourth column 124 and associated with the user input 164. User actuation of the user inputs 134, 144, 154, and 164 causes selection of the respective tab associated with the tab icons 294, 296, 298, and 300 respectively. For example, as shown in FIG. 7, user actuation of the user input 154 causes the display screen 110 to display a tracks tab identified by the tracks tab icon 298, and the tracks tab includes the track-type track setup icons 284, 286, 288, and 290 as described above and as shown in FIG. 7. User selection of a different tab causes different track setup icons to be displayed in the display screen 110, which causes different track-setup parameters to be associated with and modified by one, more than one, or all of the controls 165.

Figure 8:
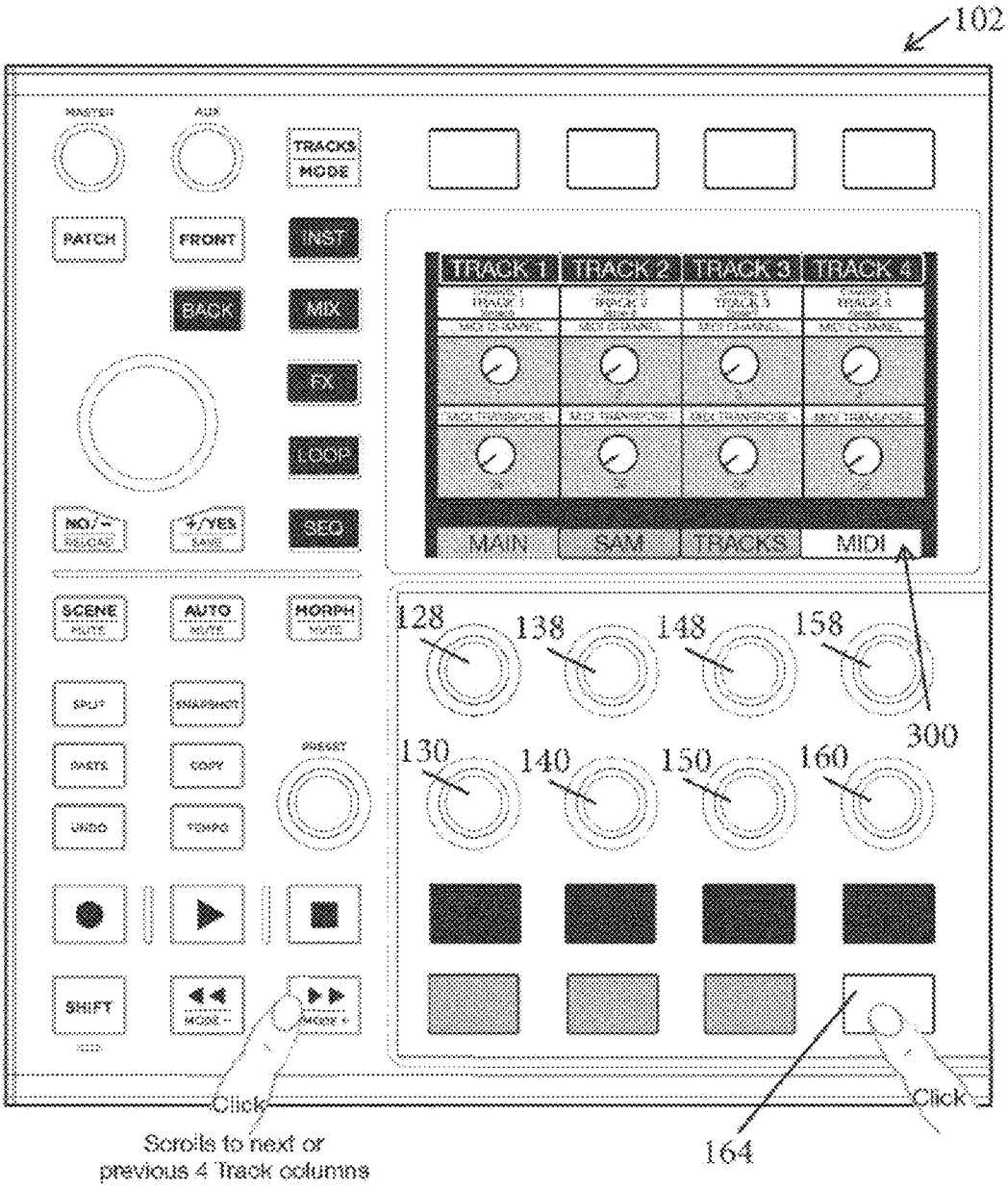

For example, as shown in FIG. 8, user selection of the user input 164 causes the display screen 110 to display track setup icons from a MIDI tab indicated by the tab icon 300, and the track setup icons shown in FIG. 8 represent MIDI track-setup parameters that may be modified, for each of the tracks, by user actuation of the user inputs 128, 130, 138, 140, 148, 150, 158, and 160.

The embodiment of FIGS. 6 to 8 includes only four tracks, but alternative embodiments may include fewer or more tracks. For example, in embodiments including the expansion module 104 (as shown in FIG. 1), the display screen 242 may include columns similar to the columns shown in the display screen 110 in FIGS. 6 to 8, but in association with four additional tracks such as TRACK 5, TRACK 6, TRACK 7, and TRACK 8, for example, and such columns in the display screen 242 may operate as described herein in response to the controls 244 and independently from the columns in the display screen 110. Further, in embodiments including the expansion module 106 (as shown in FIG. 1), the display screen of the expansion module 106 may include columns similar to the columns shown in the display screen 110 in FIGS. 6 to 8, but in association with four additional tracks such as TRACK 9, TRACK 10, TRACK 11, and TRACK 12, for example, and again such columns in the display screen of the expansion module 106 may operate as described herein in response to controls on the expansion module 106 and independently from the columns in the display screens of the other modules. Still further, in embodiments including the expansion module 108 (as shown in FIG. 1), the display screen of the expansion module 108 may include columns similar to the columns shown in the display screen 110 in FIGS. 6 to 8, but in association with four additional tracks such as TRACK 13, TRACK 14, TRACK 15, and TRACK 16, for example, and again such columns in the display screen of the expansion module 108 may operate as described herein in response to controls on the expansion module 108 and independently from the columns in the display screens of the other modules. Such expansion across multiple modules is not limited to instrument setup view as illustrated in FIGS. 6 to 8, but may apply more generally to the various interfaces and interactions described herein so that the expansion modules 104 may effectively extend the display screen 110 into a display including a plurality of display screens, and effectively extend the controls 165 into a larger plurality of controls.

Like instrument setup view as illustrated in FIGS. 6 to 8, selecting the front selection user input 186 (shown in FIG. 2) and then holding the mixer track-part selector user input 170 (also shown in FIG. 2) for a predetermined period of time (such as one or two seconds, for example) causes the display screen 110 to display a mixer setup view that may be used for track setup of mixer modules of the various tracks as described above.

Further, the storage memory 230 (shown in FIG. 3) includes a sound effects models store 302, which stores models of sound effects modules that may be synthesized by the music control device 100, and selecting the front selection user input 186 and then holding the sound effects track-part selector user input 172 (also shown in FIG. 2) for a predetermined period of time (such as one or two seconds, for example) causes the display screen 110 to display a sound effects setup view that may be used for track setup of sound effects modules of the various tracks as described above.

Likewise, selecting the front selection user input 186 and then holding the looper user input track-part selector 174 (also shown in FIG. 2) for a predetermined period of time (such as one or two seconds, for example) causes the display screen 110 to display a looper setup view that may be used for track setup of looper modules of the various tracks as described above.

Likewise, selecting the front selection user input 186 and then holding the sequencing track-part selector user input 176 (also shown in FIG. 2) for a predetermined period of time (such as one or two seconds, for example) causes the display screen 110 to display a sequencing setup view that may be used for track setup of sequencing modules of the various tracks as described above.

Once the tracks are set up as described above, track setup information may be stored in a track setup store 304 in the storage memory 230 (shown in FIG. 3).

Figure 9:
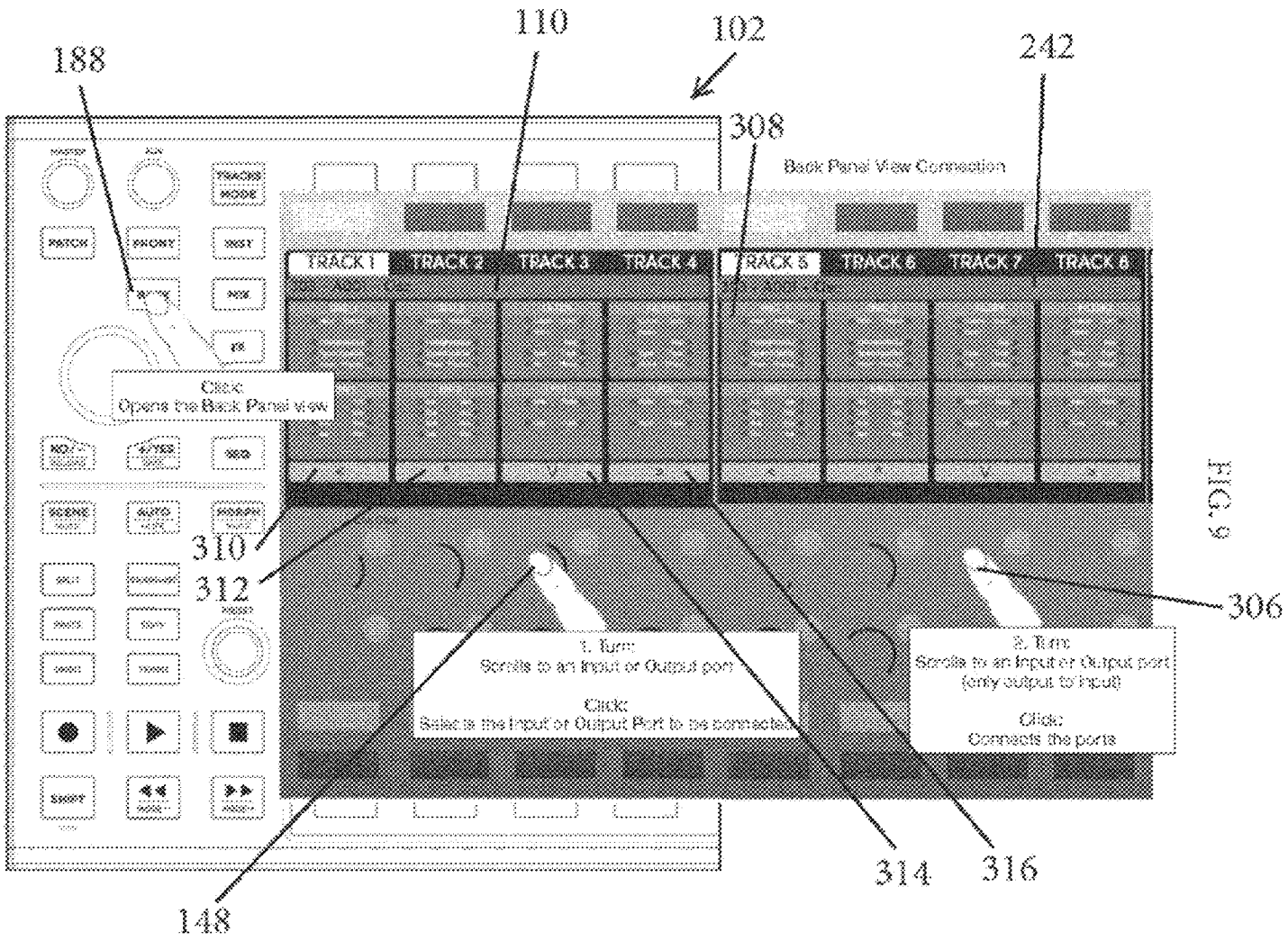

Referring to FIG. 9, user selection of the back selection user input 188 allows user modification of simulated interconnections between model elements such as those described herein. FIG. 9 schematically illustrates the display screen 110 adjacent the display screen 242 of the expansion module 104 and collectively functioning as a display. In the embodiment shown in FIG. 9, the display screen 110 includes a "horizontal" view of model elements in TRACK 1 following user selection of TRACK 1 and the display screen 242 includes a "horizontal" view of music elements of TRACK 5 following user selection of TRACK 5. Accordingly, in the embodiment of FIG. 9, the expansion module 104 expands the main module 102 because the display screen 242 extends the display screen 110 such that the display screens 110 and 242 collectively function as a display having columns of the display screens 110 and 242, and because the display-column-associated user inputs 243 extend the display-column-associated user inputs 114 such that the display-column-associated user inputs 114 and the display-column-associated user inputs 243 collectively function as user inputs or controls in columns associated with respective columns of the display screens 110 and 242 collectively.

Model elements of TRACK 1 are identified by respective model element icons in the display screen 110 and include a first oscillator ("OSC_1"), a second oscillator ("OSC_2"), a first filter ("FILTER"), a second filter ("FILTER2"), a first envelope ("ENV1"), a second envelope ("ENV2"), a first low-frequency oscillator ("LFO1"), a second low-frequency oscillator ("LFO2"). Each of the model elements of TRACK 1 is associated with a respective one model element icon on the display screen 110, and with of the user inputs 128, 130, 138, 140, 148, 150, 158, and 160 as described above.

User actuation of the user inputs 128, 130, 138, 140, 148, 150, 158, and 160 controls simulated interconnections between the model elements of TRACK 1. For example, as shown in FIG. 9, turning the user input 148 changes indicated inputs (on the left side of the region of the first filter) or outputs (on the right side of the region representing the first filter). In one embodiment, turning the user input 148 left changes indicated inputs (on the left side of the region of the first filter) and turning the user input 148 right changes indicated outputs (on the right side of the region representing the first filter). Then, clicking or pressing the user input 148 selects the currently indicated input or output for simulated interconnection. In some embodiments, a dialog may identify the currently indicated input or output. Then, turning a user input 306 (on the expansion module 104, corresponding to the user input 148, and associated with the FILTER of TRACK 5) changes indicated an input or output of the FILTER of TRACK 5. Again, in one embodiment, turning the user input 306 left changes indicated inputs (on the left side of the region of the first filter) and turning the user input 306 right changes indicated outputs (on the right side of the region representing the first filter). Then, pressing or clicking the user input 306 completes a simulated interconnection from the first selected input or output to the second selected input or output, and a line 308 visually indicates the completed simulated interconnection.

The simulated interconnections may be between model elements of different track parts, and the track-part selectors 166 may be used to change from one track part to another track part to create a simulated interconnection between a model element of one track part to a model element of another track part. For example, simulated interconnections between model elements in the mixer track part can cause volume of one model element to control volume of another model element, and can configure sidechain compression. Simulated interconnections may include serial or parallel connections.

Further, in the "horizontal" view of FIG. 9, left and right scroll icons 310 and 312 respectively indicate functions of the user inputs 132 and 142 respectively, and up and down scroll indicators 314 and 316 respectively indicate functions of the user inputs 152 and 162 respectively, such that the user inputs 132, 142, 152, and 162 may be used to scroll left, right, up, and down to view different model elements of the selected track.

Further, turning a user input to an input or output, and pressing and holding the user input, causes a modulation mixer to appear for the selected input or output. The modulation mixer lists the simulated interconnections at that point and their depths (or amounts of modulation), and parameters of the modulation mixer may then be varied.

FIG. 9 illustrates interconnections across different display screens, but interconnections may also be made on only one display screen.

Figure 10:
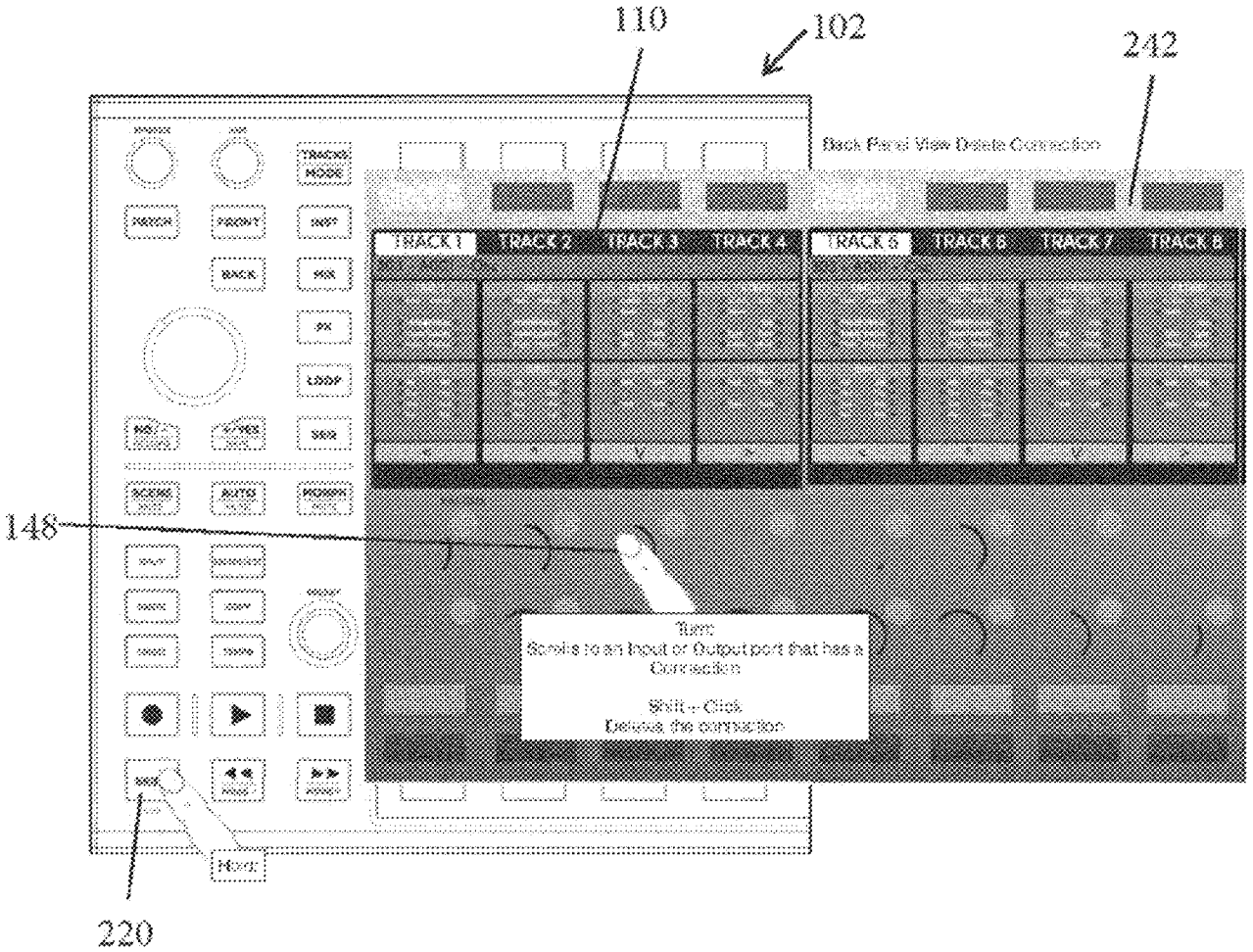

Referring to FIG. 10, rotation of the user input 148 may select a previously made simulated interconnection and a combination of the shift user input 220 and pressing or clicking the user input 148 deletes the indicated simulated interconnection. If deletion is selected at a point having multiple simulated interconnections, then a dialog may prompt the user to select which simulated interconnection to delete. When the dialog is shown, a combination of the shift user input 220 and pressing or clicking the user input 148 deletes all of the simulated interconnections at that point.

Figure 12:
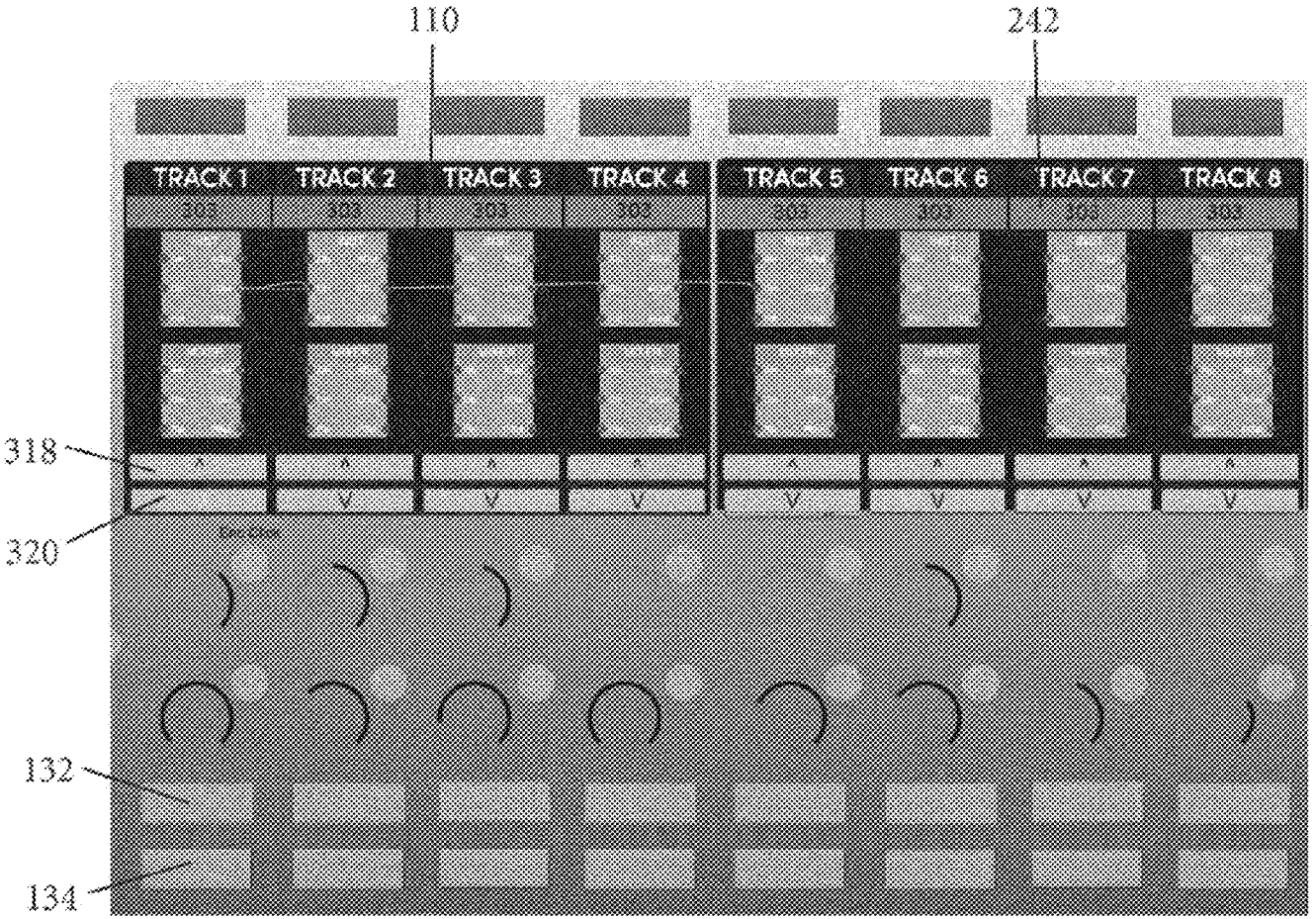

Referring to FIG. 12, simulated interconnections such as those described above may be visualized in a "vertical" view in which each column in the display screens 110 and 242 is associated with a respective different track. In the "vertical" view of FIG. 12, each column includes icons representing model elements of a respective track, and up and down scroll indicators 318 and 320 respectively indicate functions of the user inputs 132 and 134 respectively, such that the user inputs 132 and 134 may be used to scroll up and down to view different model elements of the tracks shown in the display screens 110 and 242. When viewing the "back" panel in a "vertical" view, simulated interconnections (such as individual simulated audio connections, individual simulated control connections, or combinations thereof, for example) may be grouped together, and groups of simulated interconnections may be varied as such groups. Varying groups of simulated interconnections may be more efficient than varying individual simulated interconnections.

Figure 11:
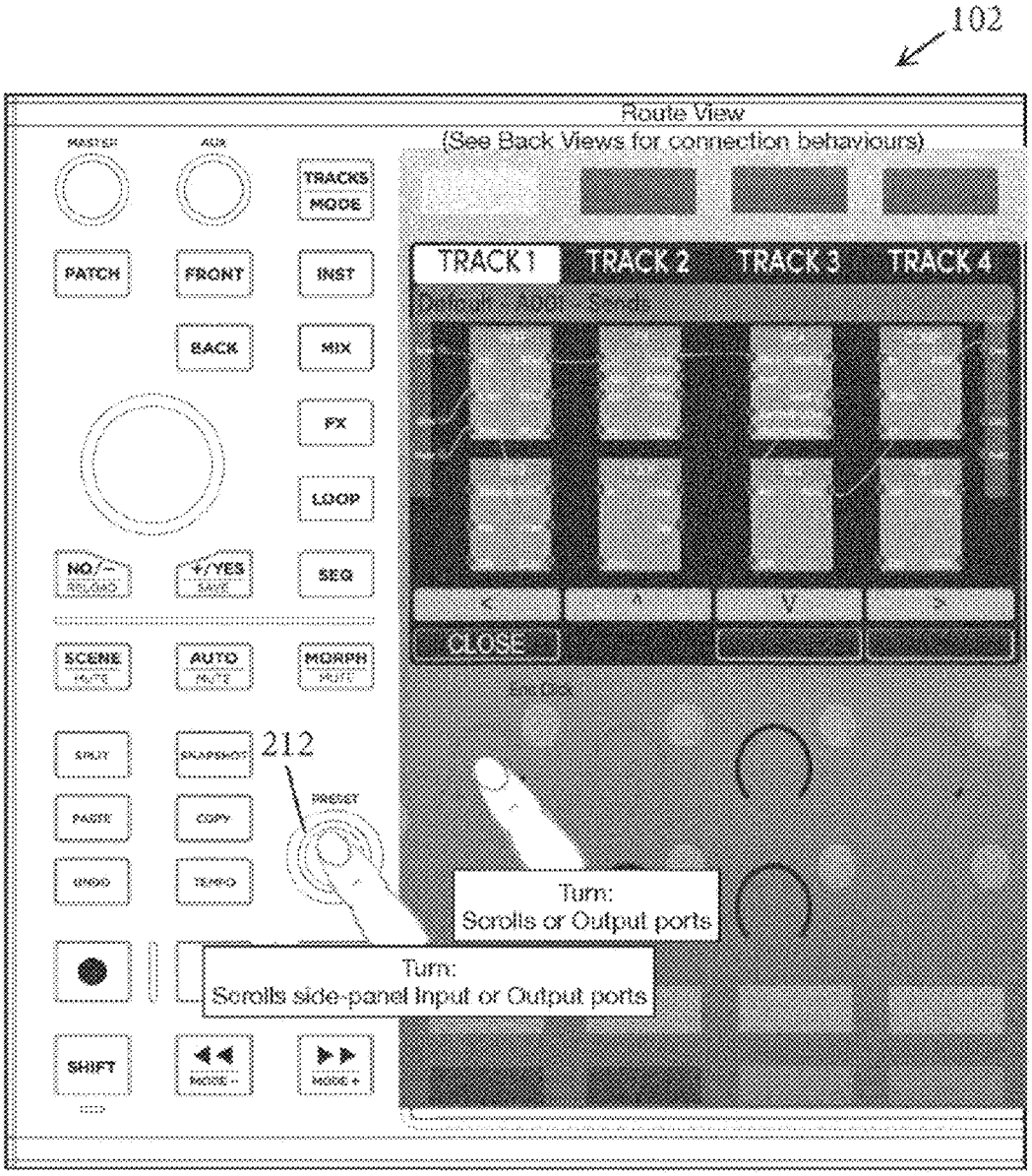

FIG. 11 illustrates a routing view. Editing of the "back" of the device, following user actuation of the back selection user input 188 as shown in FIGS. 9, 10, and 12, involves editing simulated external connection of a parameter model, whereas editing of the "front" allows of the device, following user actuation of the front selection user input 186, allows manipulation or variation of parameters external to the internal workings of the model. The routing view of FIG. 11 illustrates the internal workings of a model. Some models will have a routing view, but some will not. For models that have a routing view, the routing view allows users to change simulated interconnections that configure a model, similar to how simulated interconnections between different models may be defined on the "back" of the device as described above with reference to FIGS. 9, 10, and 12. In the routing view of FIG. 11, the left and right side connection points correspond to the external logical and signal inputs of the model itself, such as audio input, audio output, or control signals, for example. The left and right side connection points of the main module may be selected with the preset user input 212, and the left and right side connection points of the other modules may be selected with corresponding controls.

Figure 13:
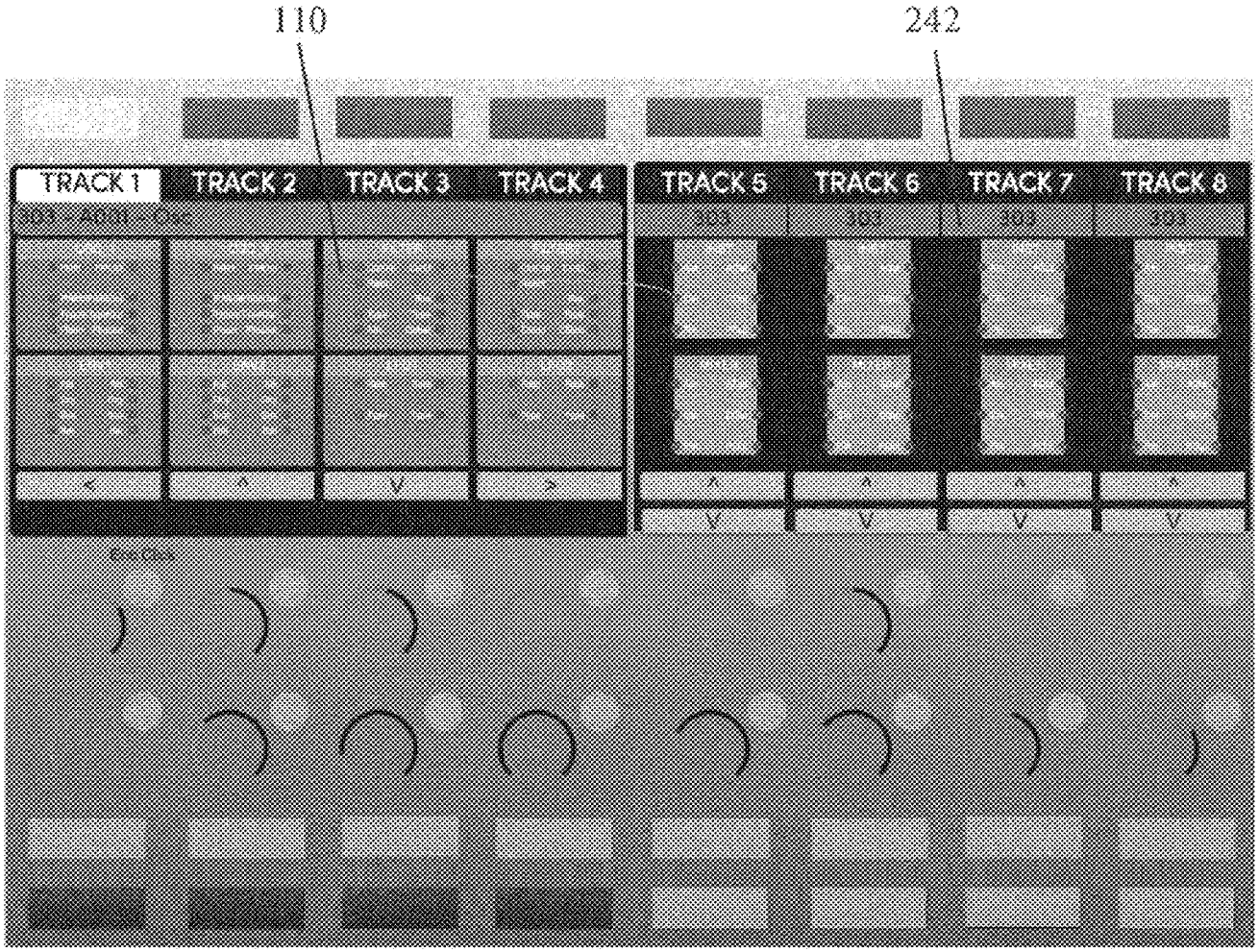

Referring to FIG. 13, the display screens 110 and 242 may be in a mixture of views. For example, as shown in FIG. 13, the display screen 110 may be in a "horizontal" view (in which each column in each display screen is associated with one track), and the display screen 242 may be in a "vertical" display (in which each column in the display screens is associated with a respective different track).

Once simulated interconnections are set up as described above, interconnection information may be stored in a connections store 322 in the storage memory 230 (shown in FIG. 3).

Figure 14:
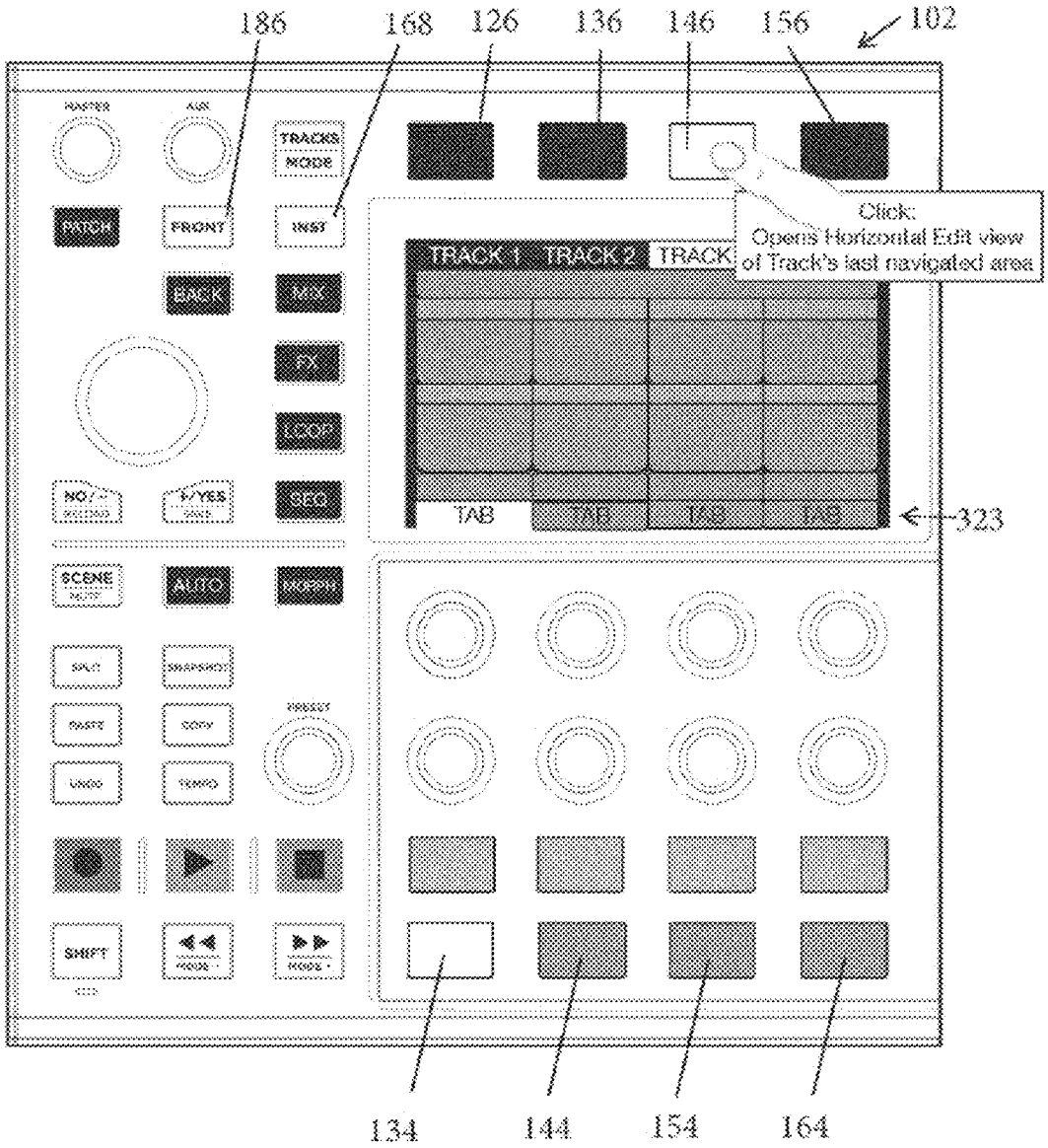

Referring to FIG. 14, user selection of the front selection user input 186 permits modifications of parameters of model elements of the tracks once set-up and interconnected as described above. For example, as shown in FIG. 14, user selection of the instrument track-part selector user input 168 allows user modification of parameters of instrument music elements of tracks of the music control device 100. Selection of one of the track selection user inputs 126, 136, 146, and 156 selects the associated track indicated by the respective track icons aligned with the track selection user inputs 126, 136, 146, and 156, and each of the user inputs 134, 144, 154, and 164 may be associated with a respective tab identified by a respective tab icon in a row of tab icons shown generally at 324.

Figure 15:
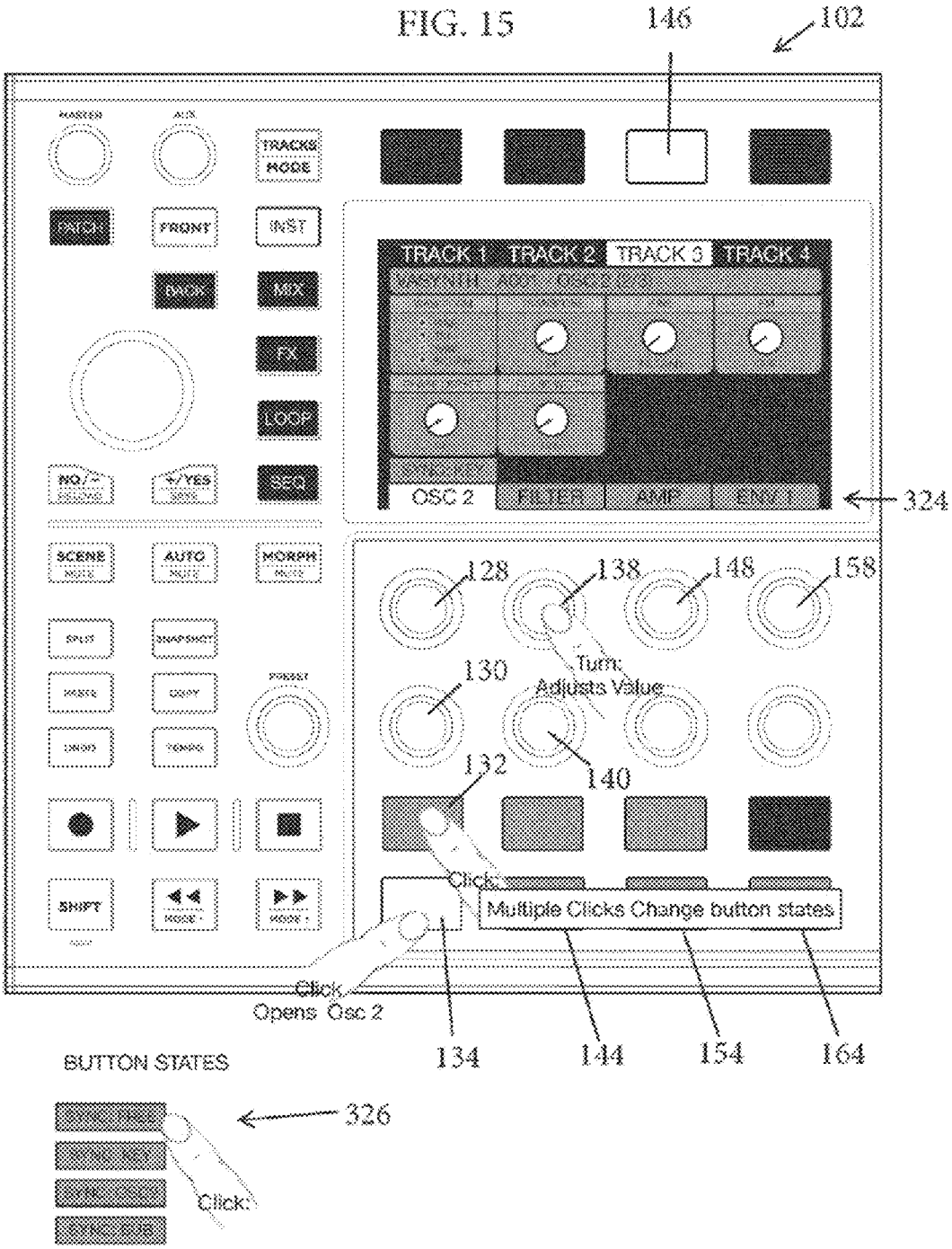

Referring to FIG. 15, an example of the instrument parameter modification mode includes four tabs, namely "OSC 2" associated with the user input 134, "FILTER" associated with the user input 144, "AMP" associated with the user input 154, and "ENV 1" associated with the user input 164. Each of the tabs includes icons representing a plurality of parameters of model elements of a selected track, and selecting one of the tabs involves producing a parameter subset selection signal representing user selection of a subset of parameters of model elements in a selected track part (selected using the instrument track-part selector user input 168) of a selected track (selected using the track selection user input 146). The parameter subset selection signal causes the display to display parameter icons in association with controls of the music control device 100.

For example, in the embodiment of FIG. 15, user selection of the user input 134 selected the tab "OSC 2", which includes parameter icons each associated with a parameter of a model element in the selected track part of the selected track, and each associated with one of the user inputs 128, 130, 132, 138, 140, 148, and 158. The parameters associated with the user inputs 128, 130, 138, 140, 148, and 158 may be modified by rotation of those user inputs, and the parameter associated with the user input 132 cycles through a plurality of states shown generally at 326 in response to user actuation of the user input 132.

Figure 16:
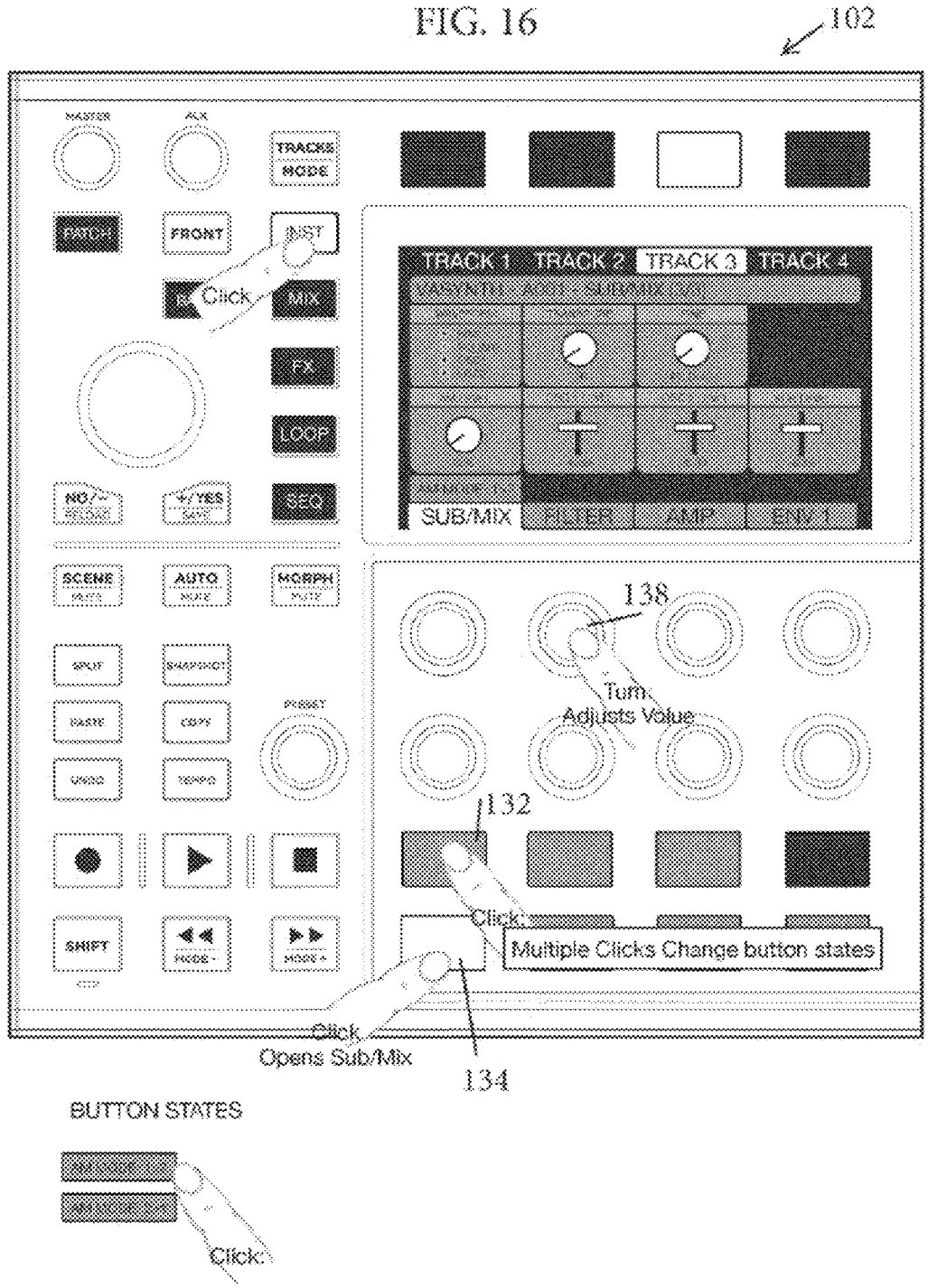
Figure 17:
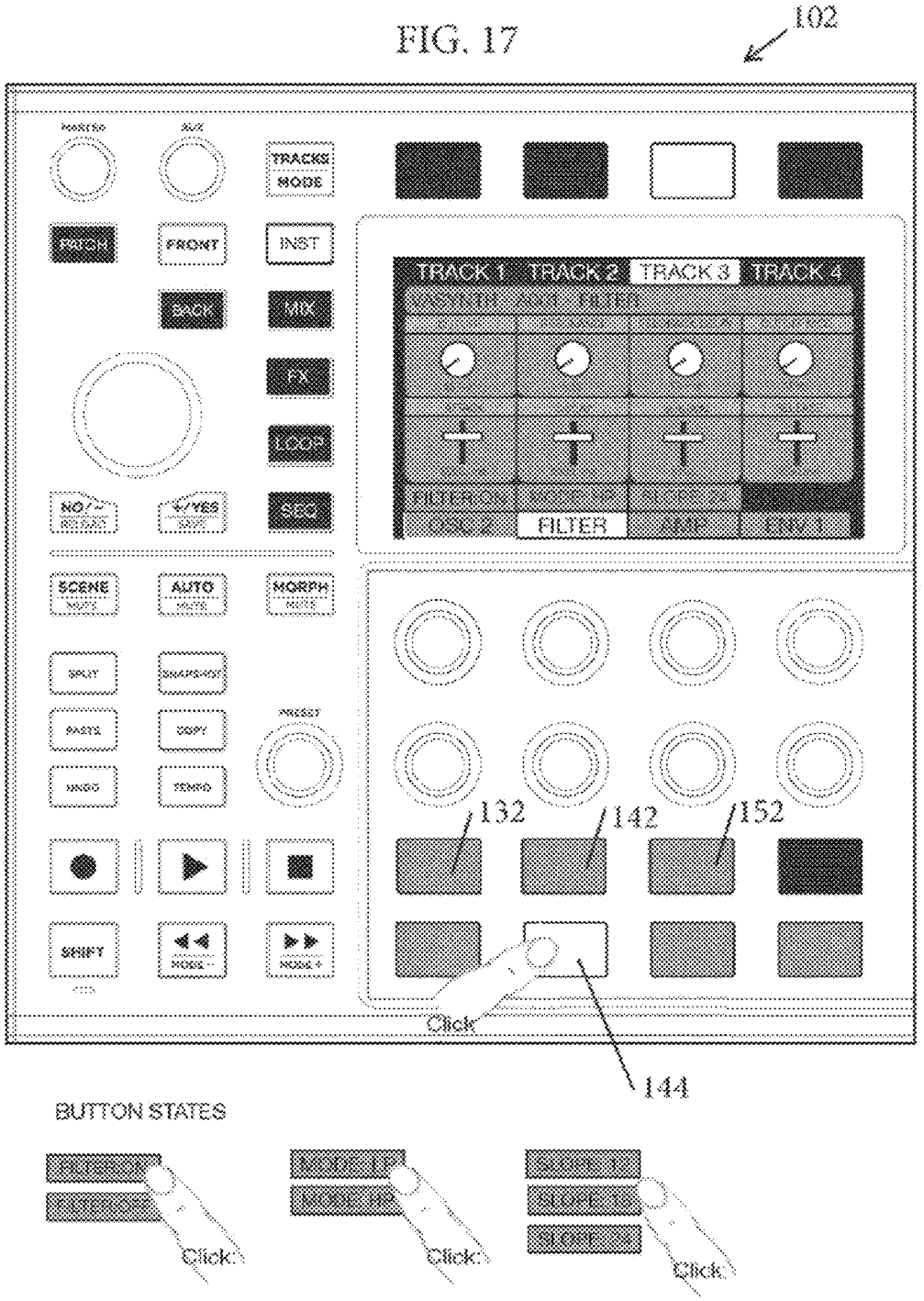

Referring to FIG. 16, further user actuation of the user input 134 replaces the tab "OSC 2" with a different tab "SUB/MIX", which includes icons representing different parameters than the "OSC 2" tab. In other words, the user input 134 is associated with an icon that changes in response to user actuation of the user input 134, and that is associated with different subsets of parameters of the selected track and of the selected track part. When user actuation of the user input 134 causes the "OSC 2" tab to be replaced with the "SUB/MIX" tab, the different icons are associated with respective ones of the controls as described above. For example, the user input 132 is associated with a "AM MODE" parameter, and the "AM MODE" parameter has two discrete values "1>2" and "2>1" such that user actuation of the user input 132 causes the parameter "AM MODE" to cycle between the parameter values "1>2" and "2>1". As another example, rotating the user input 138 varies a "TRANSPOSE" parameter of a model element of the selected track and of the selected track part.

As another example, referring to FIG. 16, the user input 144 is associated with an icon representing a "FILTER" tab, and user actuation of the user input 144 causes parameter icons of the "FILTER" tab to appear on the display screen 110. Again, each of the parameter icons of the "FILTER" tab is associated with a respective one of the controls and with a parameter of at least one model element of the selected track and the selected track part, and user actuation of the controls may vary parameters associated with the parameter icons. For example, the user input 132 is associated with a "FILTER" parameter, and user actuation of the user input 132 causes the "FILTER" parameter to switch between "ON" and "OFF" discrete values. Likewise, the user input 142 is associated with a parameter icon associated with a "MODE" parameter, and user actuation of the user input 142 causes the "MODE" parameter to switch between "LP" and "HP" discrete values. As another example, the user input 152 is associated with a parameter icon representing a "SLOPE" parameter, and user actuation of the user input 152 causes the value of the "SLOPE" parameter to change between "12", "18", and "24" discrete values.

Figure 18:
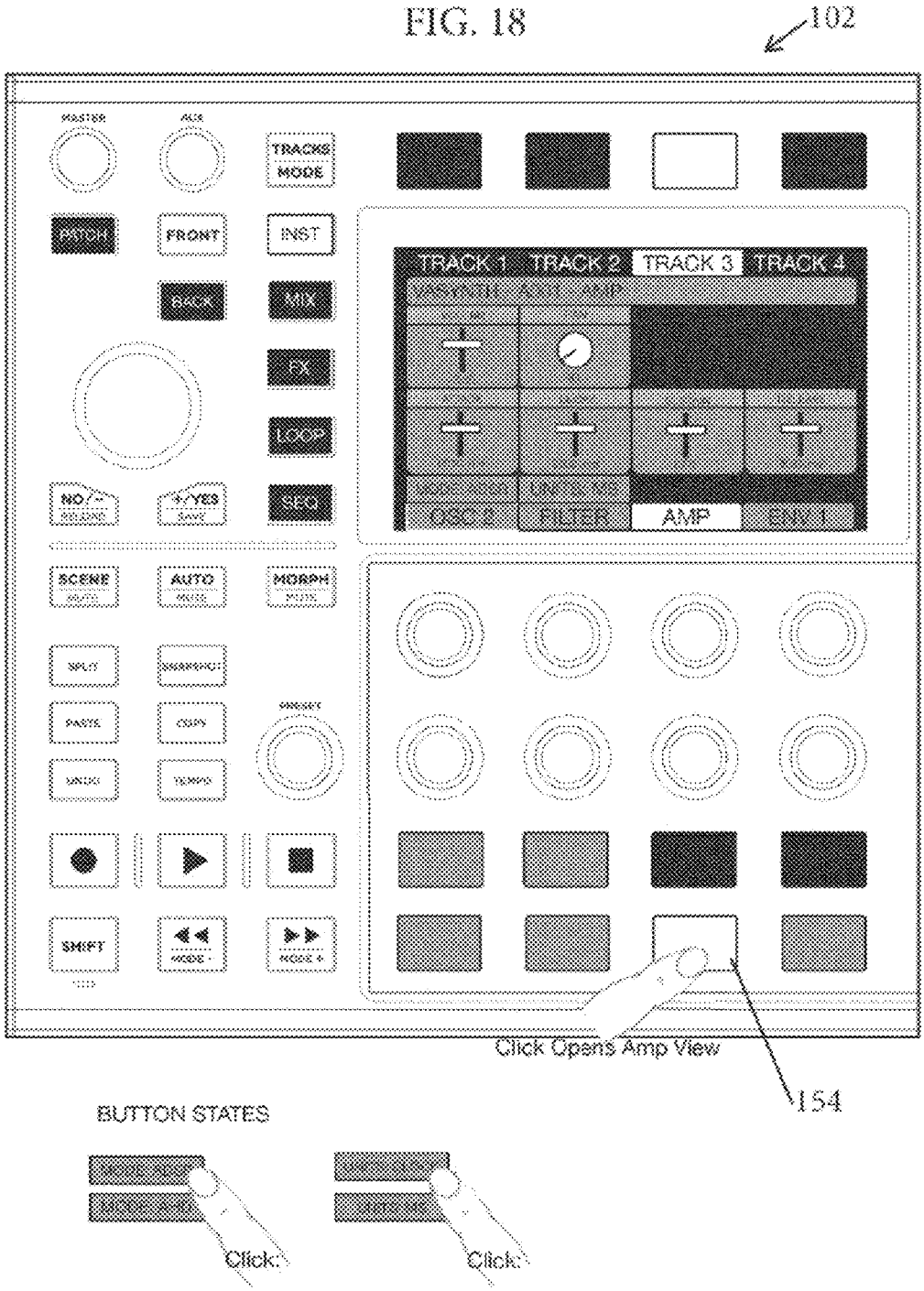
Figure 19:
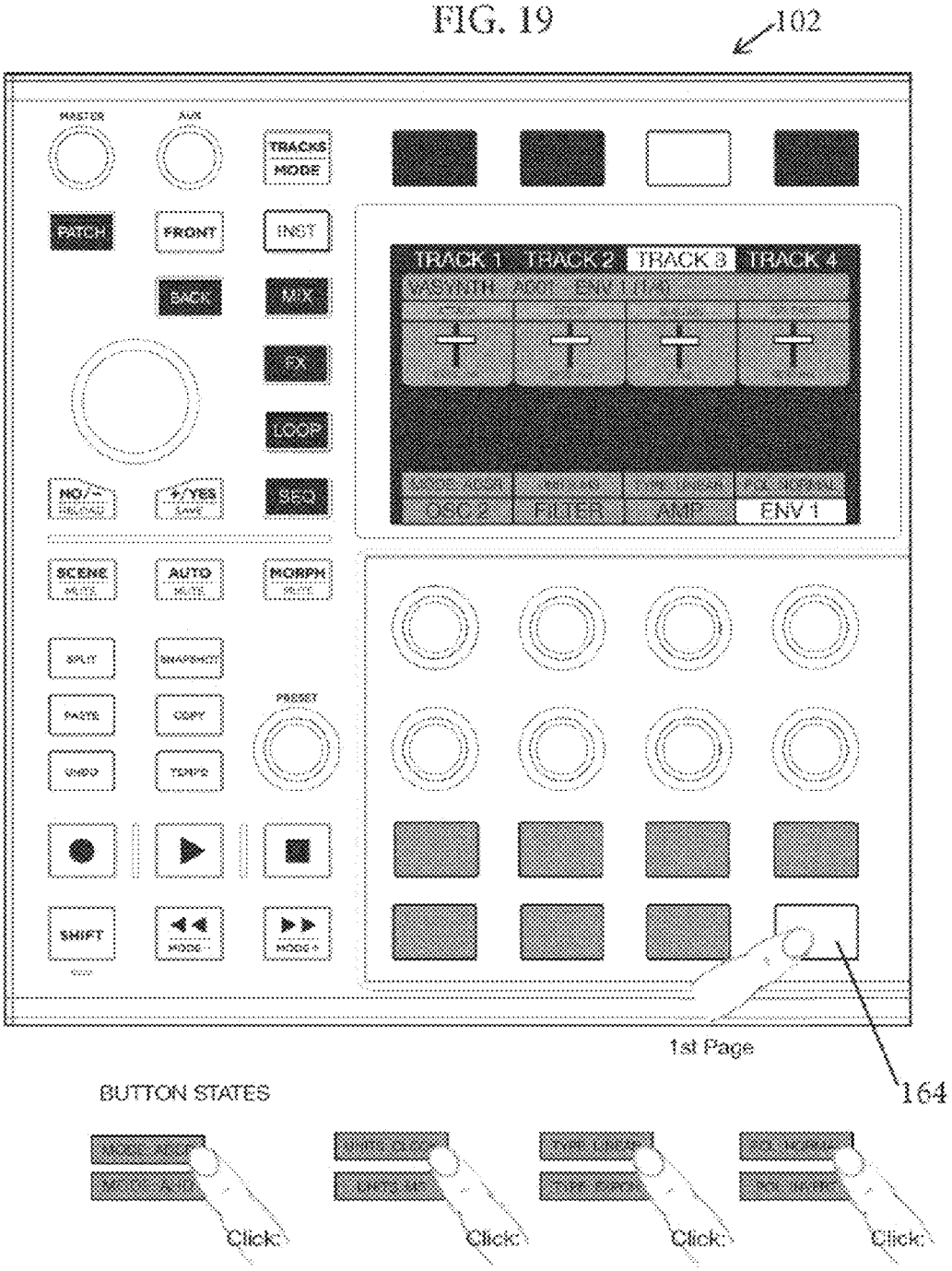
Figure 20:
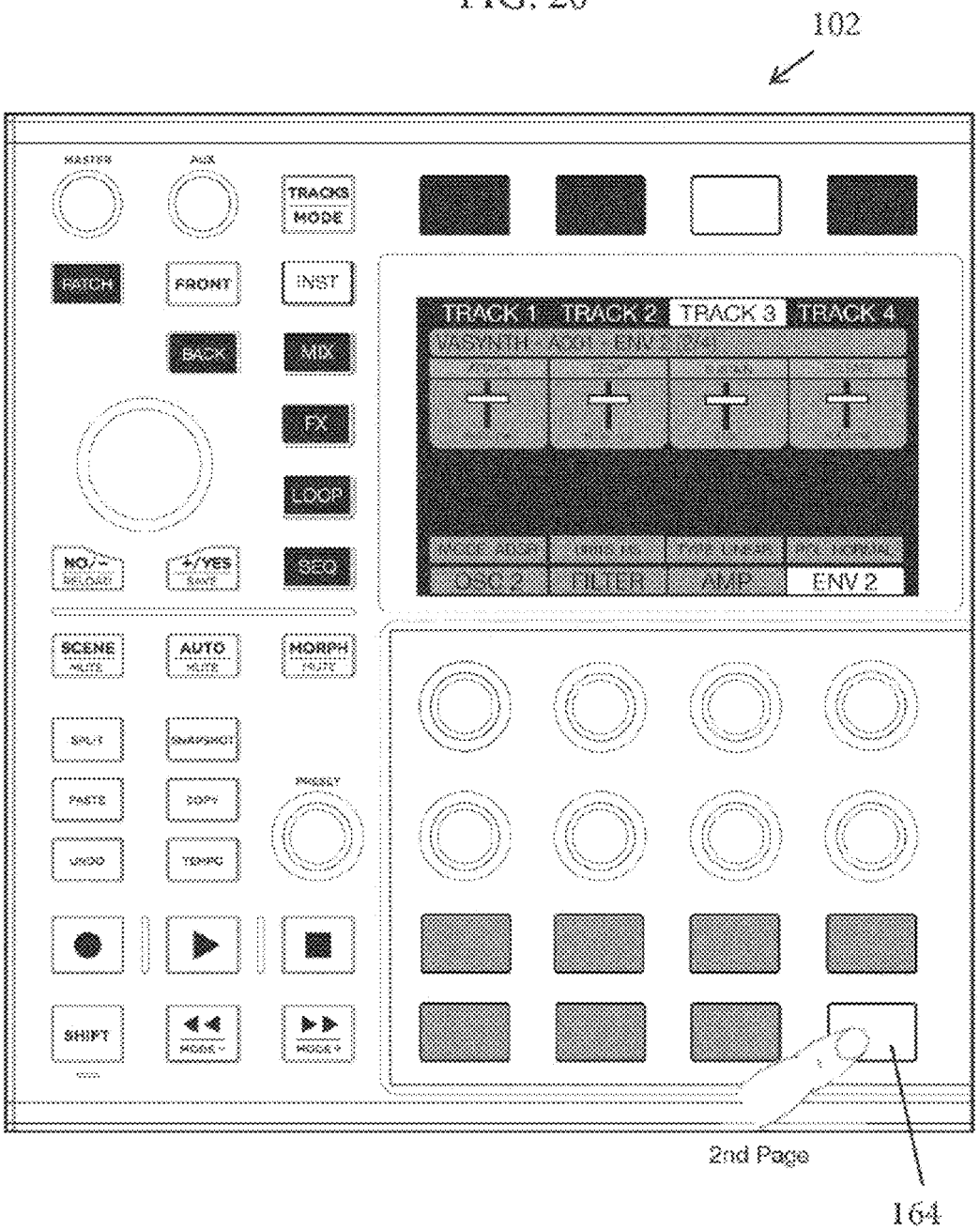
Figure 21:
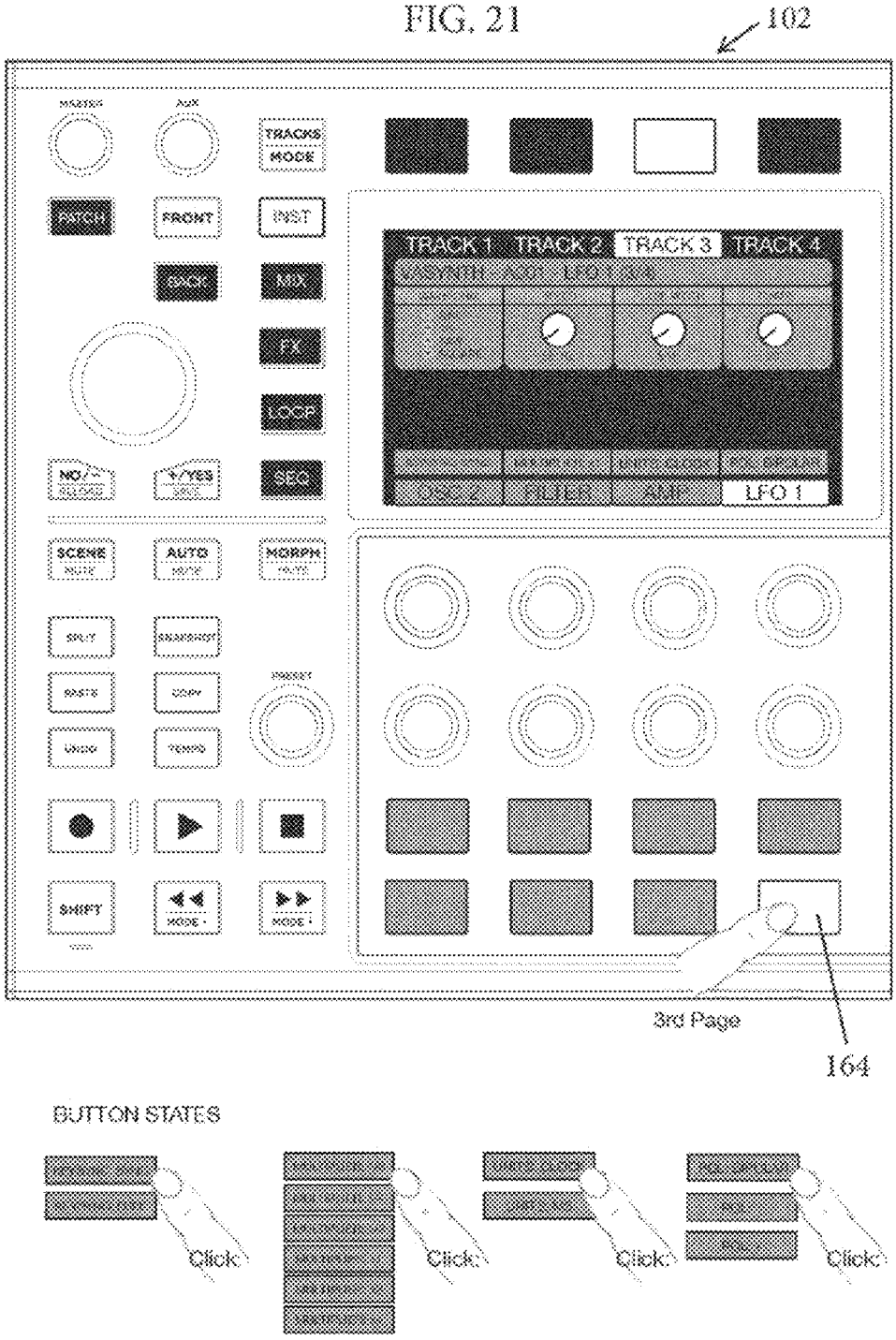
Figure 22:
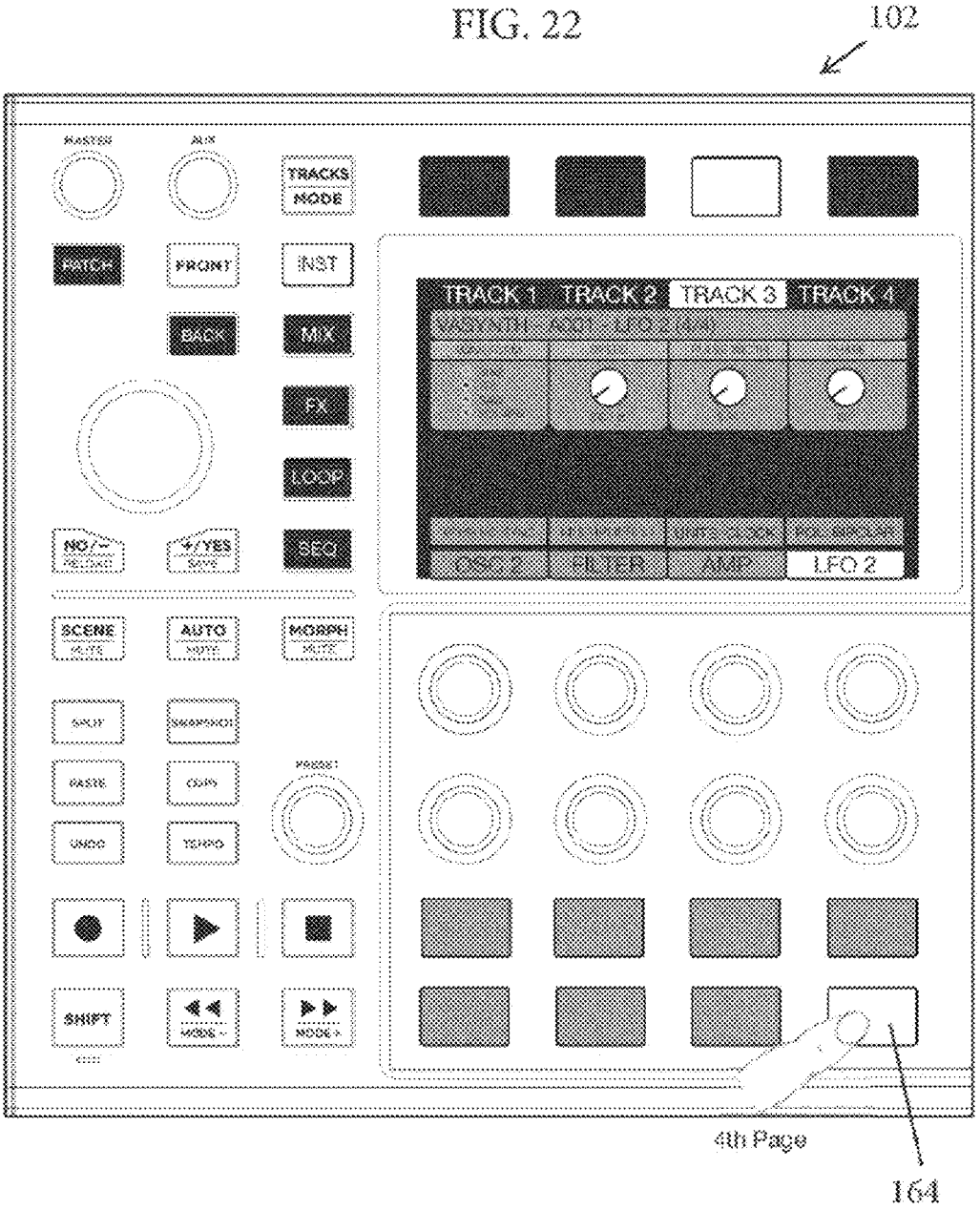

Referring to FIG. 18, the user input 154 is associated with an icon indicating an "AMP" tab, which includes parameter icons associated with respective controls and associated with respective parameters of at least one musical element of the selected track part of the selected track.

As shown in FIGS. 19 to 22, the user input 164 is associated with four tabs, namely "ENV 1", "ENV 2", "LFO 1", and "LFO 2". Each of those tabs includes icons associated with respective parameters of at least one model element of the selected track part of the selected track, and the parameter icons are associated with respective ones of the controls varies the associated parameters as described above.

Figure 23:
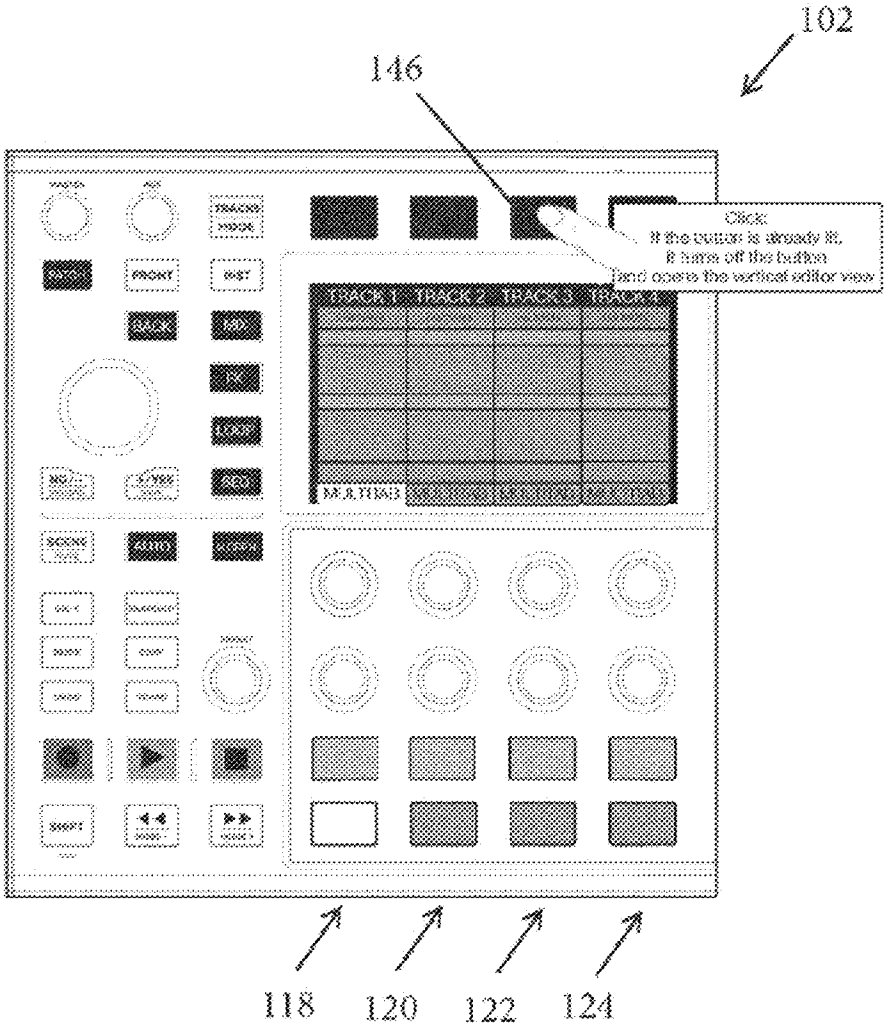

As indicated above, user actuation of the user input 146 produced a track selection signal indicating user selection of "TRACK 3". As shown in FIG. 23, further user actuation of the user input 146 involves producing a track de-selection signal representing user de-selection of the selected track. In response to the track de-selection signal, the display screen 110 displays a "vertical" view in which each column in the display screen 110 is associated with a respective different track. In the embodiment shown in FIG. 23, the first column 118 is associated with "TRACK 1", the second track 120 is associated with "TRACK 2", the third column 122 is associated with "TRACK 3", and the fourth column 124 is associated with "TRACK 4" such that icons and controls in each of those columns are associated with at least one model element of the selected track group of the associated track.

Figure 24:
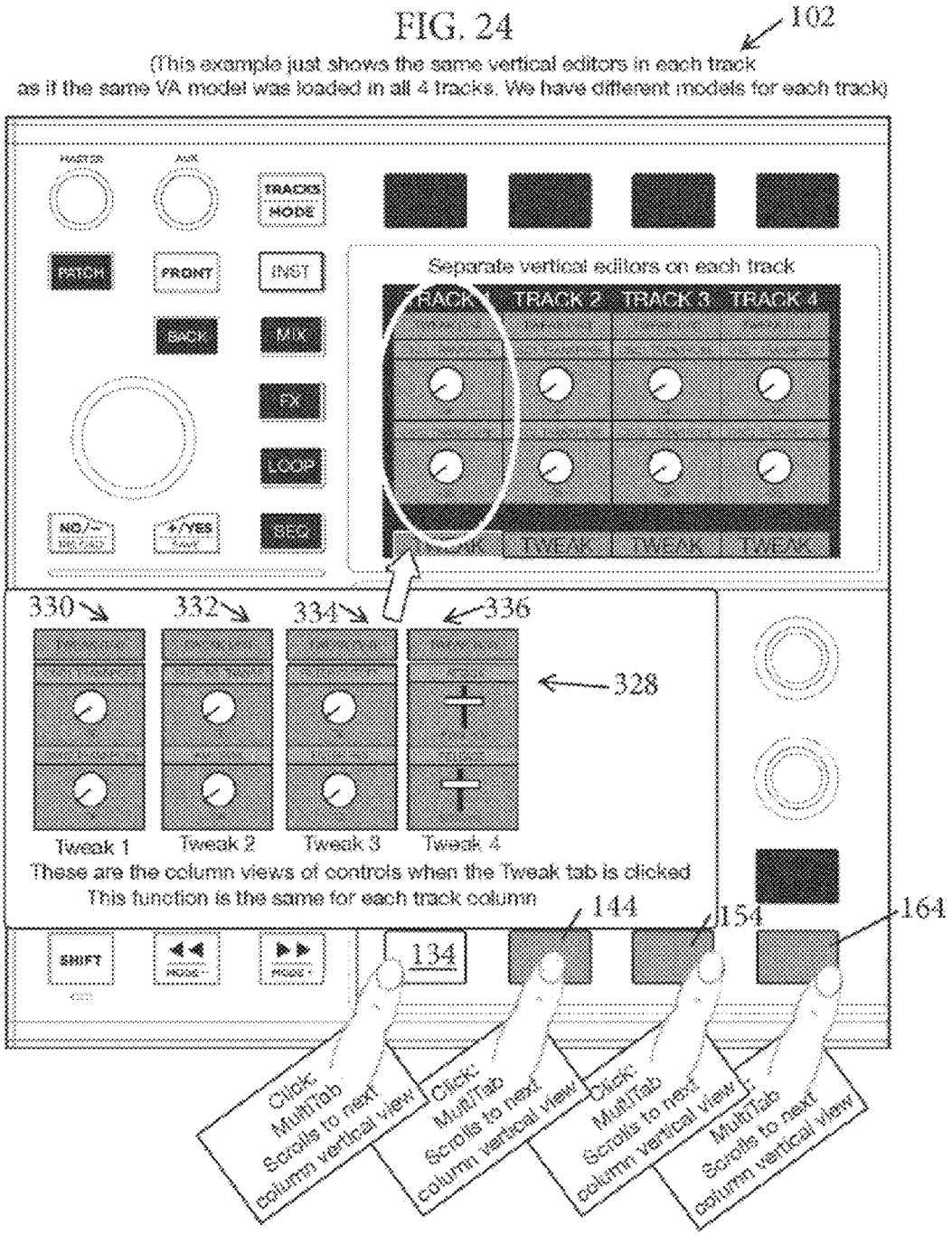

FIG. 24 illustrates an example of parameter icons associated with parameters "OSC 1 transpose" and "OSC 2 transpose" in the instrument track group of four tracks "TRACK 1", "TRACK 2", "TRACK 3", and "TRACK 4". Further, the user inputs 134, 144, 154, and 164 are each associated with a plurality of sets of parameters shown generally at 328. Therefore, user actuation of the user input 134 cycles the icons in the first column 118 between the first subset of parameters shown generally at 330, the second subset of parameters shown generally at 332, the third subset of parameters shown generally at 334, and the fourth subset of parameters shown generally at 336. The parameters shown in each of the columns may be different, so that user actuation of the user input 134 may cause the first subset of parameters 330 to be shown, whereas user actuation of the user inputs 144, 154, and 164 may cause different subsets of the parameters to be displayed in the other columns.

Figure 25:
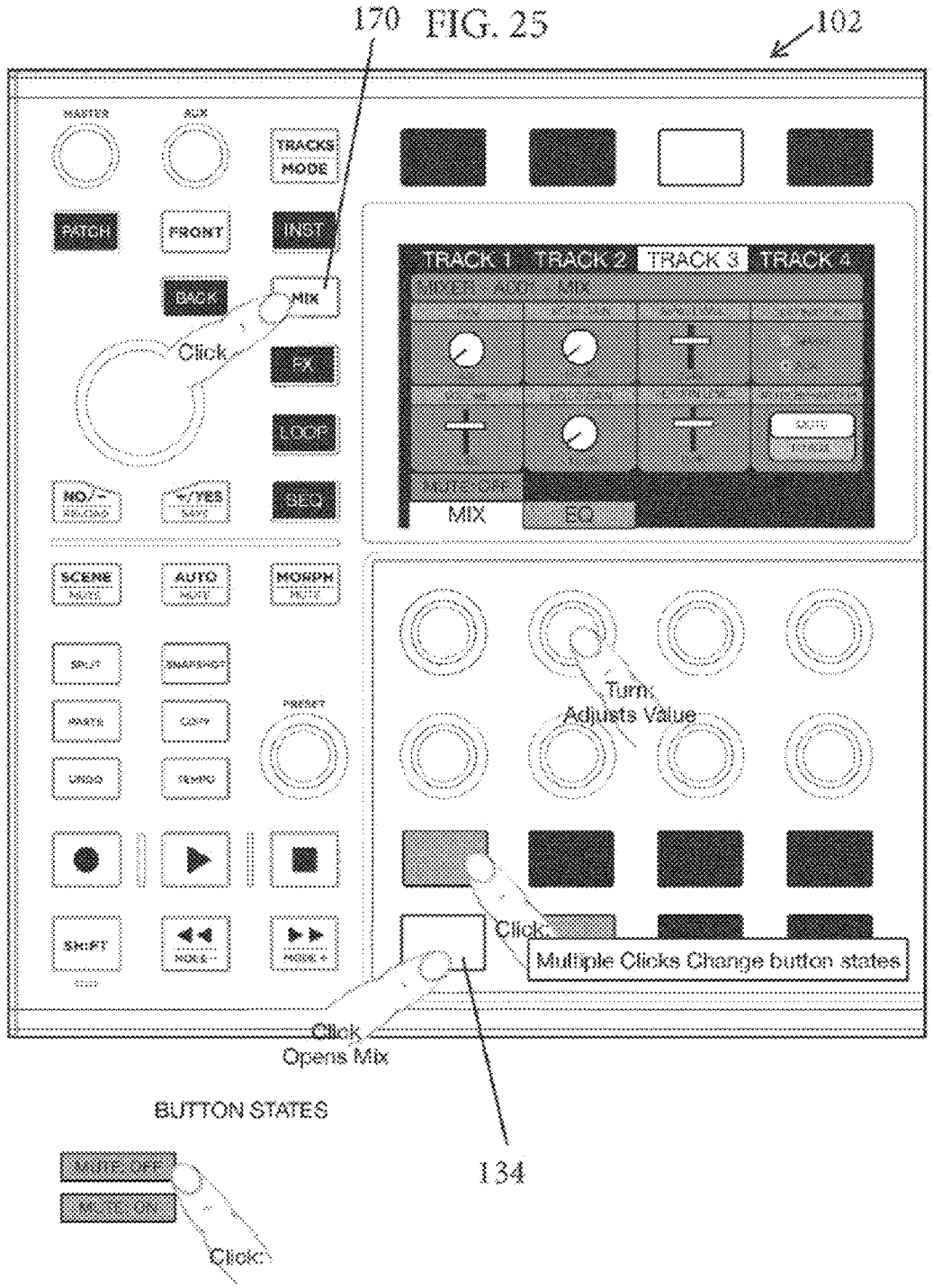
Figure 26:
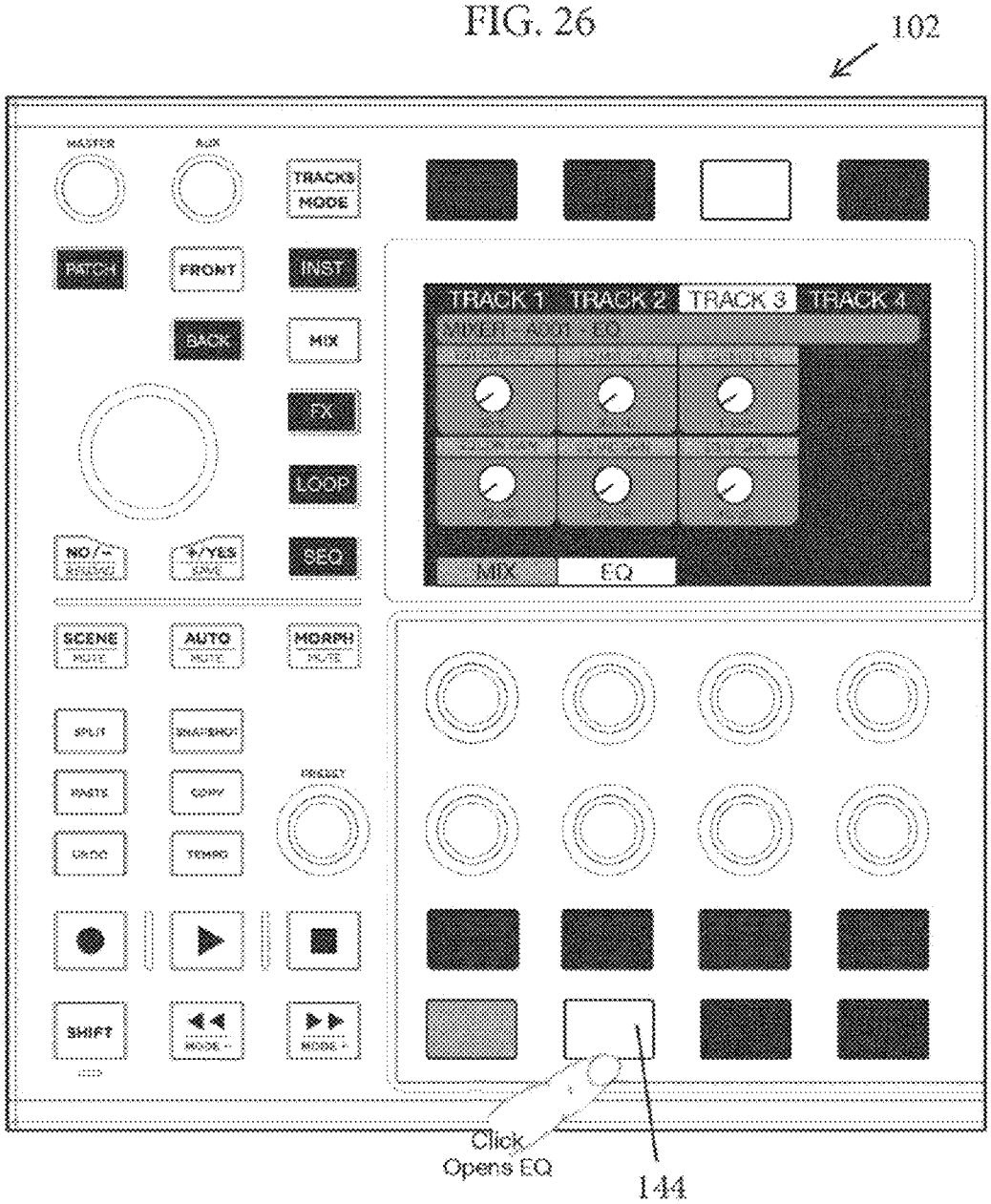
Figure 27:
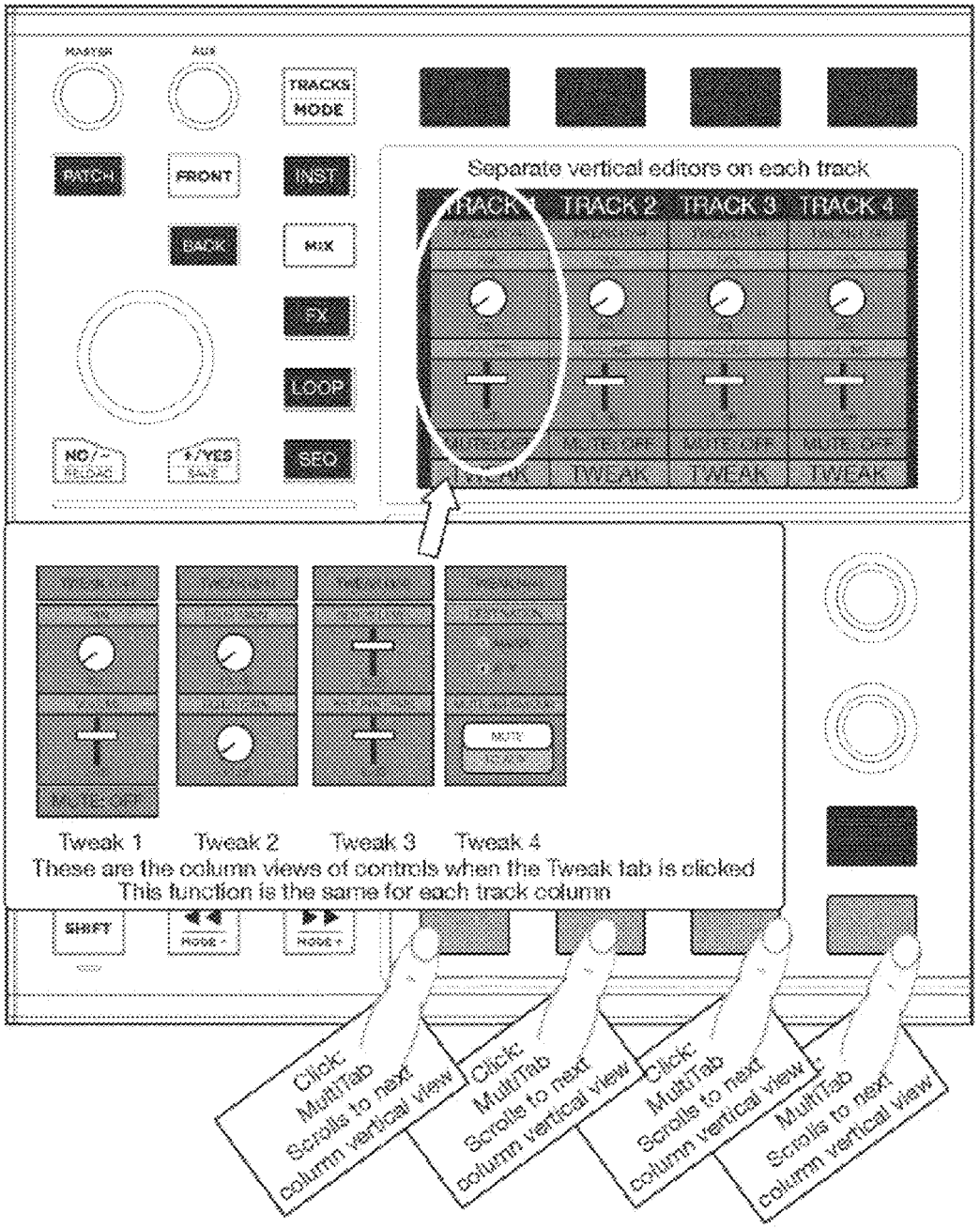

Referring to FIG. 25, user actuation of the mixer track-part selector user input 170 allows the user to vary parameters of musical elements of the mixer track part of the selected track (or at a plurality of tracks if no track is selected) as described above. As shown in FIG. 25, user selection of the user input 134 causes a "MIX" tab of parameters to be associated with icons and with the controls to allow user variation of the subset of parameters associated with the "MIX" tab, and user actuation of the user input 144 causes an "EQ" tab to be displayed with a different subset of parameter icons representing a different subset of parameters of musical elements of the mixer track part of the selected track. Referring to FIG. 27, when no track is selected, a "vertical" view includes parameter icons in columns, each of the columns associated with a respective track, and each of the columns may display one of a plurality of different subsets of parameter icons representing different subsets of parameters of model elements in the selected track part of the four tracks.

Figure 28:
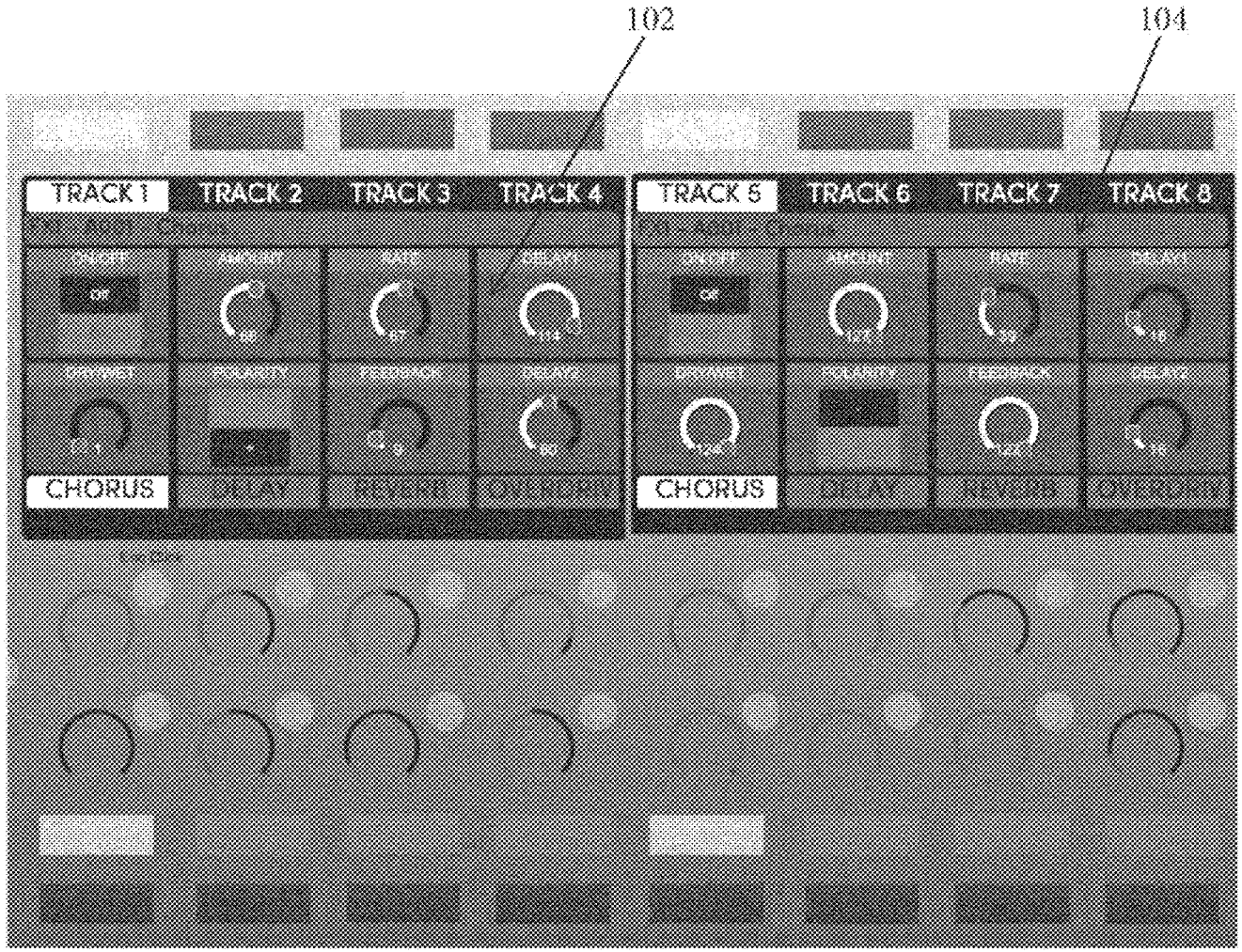

Referring to FIG. 28, user actuation of the sound effects track-part selector user input 172 (shown in FIG. 2) also allows a user to vary parameters of the sound effects track part of one or more selected tracks. FIG. 28 schematically represents icons on the display screen 110 associated with the controls 165, and icons on the display screen 242 associated with the controls 244. In the embodiment shown in FIG. 28, the controls 165 are associated with parameters of TRACK 1, and the controls 244 are associated with parameters of TRACK 5. More generally, in embodiments having more than one module of the music control device 100, the display screen on one module may be associated with one track or with a plurality of tracks, and each display screen may be independently associated with one track or a plurality of tracks. For example, in the embodiment shown in FIG. 28, de-selection of TRACK 5 would cause the display screen 242 to change to a "vertical" display in which each column is associated with one of the tracks, but the display screen 110 could remain in a "horizontal" view in which all of the parameter icons are associated with one selected track. Although FIG. 28 illustrates only two display screens 110 and 242, alternative embodiments may be expanded to include more display screens and more associated controls. Further, although FIG. 28 illustrates parameter icons associated with model elements in the sound effects track part, parameters in other track parts may also be varied using multiple display screens and multiple sets of controls on multiple parameters as described herein.

Figure 62:
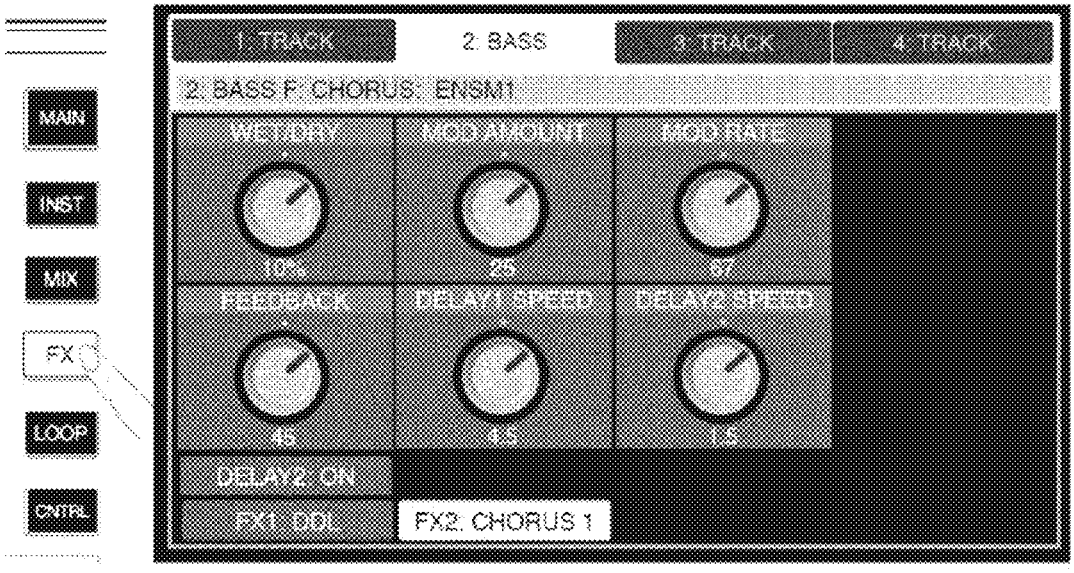
FIGS. 62 to 83 illustrate user interfaces of the music control device of FIG. 61 and of other embodiments.

FIG. 62 illustrates a sound effects user interface according to another embodiment. In general, different user interfaces such as those described herein may be interchanged or varied in other ways. Therefore, for example, the user interface of FIG. 62 may be combined in various embodiments with one or more other user interfaces such as those described herein, for example.

Figure 74:
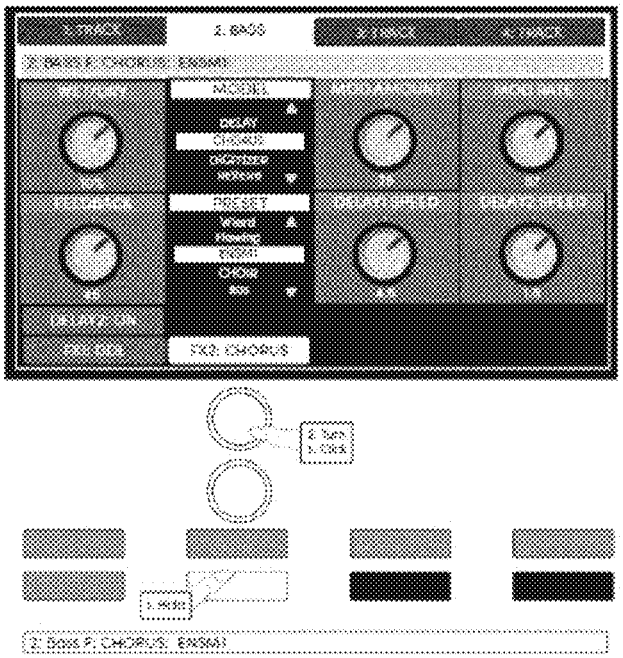

FIG. 74 illustrates a user interface that can be used to change models in a main, mixer, or sound effects tab. As shown in FIG. 74, holding a user input associated with a parameter tab for a predetermined period of time (such as one or two seconds, for example) causes an icon to appear that allows selection of a model and preset for the tab by rotating and pressing user inputs associated with the icon. The selected model name ("CHORUS" in the example of FIG. 74) may then appear on the icon associated with the parameter tab.

Figure 29:
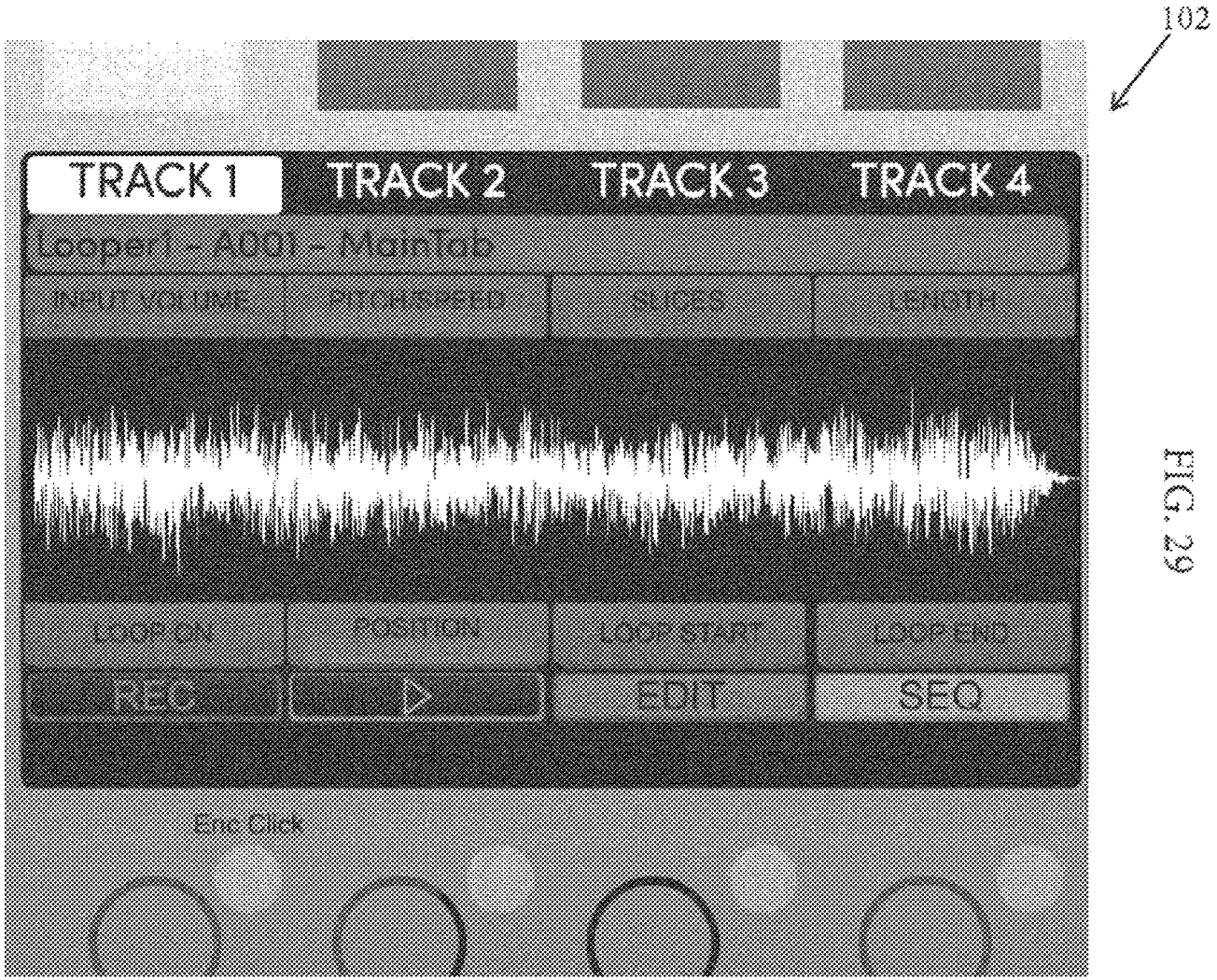

Referring to FIG. 29, user selection of the looper user input track-part selector 174 also allows a user to modify parameters of model elements in the looper track part of one or more selected tracks as described above. In general, a looper track part can, for example, record, play back, load, and export samples to or from one or more computer-readable storage media. Each looper may include, for example 1 to 8 loops per track, and a looper can enable recording, overdubbing, or both. A looper can enable a loop to be played continuously.

Figure 63:
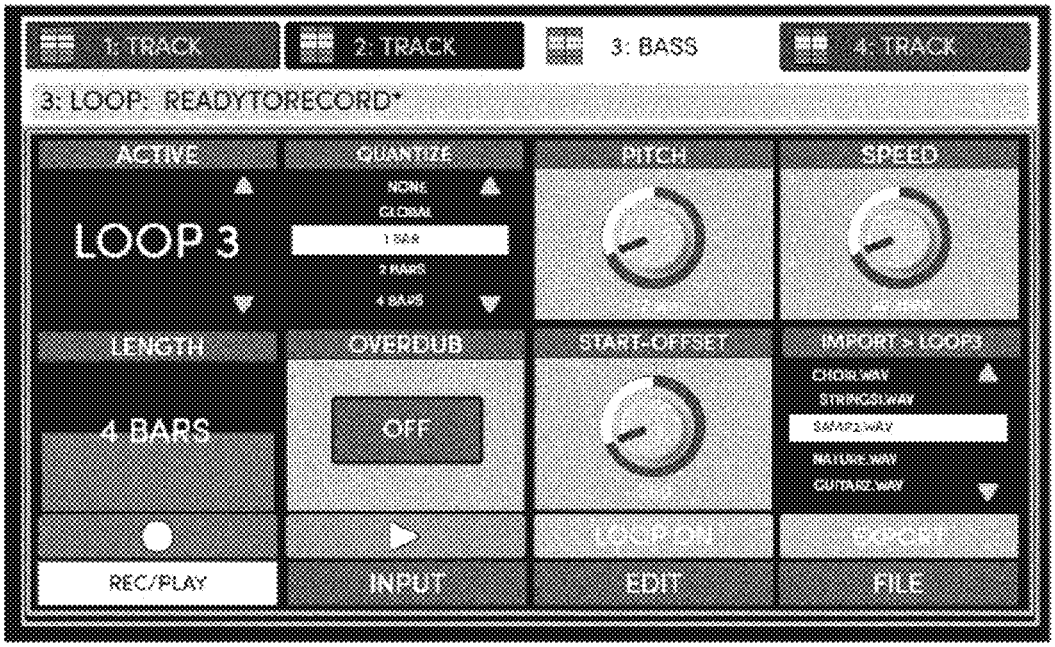

FIGS. 63 to 67 illustrate a looper user interface for a looper track part according to another embodiment. FIG. 63 illustrates a user interface according to one embodiment for recording and playing a loop. For example, the user interface of FIG. 63 permits selecting a loop by turning a user input associated with the "ACTIVE" icon, permits varying a length of the loop by turning a user input associated with the "LENGTH" icon, permits switching between recording and overdubbing by actuating a user input associated with the "OVERDUB" icon, permits varying a timing of when the will be played loop by turning a user input associated with the "QUANTIZE" icon, and more generally by actuating user inputs associated with icons as shown in FIG. 63.

Figure 64:
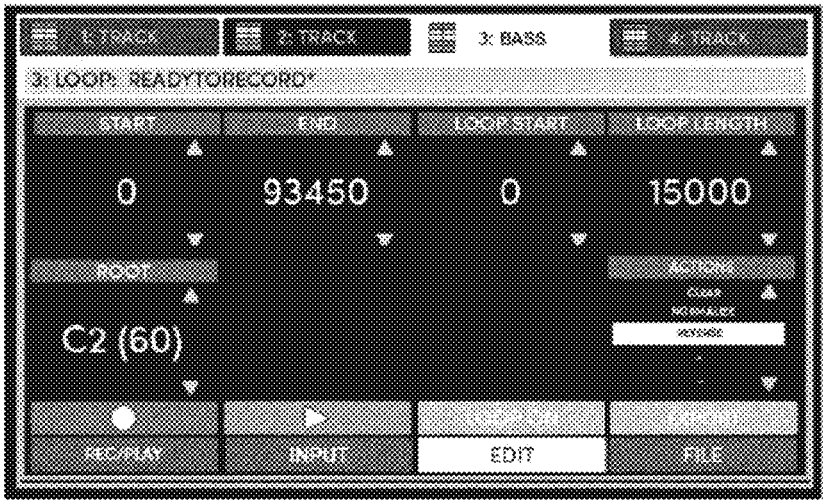

FIG. 64 illustrates a user interface according to one embodiment for editing a loop, and again the loop may be edited by actuating user inputs associated with icons as shown in FIG. 64. For example, in FIG. 64, the "ROOT" icon indicates a root pitch, and the root pitch may be varied by turning a user input associated with the "ROOT" icon.

Figure 65:
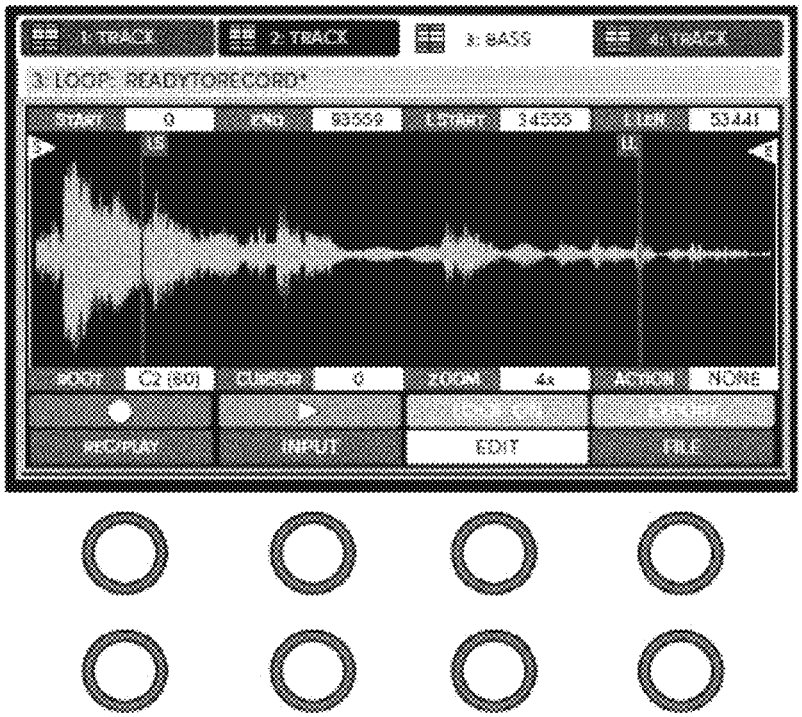

FIG. 65 illustrates another user interface according to one embodiment for editing a loop. FIG. 65 includes icons similar to the icons of FIG. 64, and again the loop may be edited by actuating user inputs associated with the icons.

Figure 66:
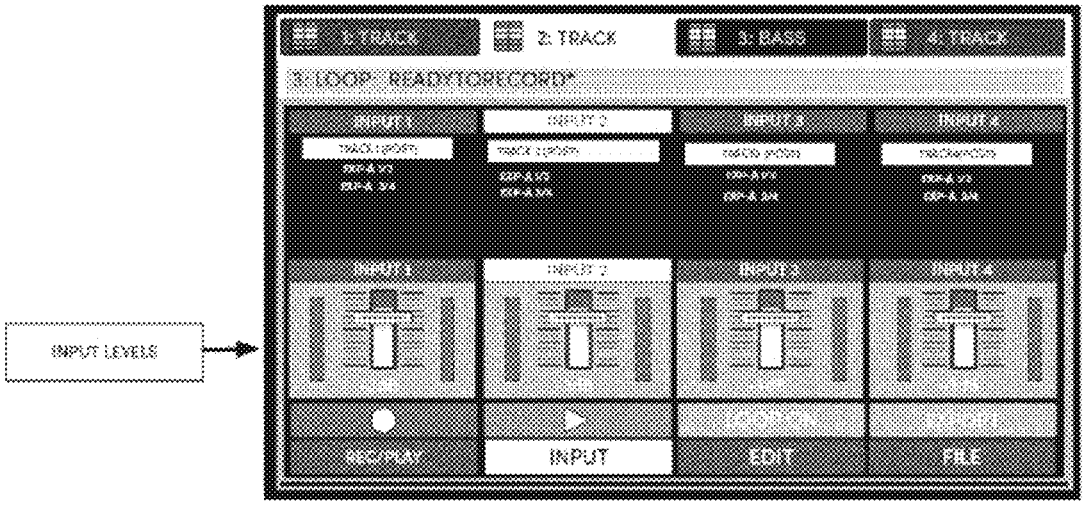

FIG. 66 illustrates a user interface according to one embodiment for mixing inputs to a loop, and actuating user inputs can vary the inputs and levels of the inputs to the loop.

Figure 67:
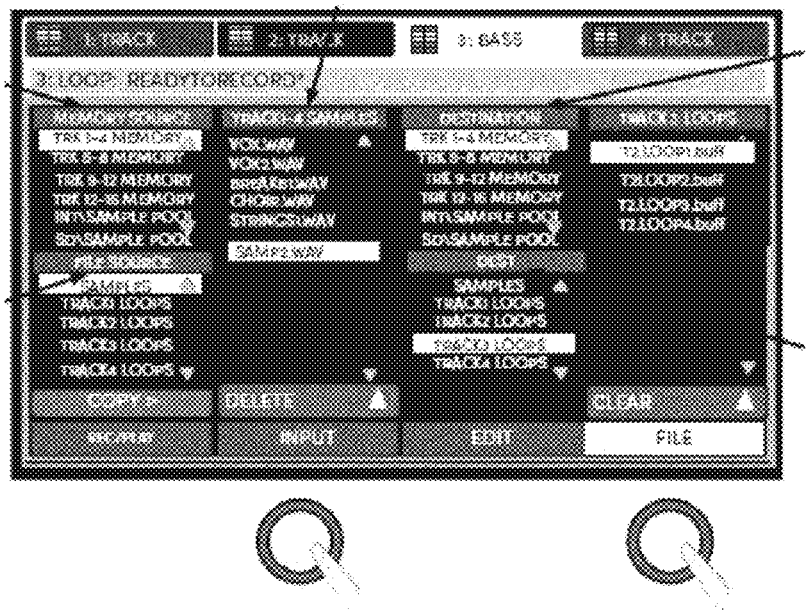
Figure 68:
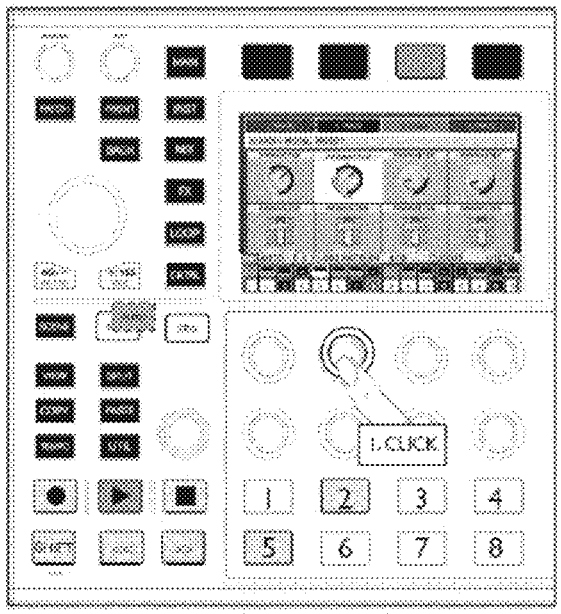
Figure 69:
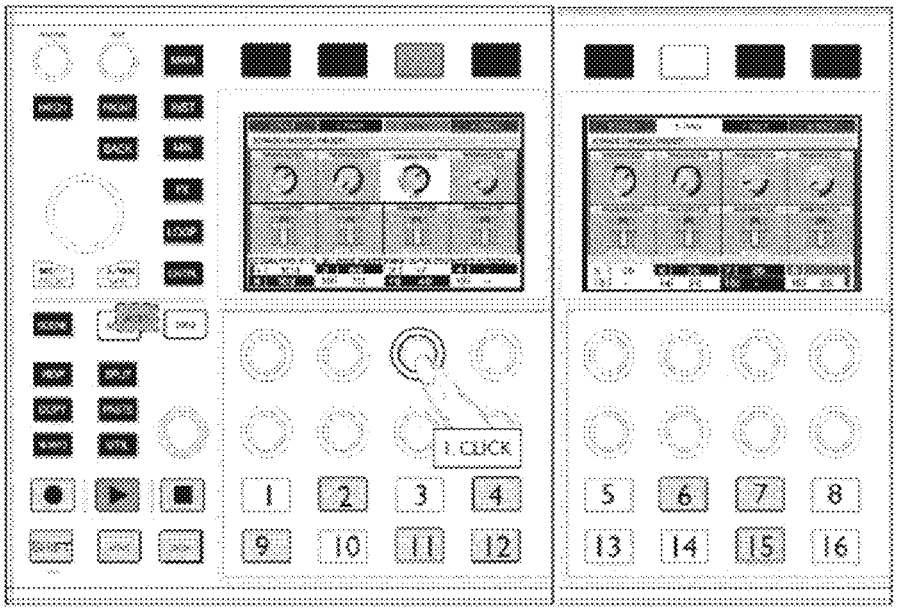
Figure 70:
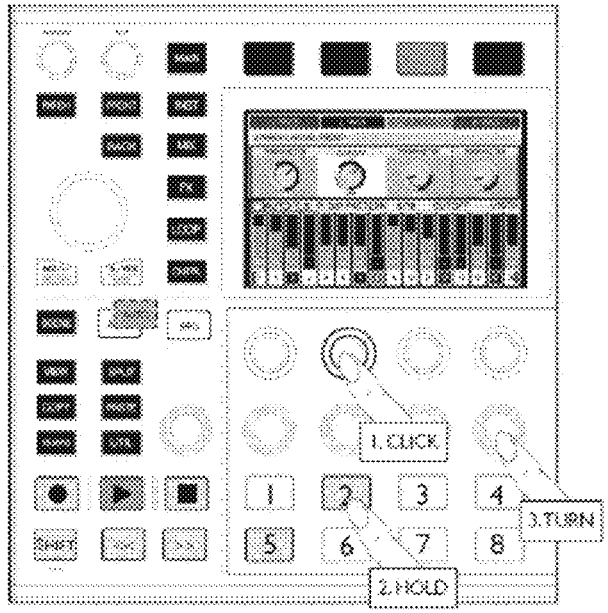
Figure 71:
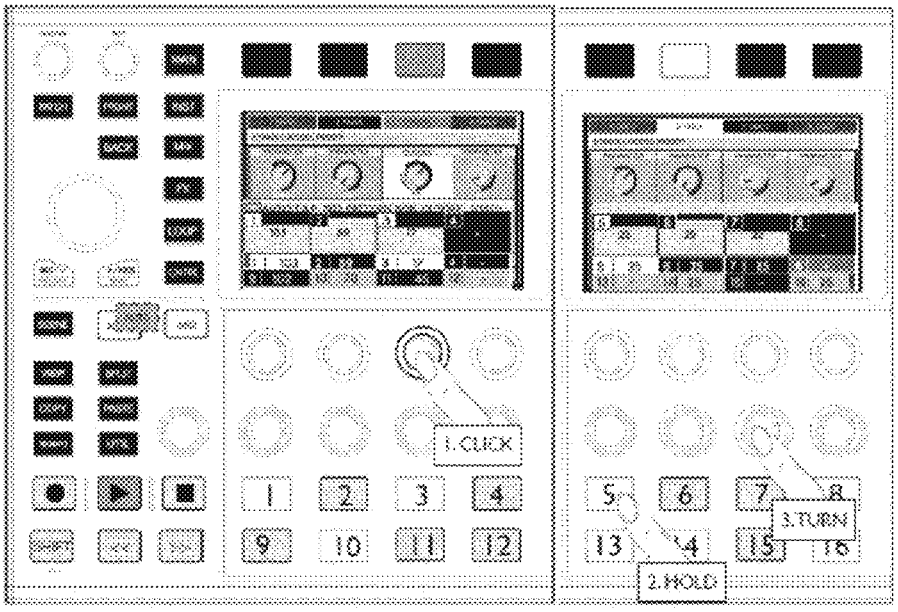

FIG. 67 illustrates a user interface according to one embodiment for managing loop and sample files. In the embodiment shown, actuating a user input associated with the "MEMORY SOURCE" icon will select a memory source that the sample or loop will come from, for example from internal or external sample or loop RAM or internal or external sample pools. Further, in the embodiment shown, actuating a user input associated with the "FILE SOURCE" icon will select either from the memory source's bulk area for samples or loops stored for each track in their own loop RAM buffers (for example, 1 to 8 loop RAM buffers per track). Further, in the embodiment shown, actuating a user input associated with the "DESTINATION" icon will select a memory destination that the sample or loop will go to, for example from internal or external sample or loop RAM or internal or external sample pools. Further, in the embodiment shown, actuating a user input associated with the "DEST" icon will select either from the memory source's bulk area for samples or loops stored for each track in their own loop RAM buffers (for example, 1 to 8 loop RAM buffers per track). If "SAMPLES" is selected, the list of current samples will show. If "TRACK . . . LOOPS" is selected, it will list the loop buffers for the selected track. Further, in the embodiment shown, actuating a user input associated with the "COPY" icon will copy the source file to the destination location, actuating a user input associated with the "DELETE" icon will delete the source or destination file, and actuating a user input associated with the "CLEAR" icon will clear the loop buffer.

As parameters are varied as described above, parameter information may be stored in a parameters store 328 in the storage memory 230 (shown in FIG. 3). The music control device 100 may then access information stored in the storage memory 230 to coordinate musical instruments for performance, recording, or other production or presentation of music.

Many of the embodiments described herein include only the main module 102 for simplicity of illustration, but as indicated above, the expansion modules 104, 106, and 108 may effectively extend the display screen 110 into a display including a plurality of display screens, and effectively extend the controls 165 into a larger plurality of controls. In such embodiments, the expansion modules 104, 106, and 108 increase the number of columns available to function as described herein. In some embodiments, user actuation of the track-part selector inputs 166 applies to the display screens of all of the modules in a "span navigation" or default mode. However, in other embodiments, user actuation of the track-part selector inputs 166 applies to only one or only some of the display screens of the modules in a "split navigation" mode as described below with reference to FIG. 30. In still other modes, user actuation of the track-part selector inputs 166 may apply to some, but not all, of the tracks in a single display screen of a single module.

Figure 30:
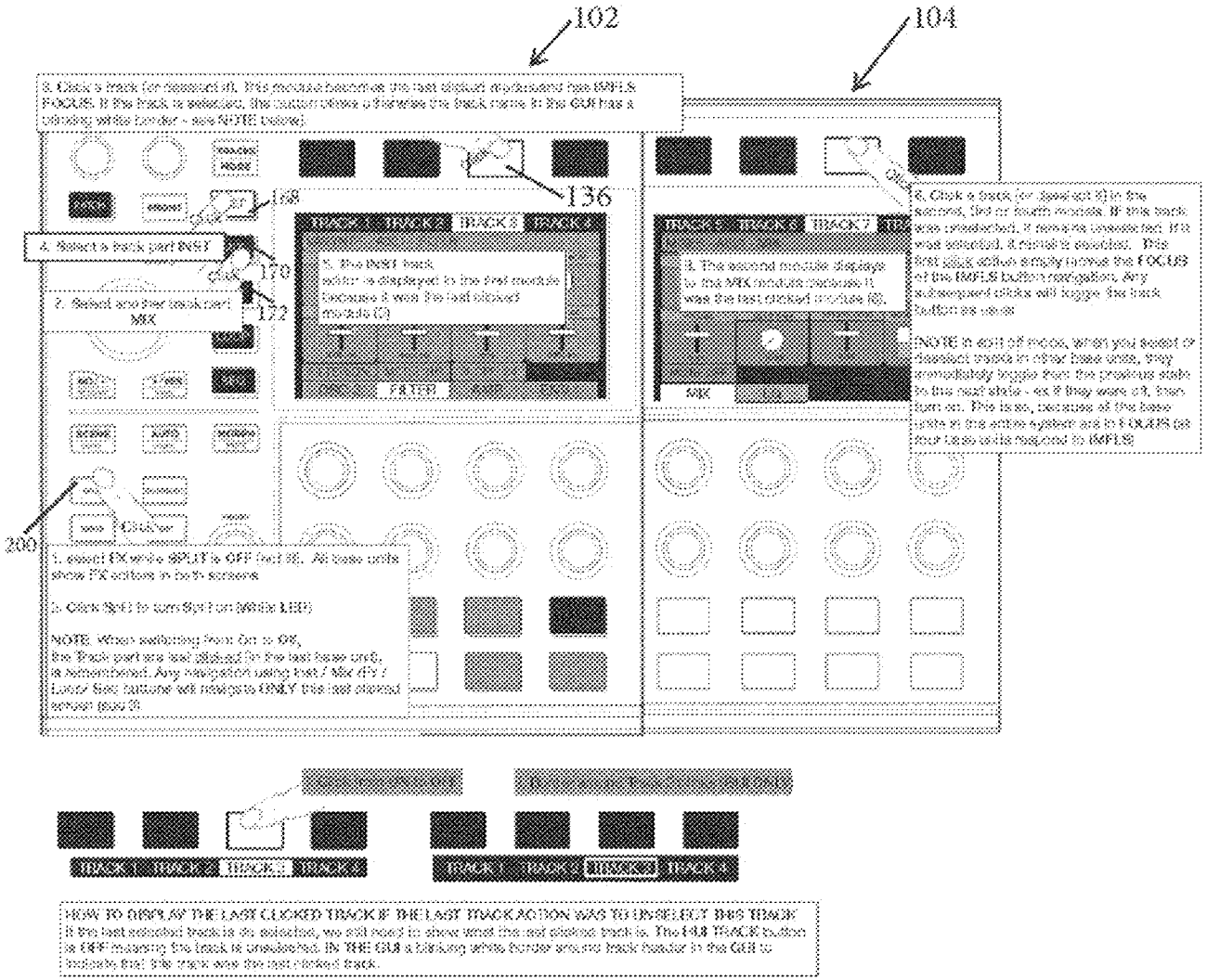
Figure 78:
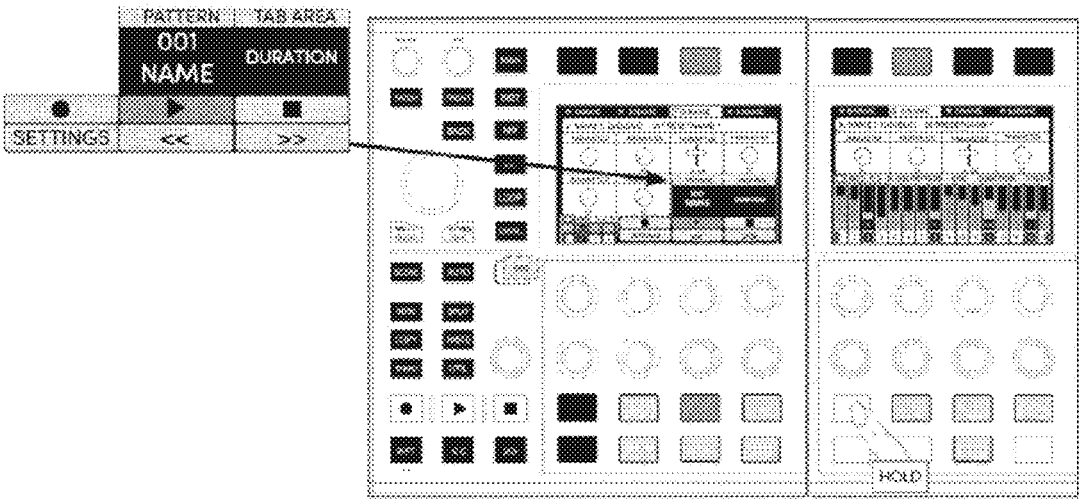

Referring to FIG. 30, the main module 102 and the expansion module 104 are shown in a split view, in which the display screen 110 and the controls 165 are associated with a different track part than the display screen 242. As shown on FIG. 30, when the split user input 200 is not selected, user selection of the sound effects track-part selector user input 172 causes both the display screen 110 and the display screen 242 to be associated with the effects track part. In other words, parameter icons on the display screen 110 and on the display screen 242 are associated with parameters of model elements of the sound effects track part of a selected track, or of more than one track if no track is selected. FIG. 78 also illustrates SPLIT sequencers in a dual system with two splits (each filling one screen) according to one embodiment. In various embodiments, multiple sequencer timelines may be displayed in one system (from multiple tracks) depending on system size (which may be four ganged modules, or more or fewer).

However, as also shown in FIG. 30, user selection of the split user input 200 causes the split user input 200 to change color, and user selection of one of the track-part selector inputs 166 applies only to a "last-clicked module". For example, as shown in FIG. 30, user actuation of the track selection user input 136 causes the main module 102 to be the "last-clicked module", and then user actuation of the instrument track-part selector user input 168 causes the display screen 110 to display parameter icons associated with parameters of model elements of the instrument track part of the selected track (or more than one track if no track is selected). However, in split mode, user actuation of the instrument track-part selector user input 168 would not affect the display screen 142, so that the parameter icons on the display screen 142 would not change following user actuation of the instrument track-part selector user input 168.

If the user then selected TRACK 7 followed by user actuation of the mixer track-part selector user input 170 as shown in FIG. 30, then the display screen 242 would change to the mixer track part by displaying parameter icons associated with model elements of the mixer track part of the selected track, without changing the icons on the display screen 110.

A track may also be expanded to more than one module at one time, for example by holding one of the track selection user inputs (126, 136, 146, and 156 on the main module 102 or track selection user inputs on an expansion module, for example) and using "left" and "right" such as the user inputs 222 and 224 to expand the selected track to one or more other modules, thereby associating parameters of the track with user inputs on more than one module.

FIG. 30 illustrates the "split navigation" mode in a "front" editor following user actuation of the front selection user input 186, but in some embodiments such "split navigation" mode may also be used in a "back" editor (for example as described with reference to FIGS. 9 to 13) following user actuation of the back selection user input 188. In general, in various embodiments, selection of a track part may apply to one track, to all tracks, to one module, to more than one but not all modules, or to all modules. For example, in some embodiments, simple selection of one of the track-part selectors 166 causes the selected track part to be applied to be applied to all tracks. Further, in some embodiments, holding one of the track selection user inputs (126, 136, 146, and 156 on the main module 102 or track selection user inputs on an expansion module, for example) causes an overlay (shown in FIG. 73, for example) including a list of track parts to appear on the display in association with the track selection user input being held, and turning a user input associated with the overlay selects a track part for only that track. Further, in some embodiments, holding one of the track selection user inputs (126, 136, 146, and 156 on the main module 102 or track selection user inputs on an expansion module, for example) and then selecting one of the track-part selectors 166 causes the selected track part to be applied to be applied to all tracks on the module of the track selection user input being held. Further in various embodiments, selection of a track may apply to one module, to more than one but not all modules, or to all modules. FIG. 78 also shows a SPLIT functionality for to sequencers and automation according to one embodiment. In the embodiment shown in FIG. 78, the main module's two button rows may edit the first module's sequencer (Track 3), while the "expand" modules' 2 bottom rows of buttons may edit the melodies the track selected (Track 6) in the "expand" module (glowing green).

Figure 73:
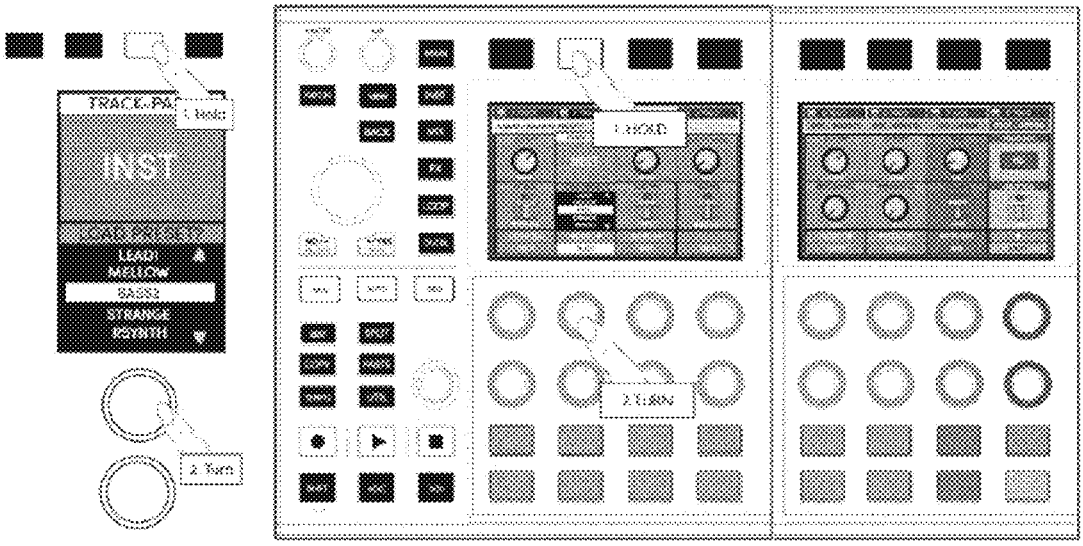

As indicated above, FIG. 73 illustrates selection of a track part for one track. However, as also shown in FIG. 73, a preset may be selected in addition to selecting a track part. As shown in FIG. 73, holding one of the track selection user inputs (126, 136, 146, and 156 on the main module 102 or track selection user inputs on an expansion module, for example) causes an overlay to appear on the display, and user inputs aligned with the track selection user input being held may vary parameters of the overlay. For example, if the track selection user input 136 is held, then the user input 138 (or, more generally, one of the user inputs aligned with the track selection user input being held) may be used to select a track part, and the user input 140 (or, more generally, another of the user inputs aligned with the track selection user input being held) may be used to select a preset.

Figure 75:
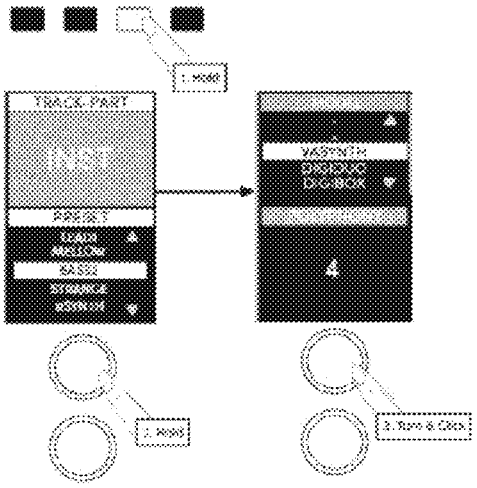
Figure 76:
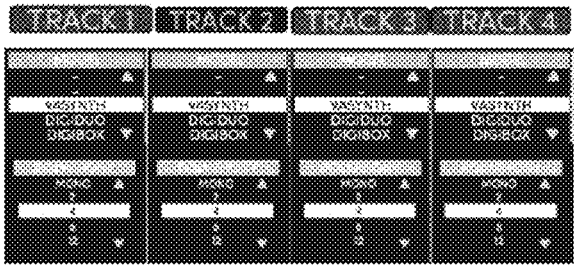

As indicated above, FIG. 74 illustrates a user interface according to one embodiment that can be used to change models in a main, mixer, or sound effects tab. Likewise, FIGS. 75 and 76 illustrate a user interface according to one embodiment that can be used to change models in an instrument or looper tab. As indicated above and as also shown in FIG. 75, in one embodiment, holding one of the track selection user inputs (126, 136, 146, and 156 on the main module 102 or track selection user inputs on an expansion module, for example) causes an overlay to appear on the display, and one of the user inputs associated with the overlay can be used to select a track part. However, in some embodiments, holding the user input that can be used to select a track part for a predetermined period of time (such as one or two seconds, for example) causes the overlay to display a choice of models, and turning and clicking the user input associated with the overlay while still holding the track selection user input changes the selected model. As shown in FIG. 76, in one embodiment, models may also be selected in an instrument or looper tab by holding one of the track-part selectors 166 for a predetermined period of time (such as one or two seconds, for example) causes the display to display a track-part setup view, and models may be selected from such a track-part setup view.

Also, as tracks and track parts are selected, memories of most recent selections may be recalled and applied. For example, when a track is selected, most recent selections track parts and parameters of the track may be recalled and applied for "horizontal" views, for "vertical" views, or for both.

In some embodiments, when tracks and parameters are associated in "vertical" views, repeated selection of a track part input selector may cycle the parameters for all tracks from one parameter subset to a next parameter subset. In such embodiments, any tracks in a "horizontal" view may remain unchanged in response to repeated selection of a track part input selector.

Figure 33:
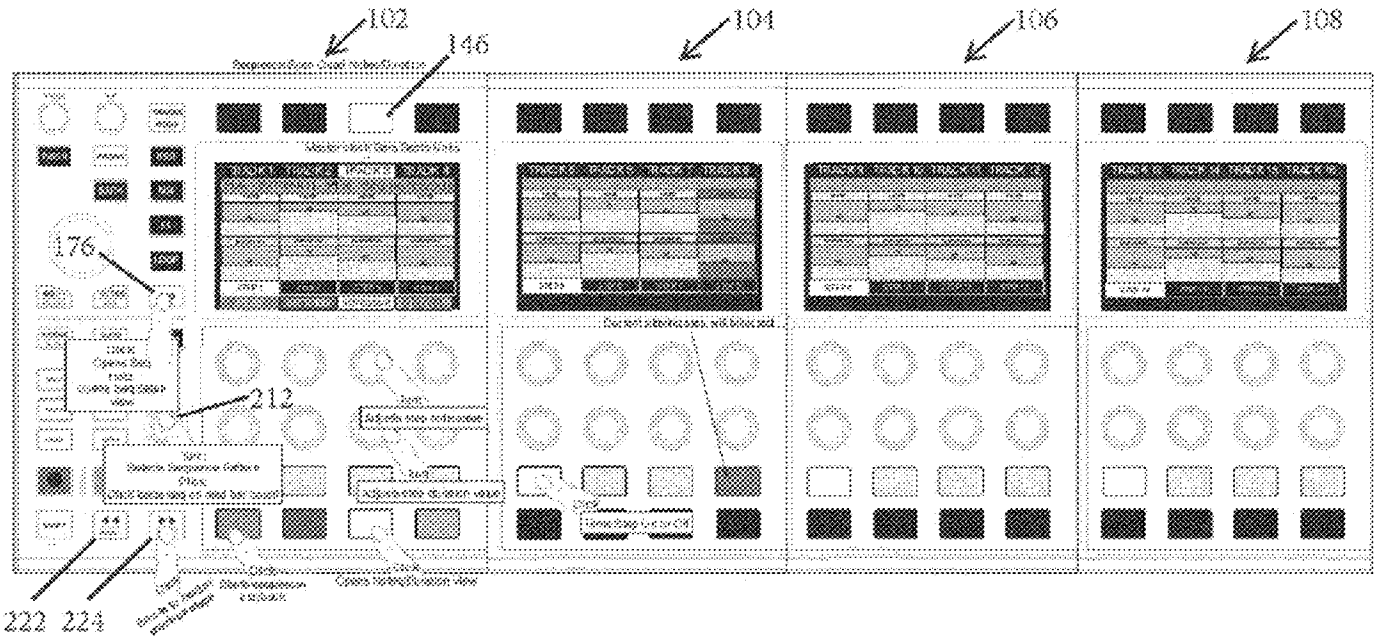
Figure 32:
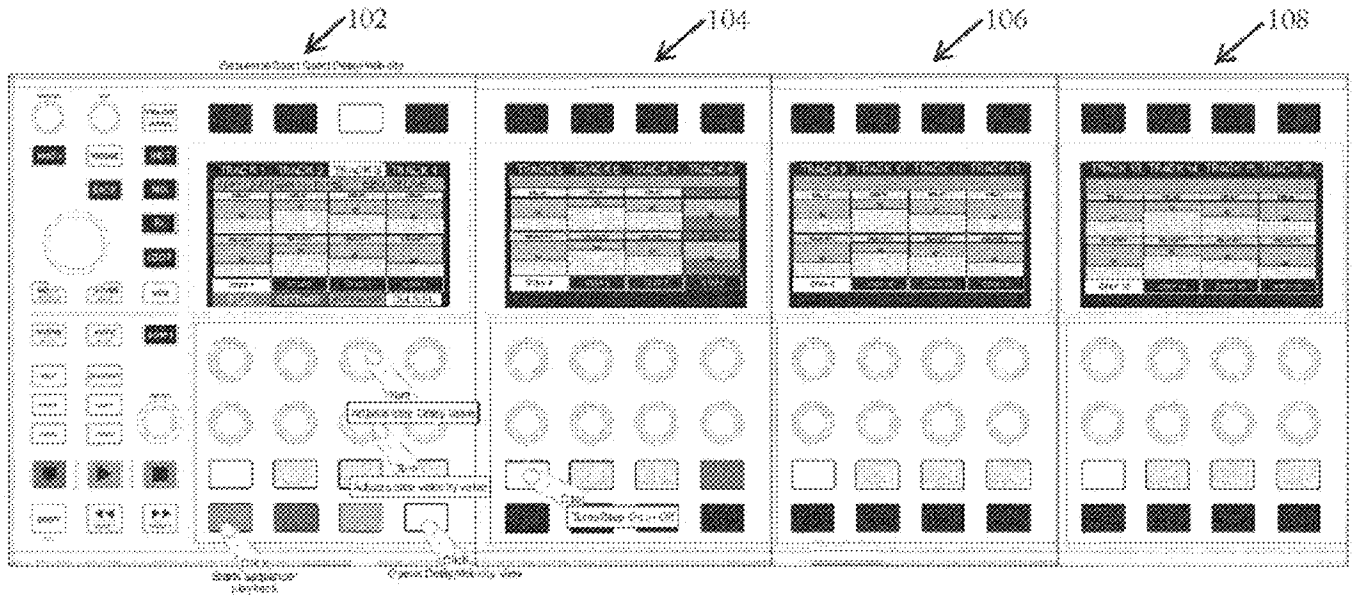
Figure 33:
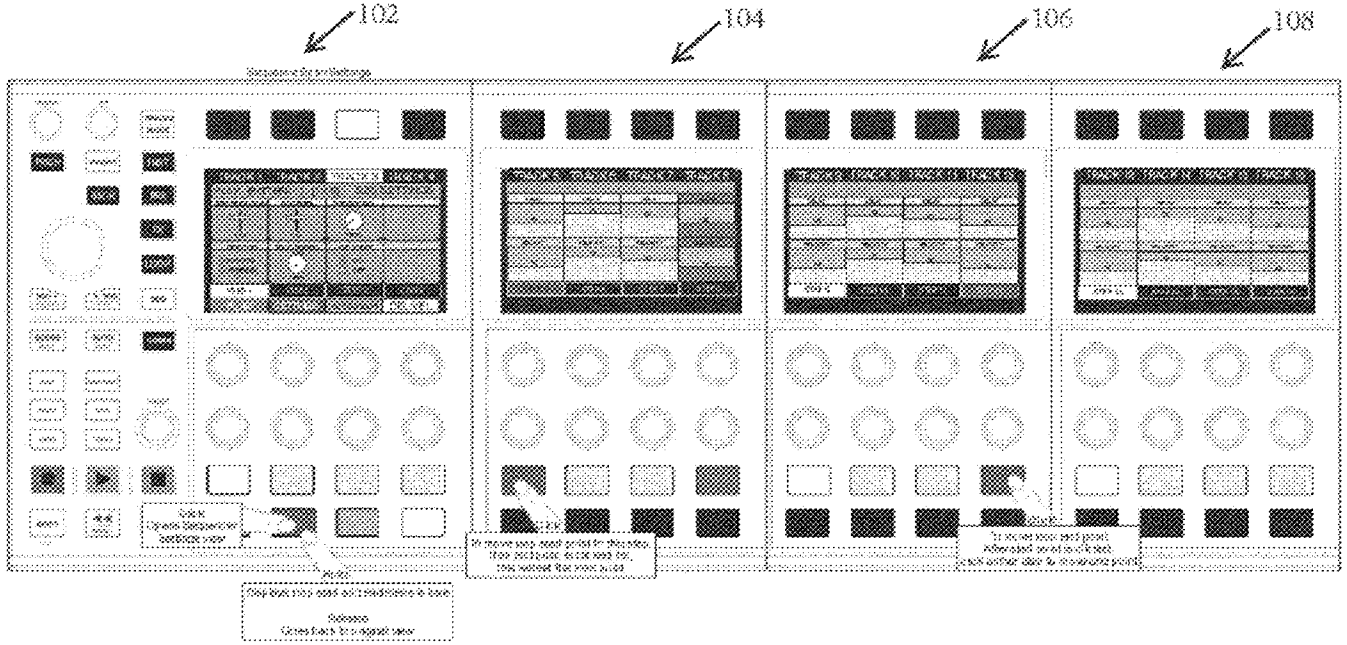

Some of the editors described herein include icons associated controls with controls on the same module. However, some editors may associate icons on one module with controls on another module. For example, FIGS. 31 to 33 illustrate display screens on all of the modules 102, 104, 106, and 108 associated with a selected track (TRACK 3 in the embodiment shown). In the embodiment shown in FIGS. 31 to 33, user actuation of the sequencing track-part selector user input 176 and selection of TRACK 3 (using the track selection user input 146) causes parameter icons on all four displays of all four modules to be associated with respective parameters of model elements in the sequencing track part of the selected track. In the embodiment shown in FIGS. 31 to 33, each of the sixteen columns of the four modules is associated with one step (or sequential period of time in the sequence to be defined) in the track, so the display screens on a plurality of modules include icons associated with respective parameters of model elements of a track selected on only one of the modules. As shown in FIG. 31, the reverse user input 222 and the forward user input 224 scroll the collective display (defined by the display screens of the four modules 102, 104, 106, and 108) forward and backward to show different steps in the sequence. Rotation of the preset user input 212 selects a sequence pattern, and pushing or clicking the preset user input 212 loads a subsequent bar count for the sequence. Controls such as the controls 165 and 244 vary parameters of model elements of the sequencing track part of the selected track as described above. For example, as shown in FIG. 31, clicking or pressing the user input 154 in the embodiment shown opens a "notes and duration" tab (because the user input 154 is associated with a "NOTES/DUR" icon on the display screen 110), and when the "notes and duration" tab is selected, turning the user input 148 varies an associated step note value, and turning the user input 150 varies an associated step duration value. As also shown in FIG. 31, clicking or pressing the user input 134 starts sequencer playback (because the user input 134 is associated with a "PLAY" icon on the display screen 110) in the embodiment shown. Also, in the embodiment shown, the row of user inputs including the user input 132 are all associated with respective "step" icons on the display screen 110, and user selection of such a user input turns on or off the associated step. Also, in the embodiment shown, the step that is currently playing is indicated by red in the associated column as shown in FIG. 31.

As shown in FIG. 32, clicking or pressing the user input 164 in the embodiment shown opens a "delay and velocity" tab (because the user input 164 is associated with a "DEL/VEL" icon on the display screen 110), and when the "delay and velocity" tab is selected, turning the user input 148 varies an associated step delay value, and turning the user input 150 varies an associated step velocity value.

As shown in FIG. 33, in the embodiment shown, clicking or pressing the user input 144 opens a setting tab (because the user input 144 is associated with a "SETTINGS" icon on the display screen 110), and holding the user input 144 causes loop start and end steps to be displayed in blue. When the loop start and end steps are displayed in blue, steps may be selected (using user inputs in the row of user inputs including the user input 132) to select start and end steps for a loop.

Figure 51:
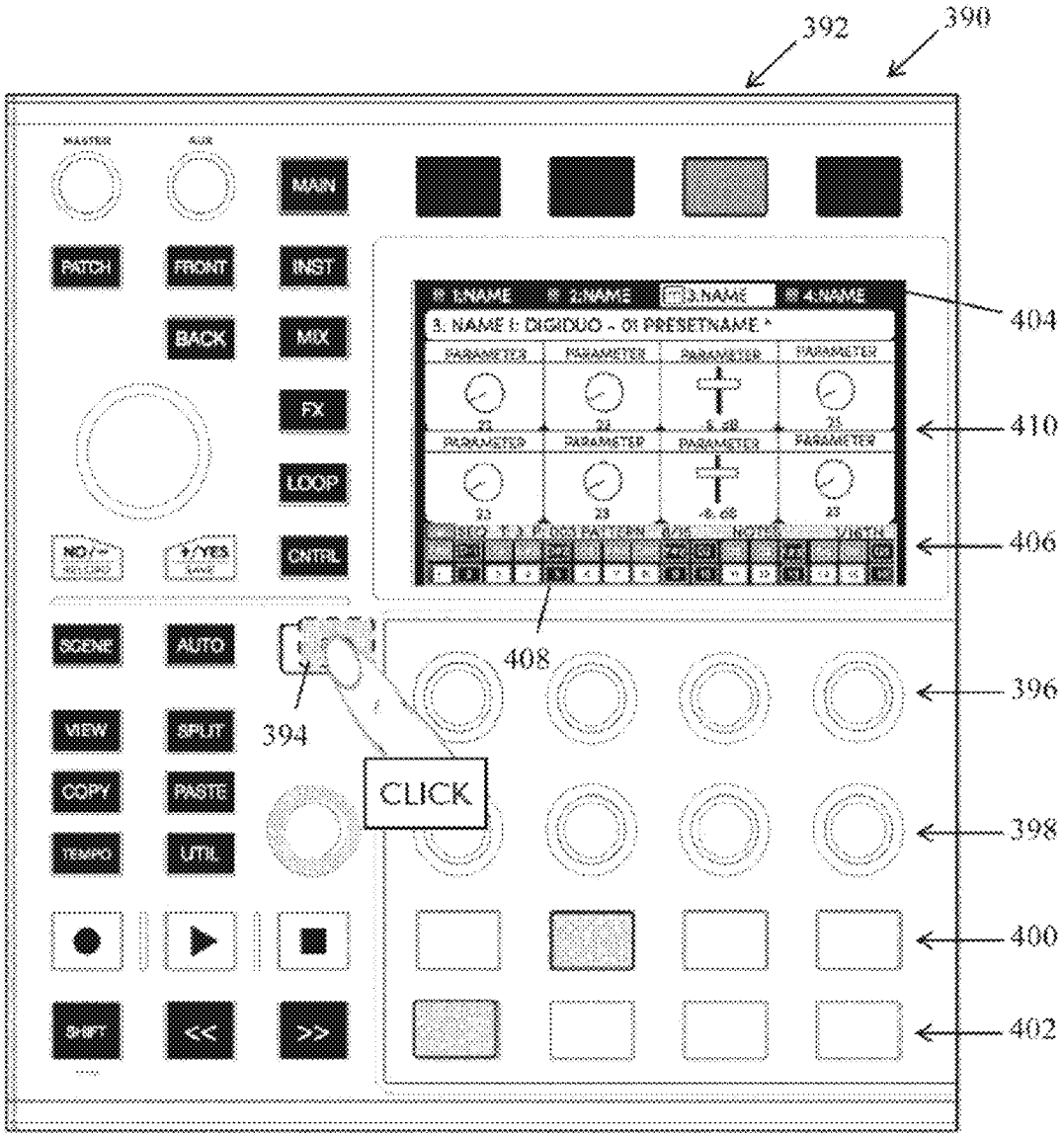
FIGS. 51 to 60 illustrate music control devices of other embodiments and user interfaces of music control devices of other embodiments.

Referring to FIG. 51, a sequencing track-part according to another embodiment is shown on a music control device 390 including a main module 392 according to another embodiment. The main module 392 is similar to the main module 102 or the main module 358 and includes a sequencing track-part selector user input 394, a first row shown generally at 396 of user inputs (similar to the 128, 138, 148, and 158), a second row shown generally at 398 of user inputs (similar to the 130, 140, 150, and 160), a third row shown generally at 400 of user inputs (similar to the 132, 142, 152, and 162), and a fourth row shown generally at 402 of user inputs (similar to the 134, 144, 154, and 164). The main module 392 also includes a display 404 similar to the display 110. In response to user selection of the sequencing track-part selector user input 394, a sequencing overlay shown generally at 406 appears on the display 404.

Figure 60:
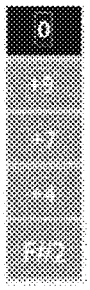

The sequencing overlay 406 includes 16 icons, each associated with a respective step in a sequencer of a selected track, and each indicating (by number) the associated step and (by symbol) a pitch of the associated step. Although FIG. 51 illustrates pitch, one or more other parameters may be displayed, such as duration, velocity, or an indication of a chord (as shown in FIG. 60, for example), for example. The sequencing overlay 406 is thus a timeline, displayed on the display 404, of steps in the sequencer.

The third and fourth rows 400 and 402 of user inputs collectively include eight user inputs, which is less than the number of steps indicated in the sequencing overlay 406. Therefore, a portion of the steps indicated in the sequencing overlay 406 may be selected for association with the third and fourth rows 400 and 402 of user inputs. In FIG. 51, the first eight steps are selected and indicated as selected by a colored border 408, and the first eight steps are associated with respective user inputs in the third and fourth rows 400 and 402. User selection of one of the user inputs in the third and fourth rows 400 and 402 turns the associated step on or off, so user selection of the user inputs in the third and fourth rows 400 and 402 varies a parameter of the associated step. Alternatively, steps 9 to 16 may be selected, for example using "left" and "right" user inputs similar to the user inputs 222 and 224, in which case steps 9 to 16 would instead be associated with respective user inputs in the third and fourth rows 400 and 402.

The numbers of steps and user inputs in FIG. 51 are examples only, and alternative embodiments may include more or fewer steps and more or fewer user inputs. Nevertheless, the sequencing overlay 406 allows a timeline of steps to be displayed with a greater number of steps than a number of user inputs that can be associated with respective ones of the steps. The display 404 also displays parameter icons shown generally at 410 that are similar to the parameter icons described above in FIG. 15. The parameter icons 410 are associated with parameters of a different track part (such as an instrument, mixer, or effects track part, for example) of the selected track, and are also associated with respective user inputs in the first and second rows 396 and 398 at the same time that user inputs in the third and fourth rows 400 and 402 are associated with respective steps in the sequencer. Therefore, in FIG. 51, some of the user inputs are associated with respective steps in the sequencer while others of the user inputs are associated with respective track parameters in at least one other track part (such as instrument, mixer, or sound effects, for example).

Figure 52:
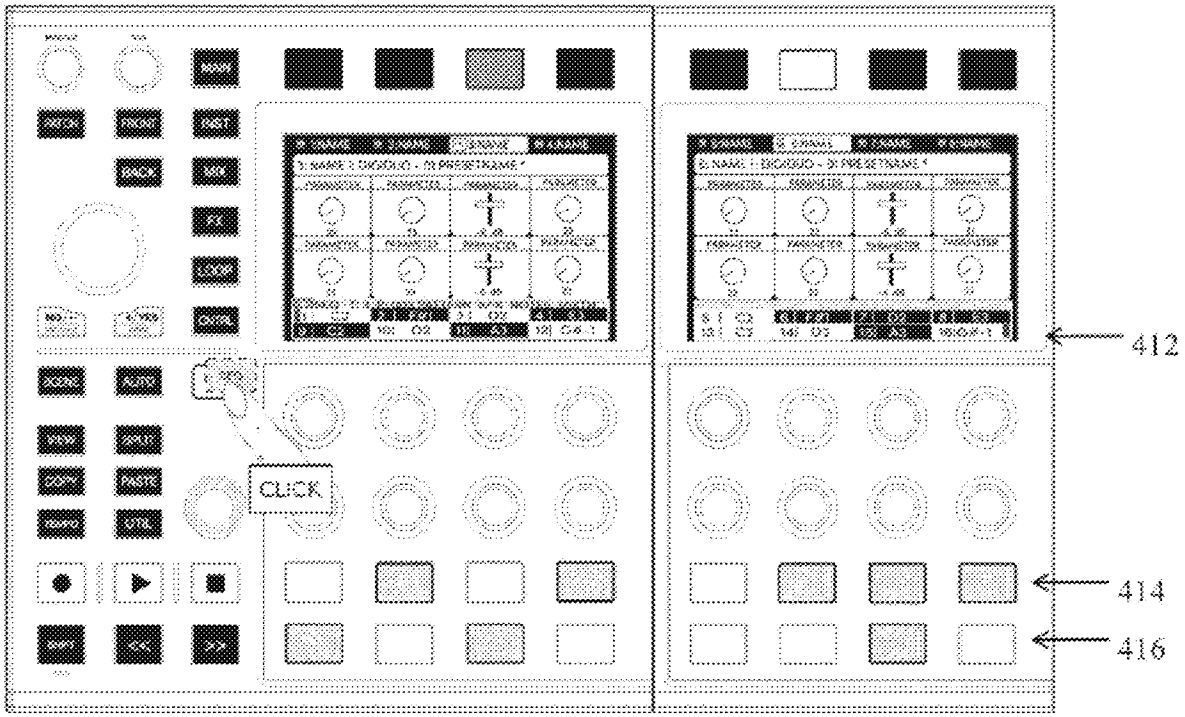

Referring to FIG. 52, a sequencing overlay according to another embodiment is shown generally at 412 on a music control device including a main module and an expansion module, each module including its own display. The sequencing overlay 412 includes 16 icons, each associated with a respective step in a sequencer of a selected track, and each indicating (by number) the associated step and (by symbol) a pitch of the associated step. The sequencing overlay 412 is thus a timeline of steps in the sequencer displayed on the displays of the music control device.

Further, as shown in FIG. 52, the sequencing overlay 412 includes two lines each extending along each of the modules of the music control device, so that a portion of the sequencing overlay 412 on the main module includes icons associated with tracks 1-4 and 9-12, and a portion of the sequencing overlay 412 on the expansion module includes icons associated with tracks 5-8 and 13-16. The icons in the first line of the sequencing overlay 412 are associated with tracks 1-8 and are associated with a row shown generally at 414 of user inputs corresponding to the third row 400 of FIG. 51, and the icons in the second line of the sequencing overlay 412 are associated with tracks 9-16 and are associated with a row shown generally at 416 of user inputs corresponding to the fourth row 402 of FIG. 51. User selection of one of the user inputs in the rows 414 and 416 turns the associated step on or off, so user selection of the user inputs in the rows 414 and 416 varies a parameter of the associated step. As with FIG. 51, FIG. 52 illustrates user inputs associated with respective steps in the sequencer while others of the user inputs are associated with respective track parameters in at least one other track part (such as instrument, mixer, or sound effects, for example). In the embodiment shown, the icons bound to the user inputs in the rows 414 and 416 are associated with the track selected in MAIN module (track 3).

Therefore, the sequencing overlay 412 functions similarly to the sequencing overlay 406, except that all 16 of the steps in the sequencing overlay 412 are associated with respective user inputs in the rows 414 and 416. Again, the numbers of steps and user inputs in FIG. 52 are examples only, and alternative embodiments may include more or fewer steps and more or fewer user inputs.

Figure 53:
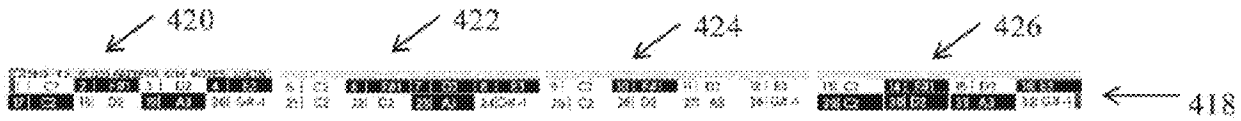

Referring to FIG. 53, a sequencing overlay according to another embodiment is shown generally at 418 on a music control device including a main module and three expansion modules, each module including its own display. The sequencing overlay 418 includes 32 icons, each associated with a respective step in a sequencer of a selected track, and each indicating (by number) the associated step and (by symbol) a pitch of the associated step. The sequencing overlay 418 is thus a timeline of steps in the sequencer displayed on the displays of the music control device.

Further, as shown in FIG. 53, the sequencing overlay 418 includes two lines each extending along each of the modules of the music control device, so that a portion shown generally at 420 of the sequencing overlay 418 may be displayed on the main module and includes icons associated with tracks 1-4 and 17-20, a portion shown generally at 422 of the sequencing overlay 418 may be displayed on the first expansion module and includes icons associated with tracks 5-8 and 21-24, a portion shown generally at 424 of the sequencing overlay 418 may be displayed on the second expansion module and includes icons associated with tracks 9-12 and 25-28, and a portion shown generally at 426 of the sequencing overlay 418 may be displayed on the third expansion module and includes icons associated with tracks 13-16 and 29-32. The icons in the first line of the sequencing overlay 418 are associated with tracks 1-16 and are associated with a row of inputs corresponding to the third row 400 of FIG. 51 and corresponding to the row 414 of FIG. 52, and icons in the second line of the sequencing overlay 418 are associated with tracks 17-32 and are associated with a row of inputs corresponding to the fourth row 402 of FIG. 51 and corresponding to the row 416 of FIG. 52.

Therefore, the sequencing overlay 418 functions similarly to the sequencing overlay 412, except that 32 of the steps in the sequencing overlay 418 are associated with respective user inputs in four modules. Again, the numbers of steps and user inputs in FIG. 53 are examples only, and alternative embodiments may include more or fewer steps and more or fewer user inputs.

Figure 54:
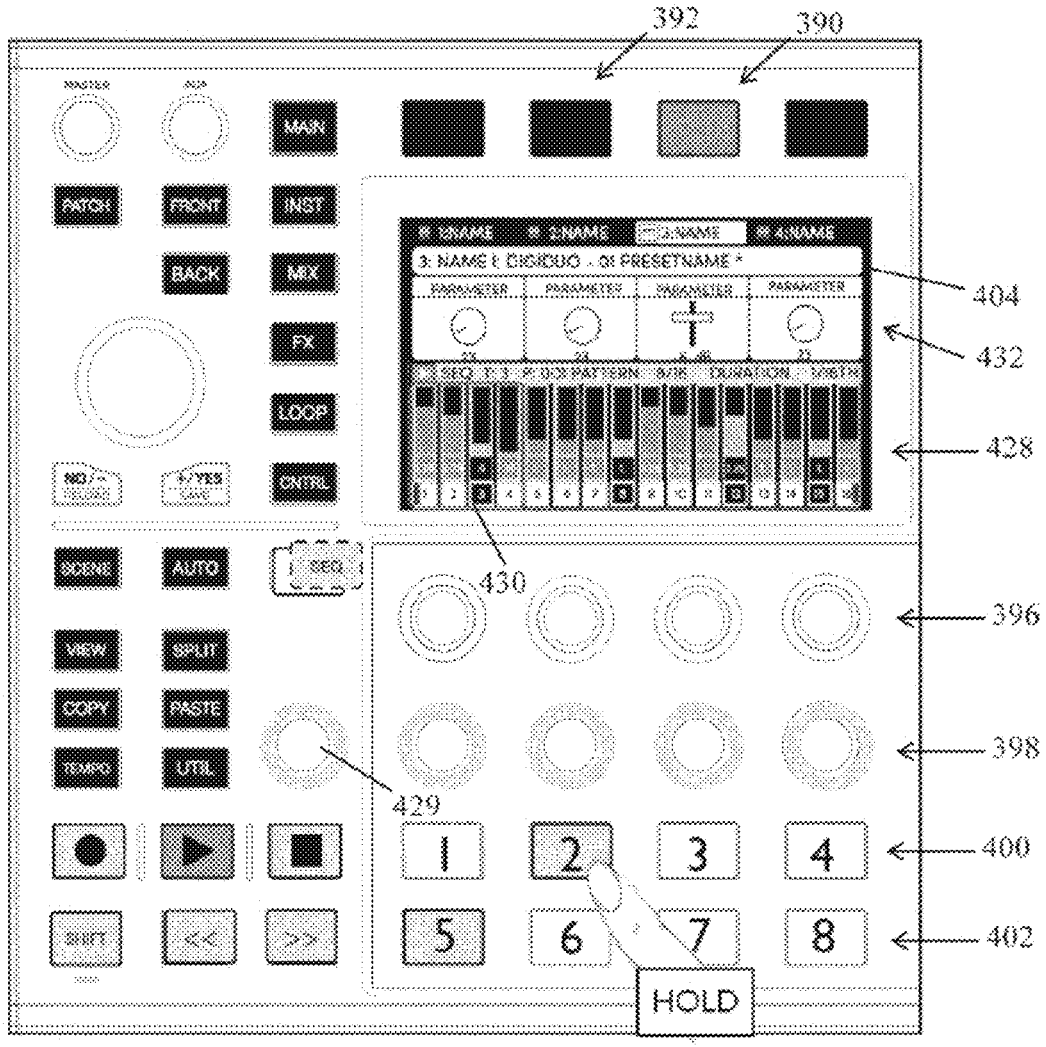

The sequencing overlays of FIGS. 51 to 53 may be modified to permit variation of pitch, chord, or other parameters of the steps. For example, FIG. 54 illustrates the music control device 390 when a user holds one of the user inputs in the third and fourth rows 400 and 402 for a predetermined period of time (such as one or two seconds, for example). In response to such user input, the display 404 displays a sequencing overlay shown generally at 428 and including 16 icons, each associated with a respective step in a sequencer of a selected track, and each indicating (by number) the associated step and (by number and by height of a bar) a duration of the associated step, and user inputs in the second row 398 are associated with parameters of respective steps. Releasing the one of the user inputs in the third and fourth rows 400 and 402 may remove the sequencing overlay 428. Although FIG. 54 illustrates duration, one or more other parameters may be displayed, such as pitch, velocity, or an indication of a chord (as shown in FIG. 60, for example), for example, and rotation of the knob 429 may change which parameters (such as notes, velocity, duration, or delay) are displayed. The sequencing overlay 428 is thus a timeline, displayed on the display 404, of steps in the sequencer. In the embodiment shown, when the knob 429 is turned and no steps are held, the melodic pattern can be changed individually (per track, track 3 as indicated at 390 in this example). In a split mode in the embodiment shown in FIG. 78, the tactile user interface is bound to controls on the module to the left and may function the same way.

The second row 398 of user inputs includes four user inputs, which is less than the number of steps indicated in the sequencing overlay 428. Therefore, a portion of the steps indicated in the sequencing overlay 428 may be selected for association with the second row 398 of user inputs. In FIG. 54, the first four steps are selected and indicated as selected by a colored border 430, and the first four steps are associated with respective user inputs in the second row 398. Parameters of the steps associated with the user inputs in the second row 398 may be modified by rotation of those user inputs. Therefore, in FIG. 54, rotation of one of the user inputs in the second row 398 modifies a duration of the associated step. However, other parameters (such as a pitch or a chord, for example) may be associated with the user inputs in the second row 398 and modified in response to user input using the user inputs in the second row 398. Further, steps 5 to 8, steps 9 to 12, or steps 13 to 16 may be selected, for example using "left" and "right" user inputs similar to the user inputs 222 and 224, in which case parameters of those selected steps would be associated with respective user inputs in the second row 398.

To vary a chord, an indication of a root pitch ("F#2" in the example of FIG. 60), and one or more indications of respective semitone intervals ("+4", "+7", and "+9" in the example of FIG. 60) from the root pitch, may be displayed in association with a step, and user input may vary the root pitch, the number of additional pitches, and the respective semitone intervals from the root pitch for each of the additional pitches. For example, pressing an associated one of the user inputs in the second row 398 may change which of the indications is selected, and turning the associated one of the user inputs in the second row 398 may change the pitch or interval of the selected indication.

The display 404 also displays parameter icons shown generally at 432 that are similar to the parameter icons described above in FIG. 15. The parameter icons 432 are associated with parameters of a different track part (such as an instrument, mixer, or effects track part, for example) of the selected track, and are also associated with respective user inputs in the first row 396 at the same time that user inputs in the second row 398 are associated with respective steps in the sequencer. Therefore, in FIG. 54, some of the user inputs are associated with respective steps in the sequencer while others of the user inputs are associated with respective track parameters in at least one other track part (such as instrument, mixer, or sound effects, for example).

Again, the numbers of steps and user inputs in FIG. 54 are examples only, and alternative embodiments may include more or fewer steps and more or fewer user inputs. Nevertheless, the sequencing overlay 428 allows a timeline of steps to be displayed with a greater number of steps than a number of user inputs that can be associated with respective ones of the steps. Further, FIG. 54 illustrates that, in the embodiment shown, user inputs in the third and fourth rows 400 and 402 may function to turn steps on or off, but when held, may cause other parameters (such as pitch, a chord, duration, or velocity) of respective steps in the sequence to be associated with other user inputs while still other parameters of at least one other track part (such as instrument, mixer, or sound effects, for example) are associated with still other user inputs.

Figure 55:
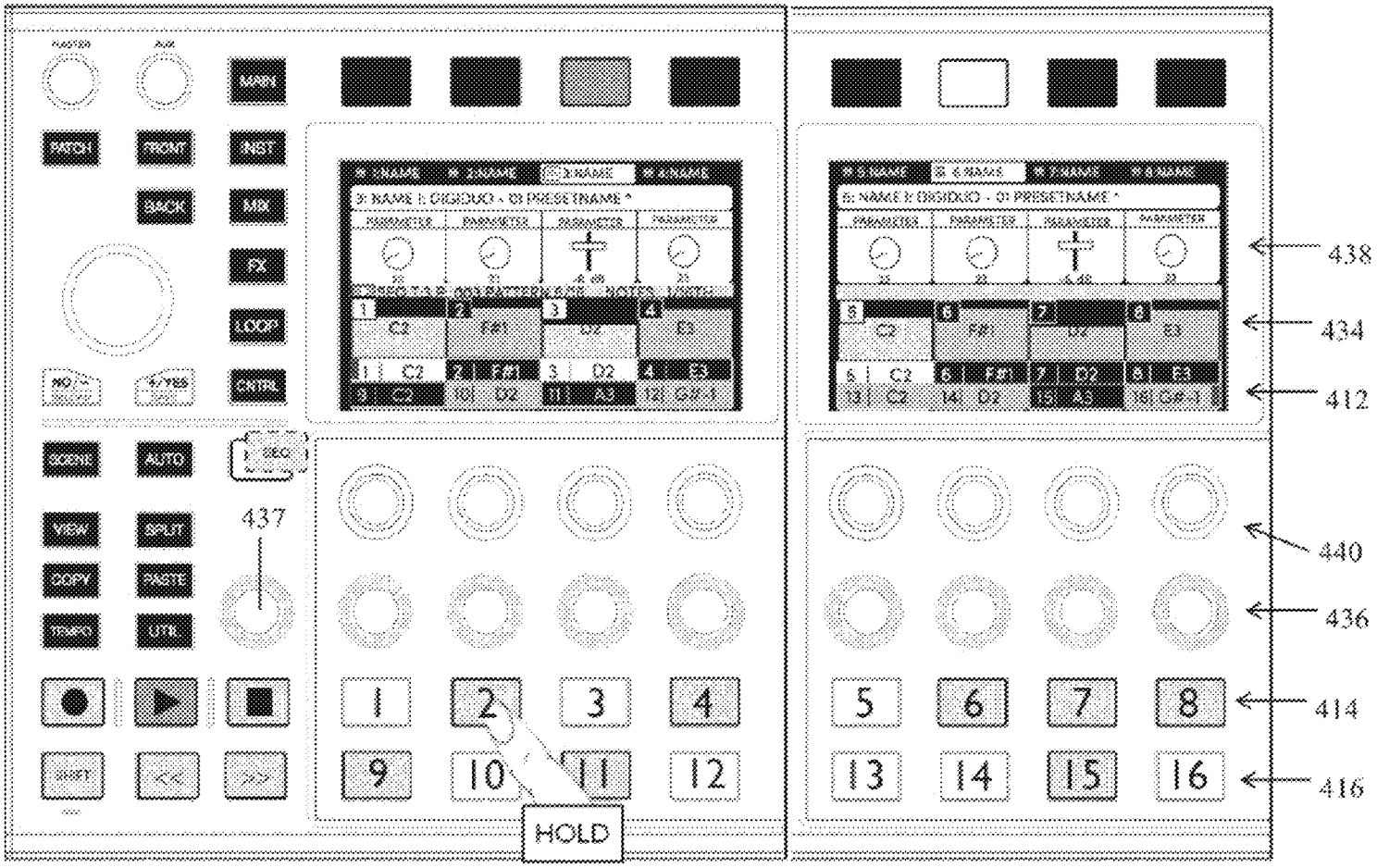

FIG. 55 illustrates a sequencing overlay shown generally at 434 on the music control device of FIG. 52 in addition to the sequencing overlay 412. As with the sequencing overlay of FIG. 54, when a user holds one of the user inputs in the rows 414 and 416 for a predetermined period of time (such as one or two seconds, for example) the sequencing overlay 434 is displayed including icons 16 icons, each associated with a respective step in a sequencer of a selected track, and each indicating (by number) the associated step and (by symbol) a pitch of the associated step, and user inputs in a row 436 are associated with parameters of respective steps. Releasing the one of the user inputs in the third and fourth rows 414 and 416 may remove the sequencing overlay 434. Although FIG. 55 illustrates pitch, one or more other parameters may be displayed, such as duration, velocity, or an indication of a chord, for example, and rotation of the knob 437 may change which parameters are displayed. When no step is held, rotation of the knob 437 may change the pattern (melody) associated with the track and may display the pattern it in the sequencing overlay 412. The sequencing overlay 434 is thus a timeline, displayed on the displays of the music control device, of steps in the sequencer. Further, FIG. 55 illustrates that, in the embodiment shown, user inputs in the third and fourth rows 414 and 416 may function to turn steps on or off, but when held, may cause other parameters (such as pitch, a chord, duration, or velocity) of respective steps in the sequence to be associated with other user inputs while still other parameters of at least one other track part (such as instrument, mixer, or sound effects, for example) are associated with still other user inputs.

The display 404 also displays parameter icons shown generally at 438 that are similar to the parameter icons described above in FIG. 15. The parameter icons 438 are associated with parameters of a different track part (such as an instrument, mixer, or effects track part, for example) of the selected track, and are also associated with respective user inputs in a first row 440 at the same time that user inputs in the row 436 are associated with respective steps in the sequencer. Therefore, in FIG. 55, some of the user inputs are associated with respective steps in the sequencer while others of the user inputs are associated with respective track parameters in at least one other track part. A similar sequencing overlay may appear on more than two modules.

Alternative embodiments may include other sequencing overlays. For example, when a music control device has three modules, a sequencing overlay similar to the sequencing overlay 412 or to the sequencing overlay 418 may extend across the three modules. Further, sequencing overlays such as those illustrated in FIGS. 51 to 55 may be split between modules. For example, when a music control device has more than one module, each module may have its own sequencing overlay similar to the sequencing overlay 406. As another example, when a music control device has four modules, two modules may have a sequencing overlay similar to the sequencing overlay 412, and the other modules may have a separate sequencing overlay similar to the sequencing overlay 412. Sequencing overlays may be split in other ways.

Figure 72:
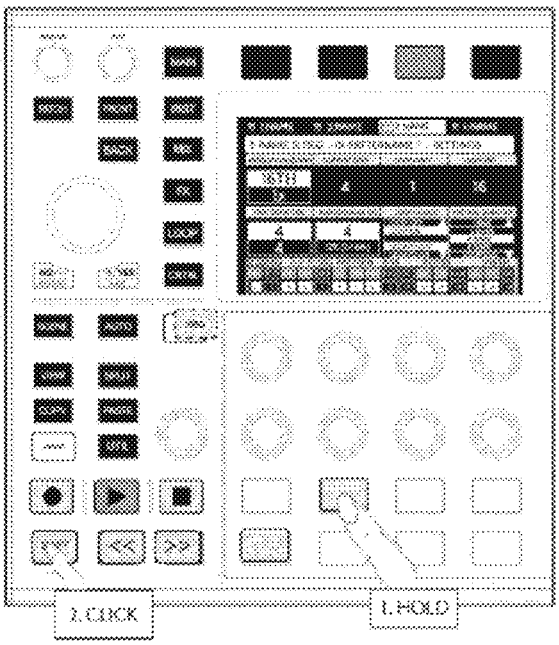

Pattern settings may be accessed, for example by holding a step button and then pressing a shift button as shown in FIG. 72. Pattern settings may be applied to every step in the sequence pattern, and pattern settings may include one or more of step resolution/zoom, current step, loop start, loop end, time signature, maximum duration, maximum step delay, loop on or off, legato, and pattern quantization. Actuating user inputs can vary the settings.

FIGS. 51 to 55 illustrate sequencing overlays, but automation overlays from automation track parts may function in the same way as described above to vary variations of parameters in the steps of a sequencer of a track. For example, FIGS. 68-71 illustrate automation overlays according to an embodiment that function analogously to the sequencing overlays of FIGS. 51, 52, 54, and 55 respectively. Likewise, automation setup may be similar to FIG. 72.

Figure 77:
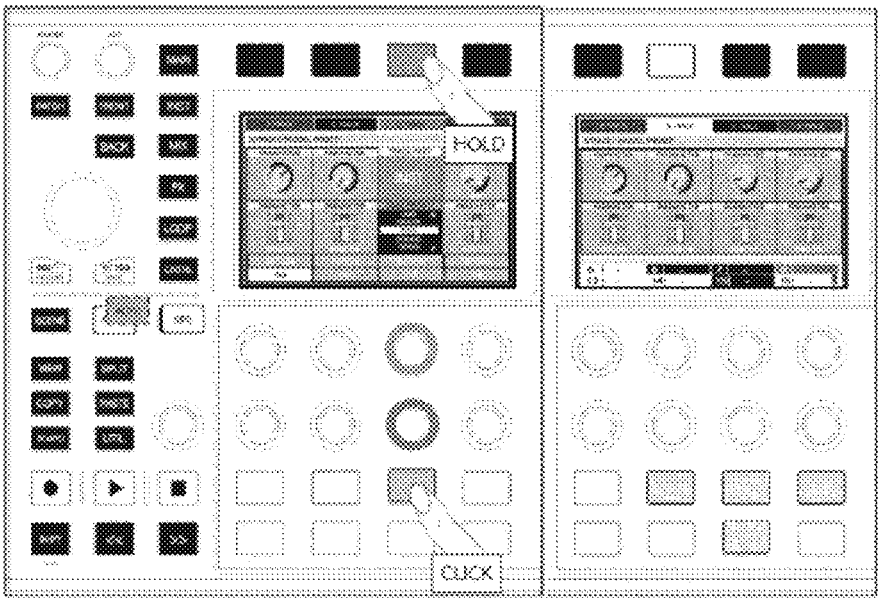

When a sequencing, automation, scene, or view overlay is displayed as described below for example, the track selection user inputs (126, 136, 146, and 156 on the main module 102 or track selection user inputs on an expansion module, for example) may still be used as described above for example. As shown in FIG. 77 as an example in one embodiment, when an automation overlay is displayed on one module, and when a track selection user input on another module is held for a predetermined period of time (such as one or two seconds, for example), the overlay is temporarily removed to display again tab icons (similar to tab icons 324 shown in FIG. 15, for example) to allow further selection of tabs to change associations of parameters with controls as described above, for example. Similar navigation may be available when a sequencing, scene, or view overlay is displayed.

When a music control device is in a split mode as described herein for example, a sequencer or automation overlay from one module may temporarily expand into another module in order to allow use of a greater number of user inputs in association with the overlay. For example, as shown in one embodiment in FIG. 78, holding a user input associated with a step of a sequencer or automation timeline on one module may cause additional icons to appear temporarily on a display of another module and associated with respective user inputs of the other module. As shown in the embodiment in FIG. 78, such additional icons may include a pattern selection icon, a tab area selection icon, icons indicating transport controls such as record, play, and stop, and icons indicating left and right inputs.

Figure 34:
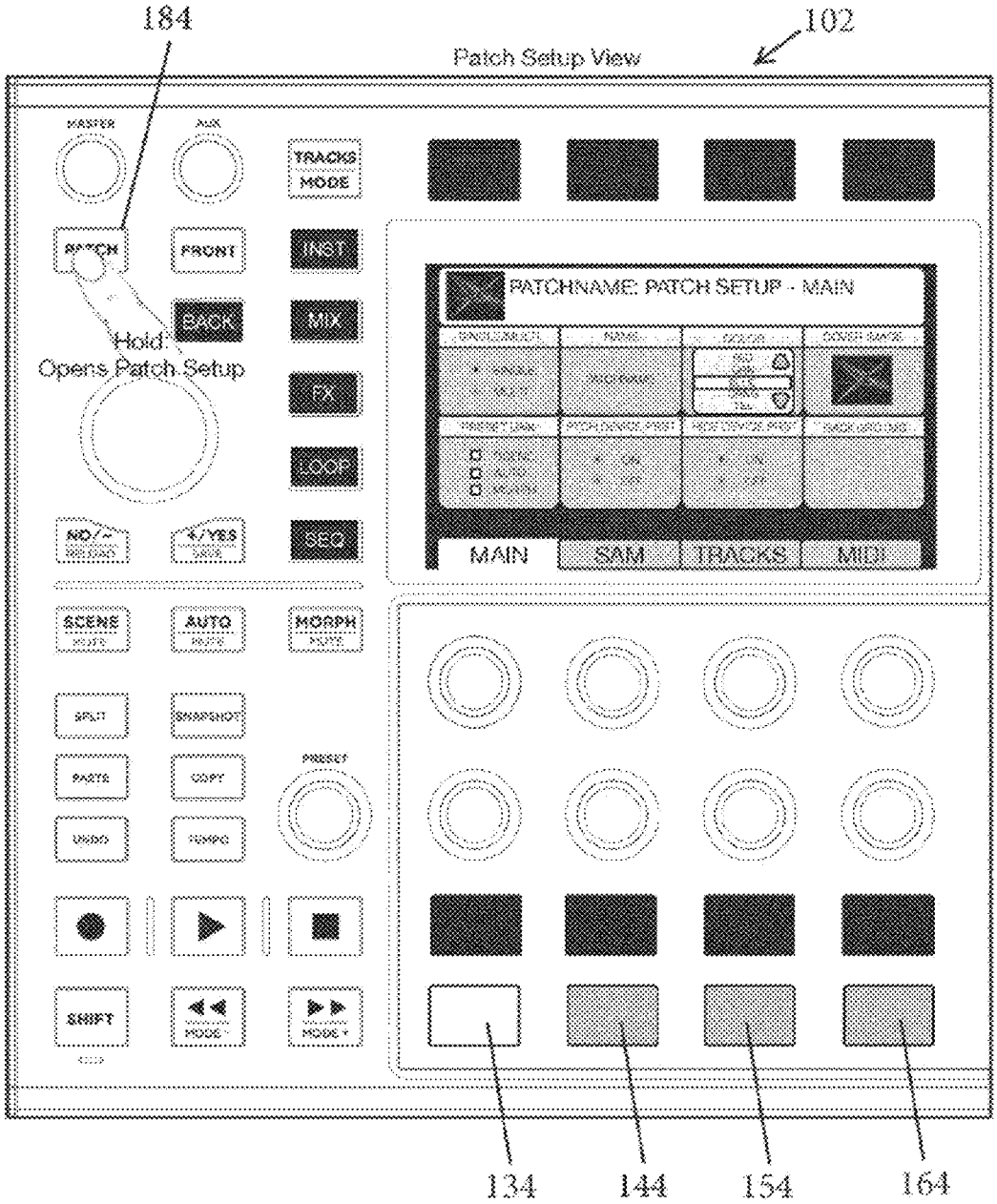
Figure 35:
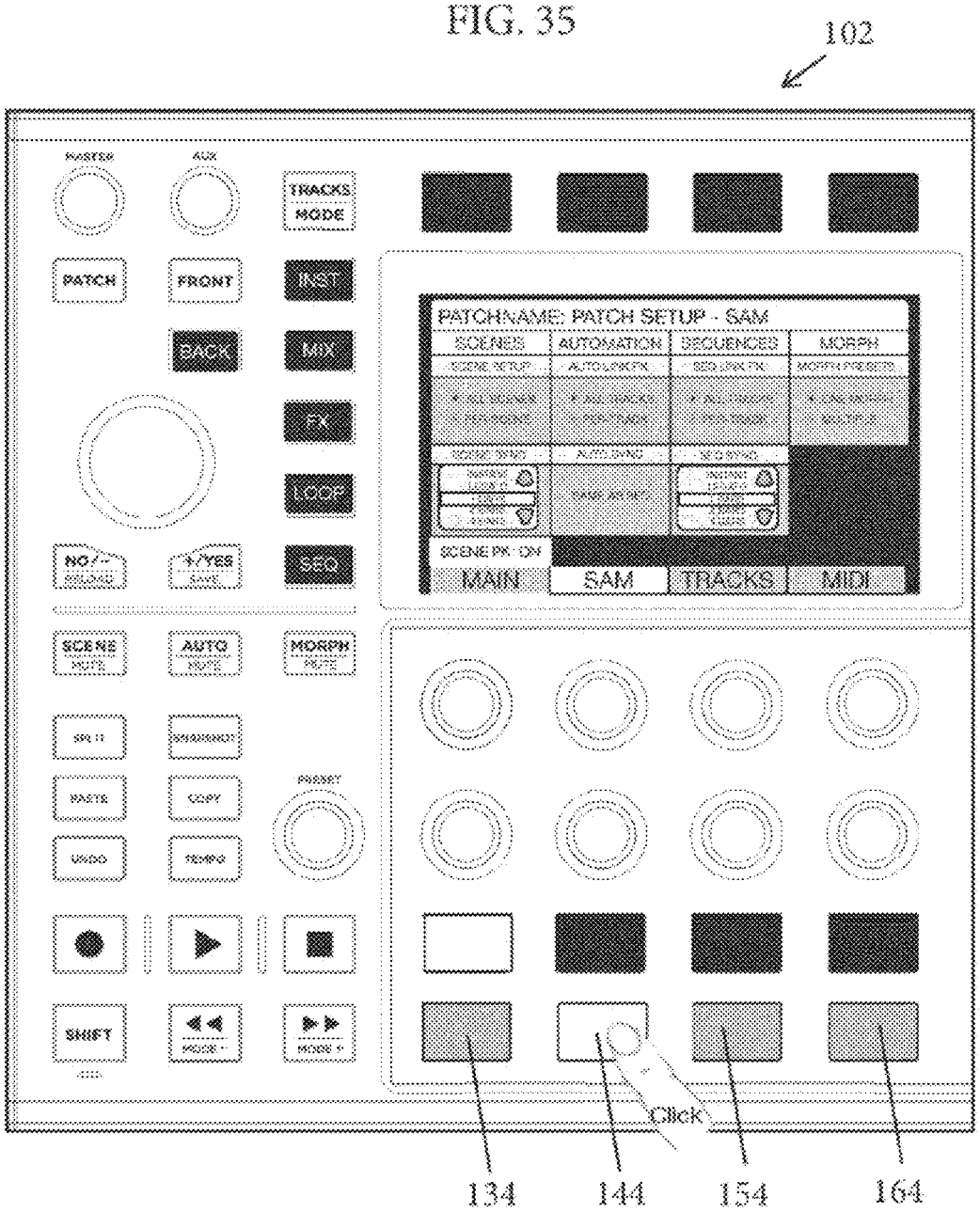
Figure 36:
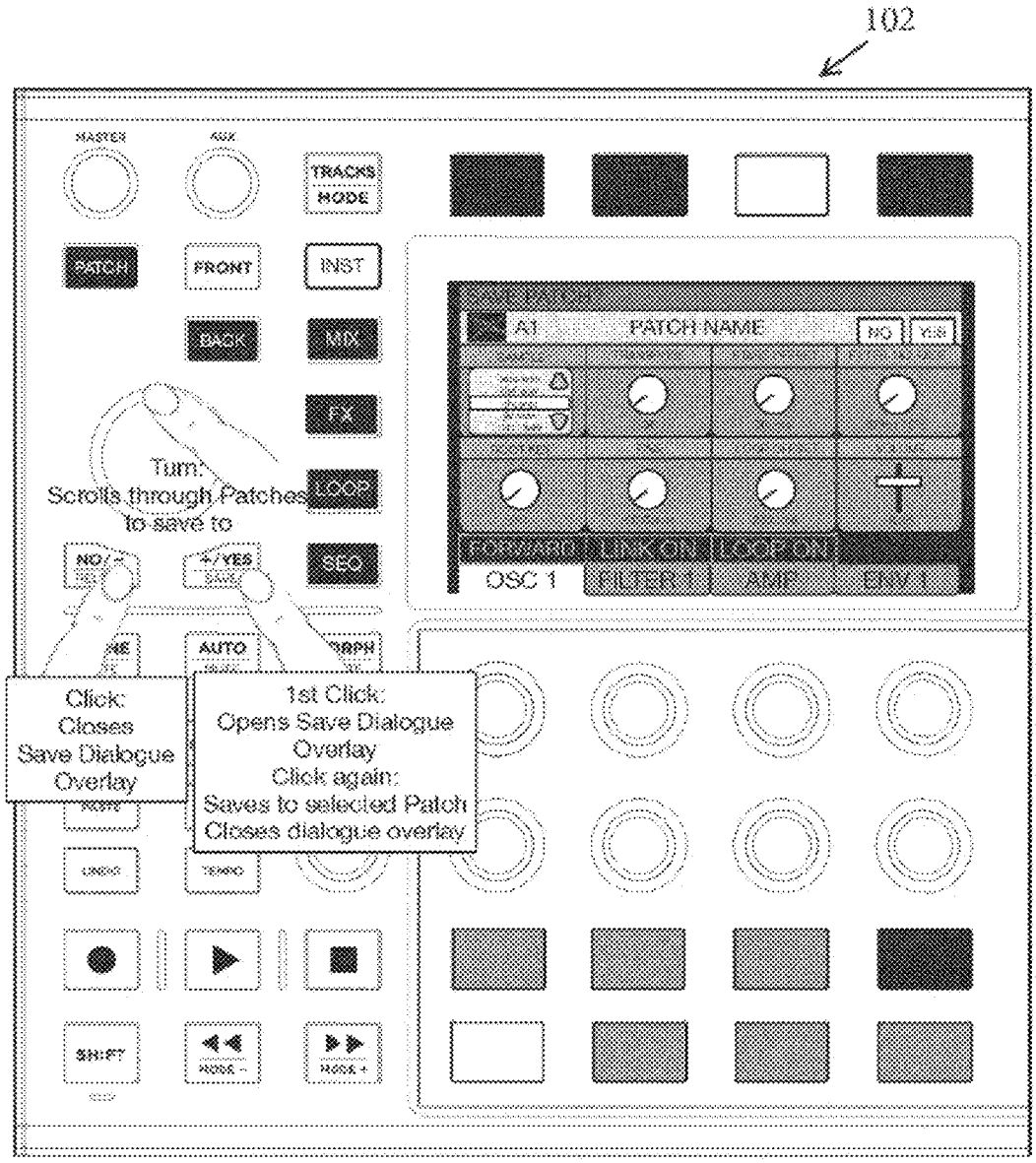
Figure 37:
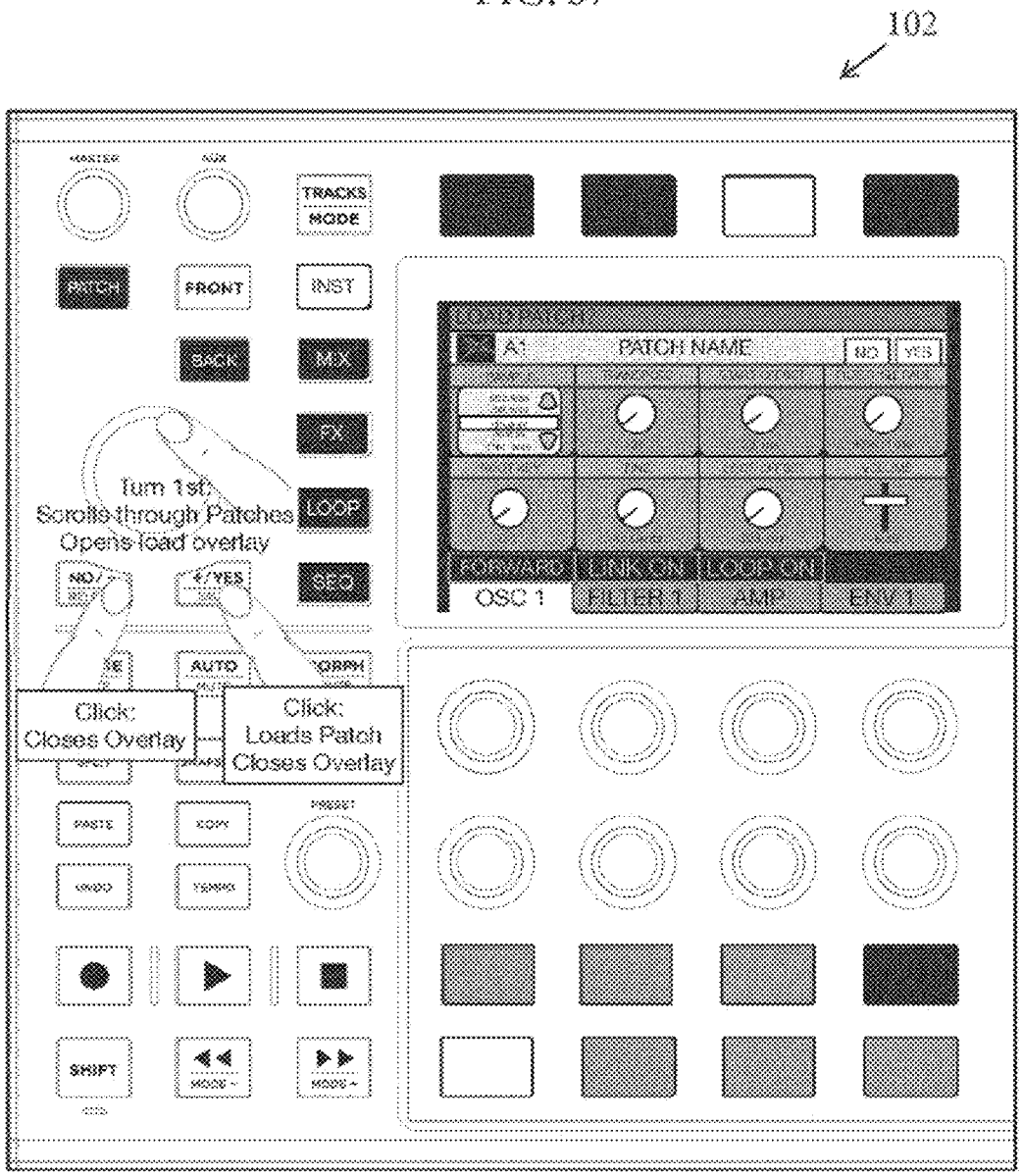
Figure 38:
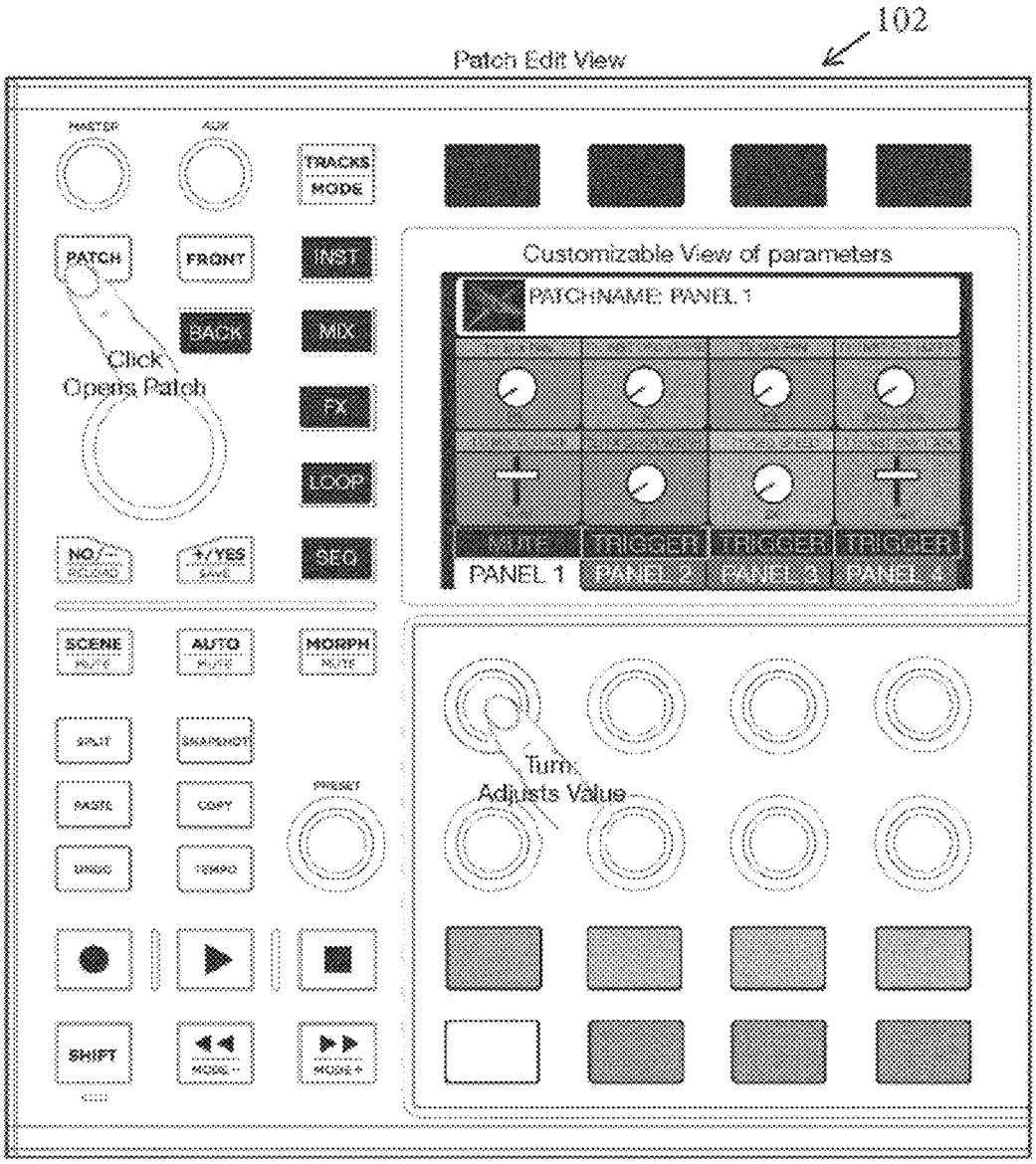

Referring to FIG. 34 user actuation of the patch selection user input 184 opens a patch setup screen as shown in FIG. 34. In general, a patch may be configured as a combination of user-selectable icons, each associated with a parameter of a model element, but not necessarily associated with the same track or track parts. In other words, a patch may be set up as a customized control panel including a collection of parameter icons that function as described above but in user-customizable patches. For example, patches may include presets per patch, presets per model, patterns per patch, samples per patch, scene, automation, or modulation between model parameters, for example. User actuation of the user inputs 134, 144, 154, and 164 changes set up icons on the display 110, and the remaining controls 165 may be used to set parameters of a selected patch as shown in FIGS. 34 and 35. Once sent up, a patch may be saved as a single data entity as shown in FIG. 36, and a previously saved patch may be loaded as shown in FIG. 37. Once a patch is set up or loaded, various different parameters may be varied according to the parameter icons of the patch, as shown in FIG. 38 for example. The patch editor is an example of another editor that may associate icons on one module with controls on another module.

Figure 39:
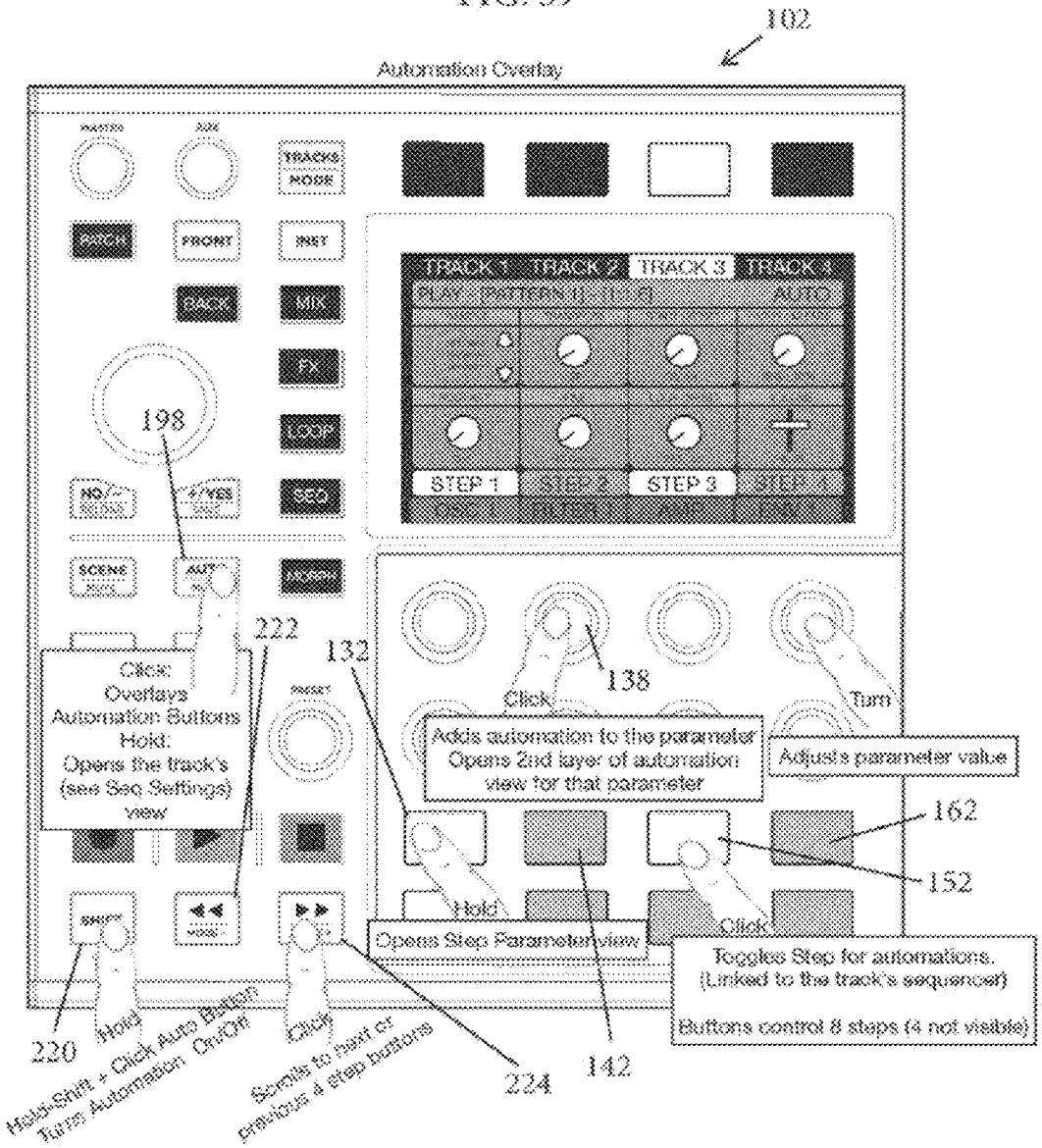

Referring to FIG. 39, when any one of the editor screens described above is displayed, an automation overlay may be displayed by user actuation of the automation selection user input 198. Initially, user actuation of the automation selection user input 198 causes a multiple-parameter automation overlay as shown in FIG. 39. The user inputs 132, 142, 152, and 162 are associated with respective steps (or time divisions) indicated by icons on the display screen 110 associated with the user inputs 132, 142, 152, and 162. The multiple-parameter automation overlay in FIG. 39 thus represents a timeline. As shown in FIG. 39, holding the user input 132 causes icons associated with parameters that have been automated on the step associated with the user input 132 to be displayed with a color (yellow in one embodiment) indicating automation of the associated parameter. By holding the user input 132, automation may be added to a parameter by pressing or clicking the user input associated with the parameter. For example, as shown in FIG. 39, pressing or clicking the user input 138 while the user input 132 is being held as automation to the parameter "TRANSPOSE" associated with the user input 138. Automation may be removed for a parameter again by holding the user input associated with the step and then clicking or pressing the user input associated with the parameter. That process may be repeated for different steps to add or remove automation for different parameters at different steps. As shown in FIG. 39, the reverse user input 222 and the forward user input 224 may be used to scroll forward and backward within the steps.

Figure 40:
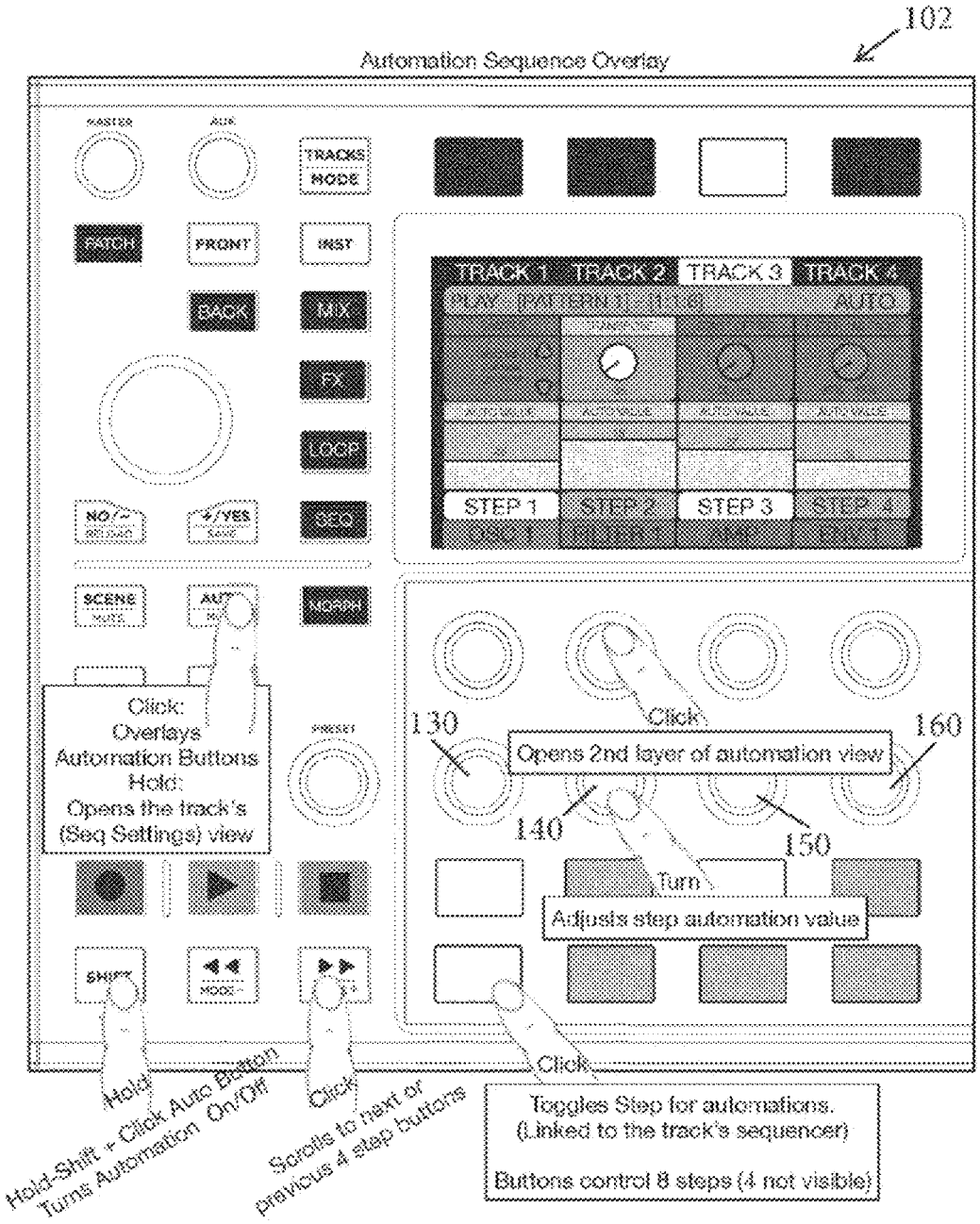
Figure 41:
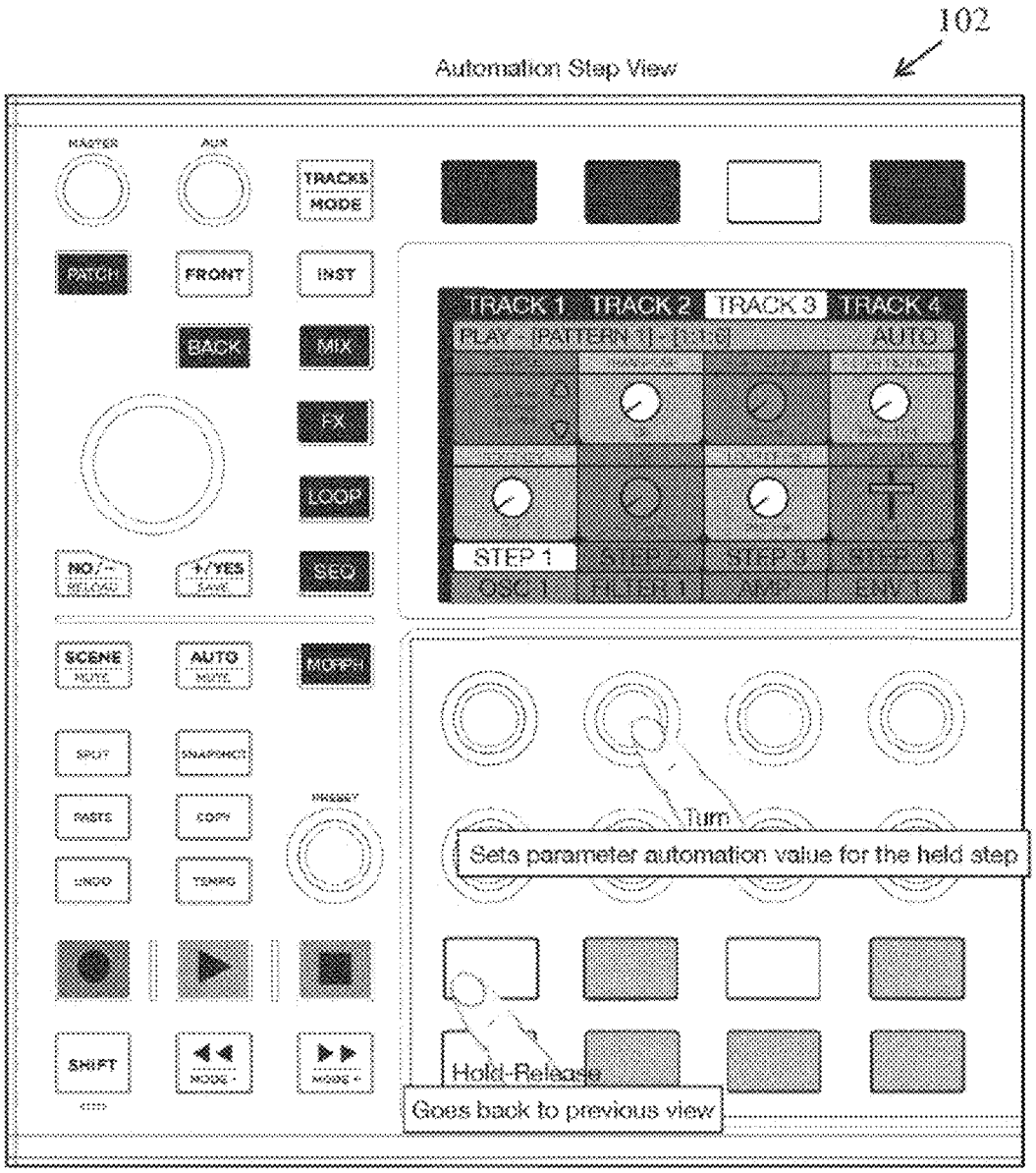

FIG. 40 illustrates a "single parameter" view, in which pressing or clicking the user input 138 selects a parameter 138 ("TRANSPOSE" in the embodiment shown) associated with the user input 138, and automation values of the selected parameter may be varied in each of the steps shown in the display screen 110 by turning the user inputs 130, 140, 150, and 160, each of which is associated with a respective one of the steps, and each of which varies automation value icons at each of the steps and associated with the user inputs 130, 140, 150, and 160 on the display screen 110 to vary the automation value at each of the steps in time. Automation may vary relative amounts (in which case an automation value is added to or subtracted from an original parameter value) or absolute amounts (in which an automation value replaces an original parameter value). FIG. 41 illustrates an automation step view, in which parameter automation values may be set for a selected step. Automation may be turned on by holding the shift user input 220 and pressing or clicking the automation selection user input 198.

FIGS. 39 to 41 illustrate automation in a "front" editor following user actuation of the front selection user input 186, but in some embodiments automation may also be applied to a "back" editor (for example as described with reference to FIGS. 9 to 13) following user actuation of the back selection user input 188.

Figure 42:
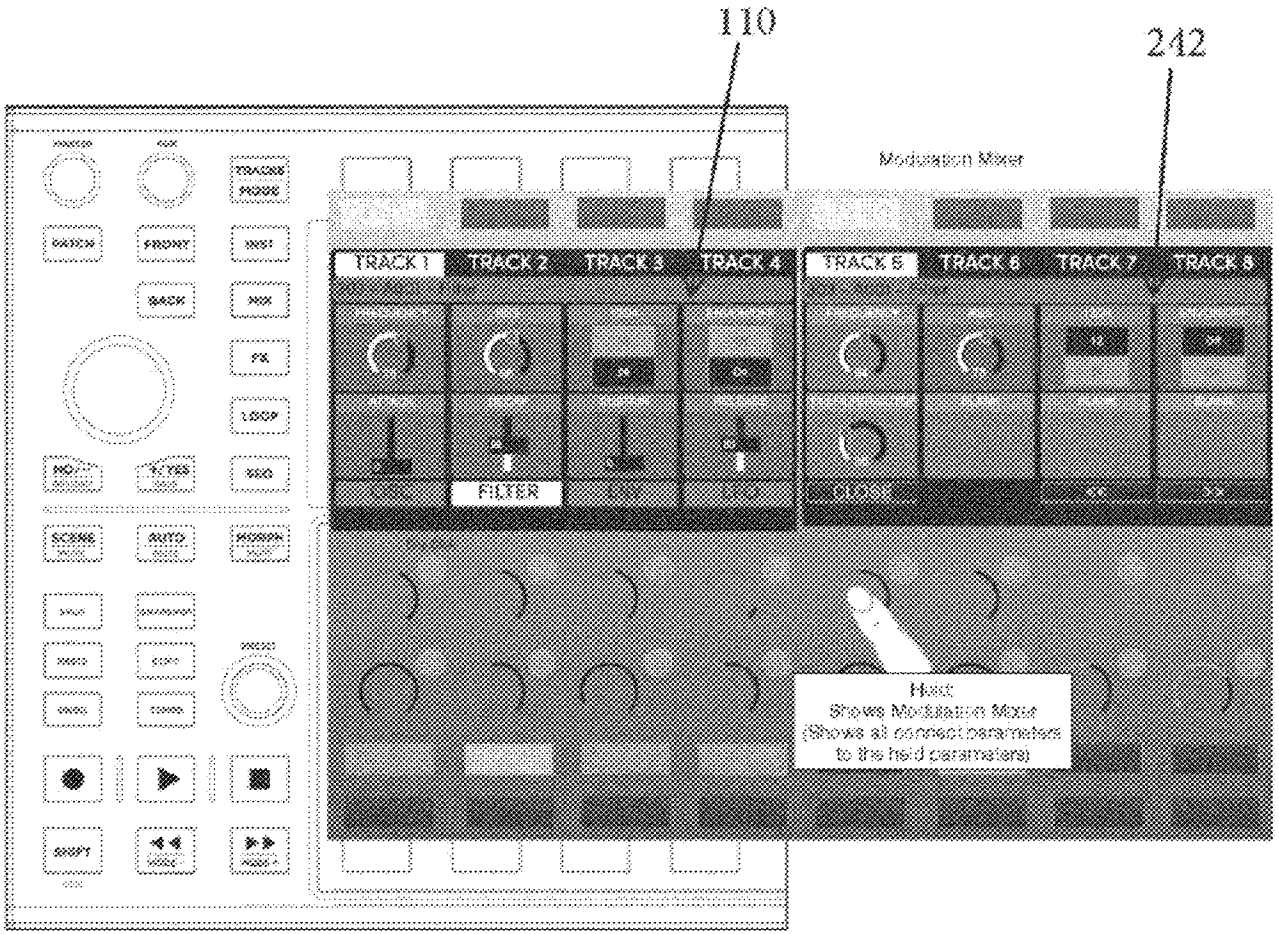

Referring to FIG. 42, a modulation mixer is accessible when navigating a track and track part as described above by pressing one of the user inputs associated with a parameter for a predetermined period of time (a few seconds, for example). For example, as shown in FIG. 42 holding one of the user inputs (corresponding to the user input 128 on the expansion module 104) causes a modulation mixer to be displayed for the parameter associated with the icon associated with the user input. The modulation mixer may be closed by clicking or pressing the user input again, or by user actuation of a user input associated with the "close" icon on the display screen 242.

In the module mixer display, interconnections made to a parameter appear as an overlay, so that the interconnected parameters may be visualized and varied. For example, a resulting parameter value may be an original parameter value varied according to one or more modulation sources as indicated in the modulation mixer.

Figure 43:
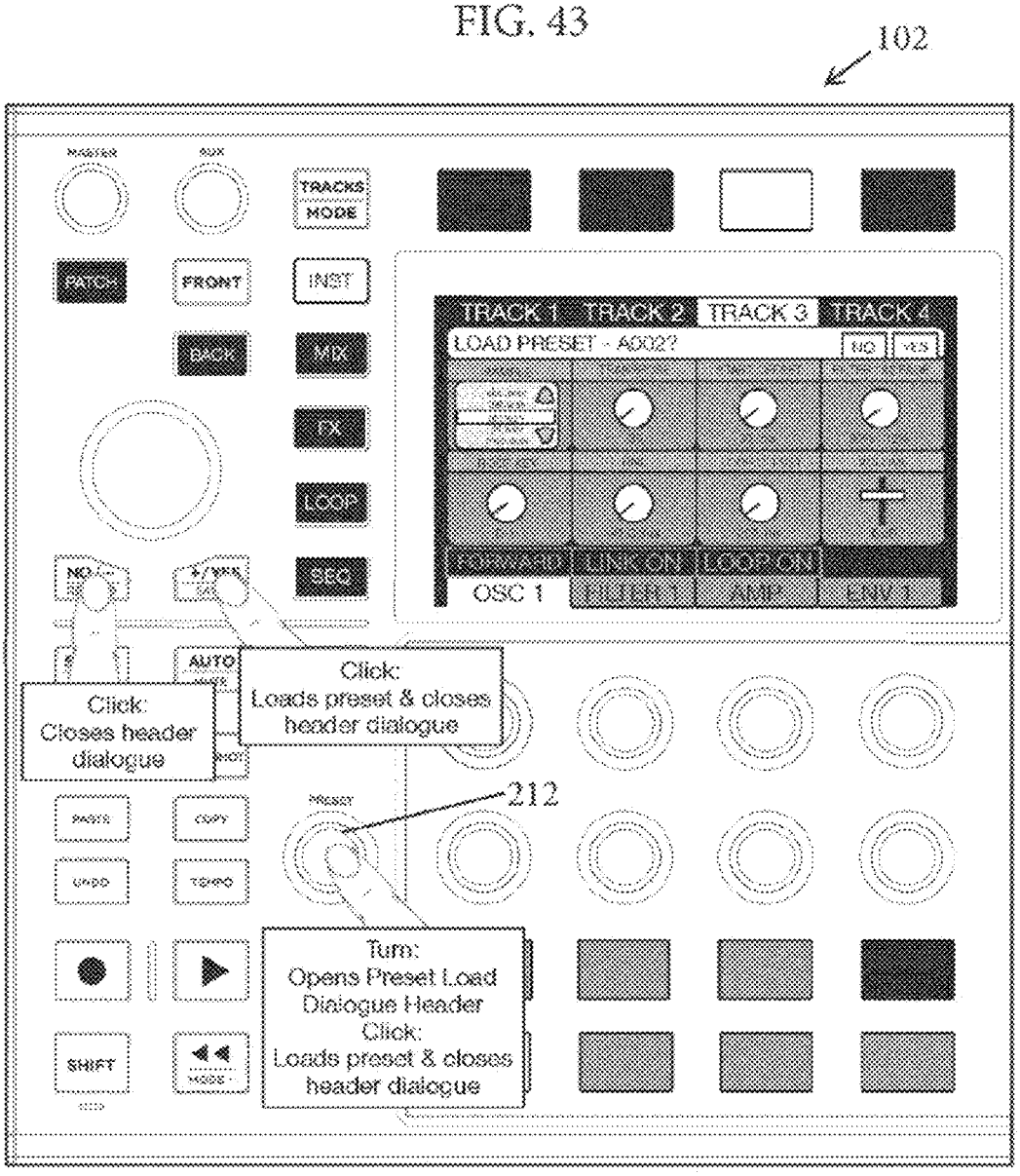

Referring to FIG. 43, a preset overlay may be displayed by turning the preset user input 212, which may select from a plurality of preset values of parameters. Clicking or pressing the preset user input 212 selects one of the presets, and causes the parameters defined by the selected preset to have respective values defined by the selected preset. In general, a preset may be a set of previously stored parameter values, and/or a selected model, instrument type, or sound effects type, of one track part, whereas a scene may apply to all track parts.

Figure 44:
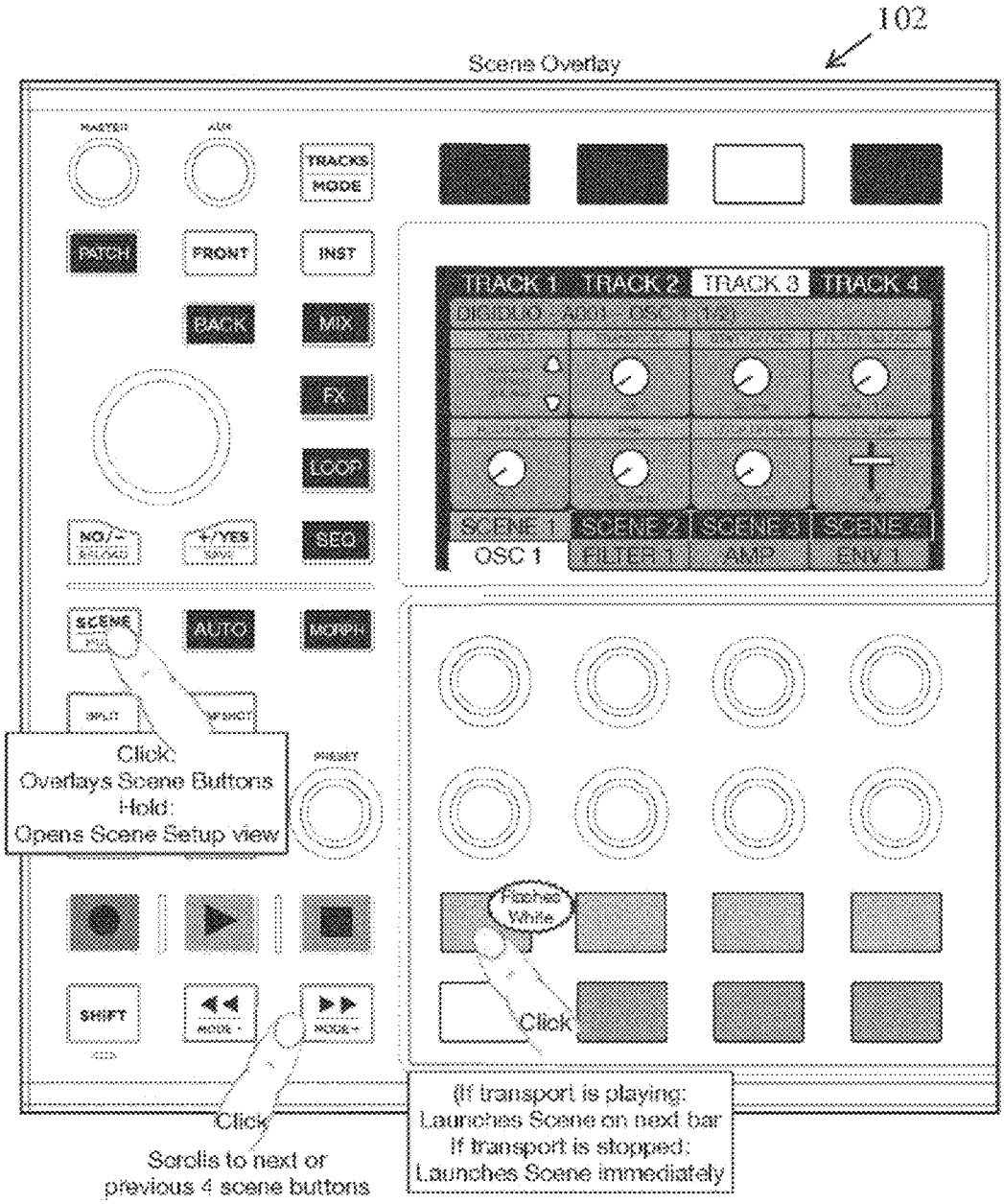
Figure 45:
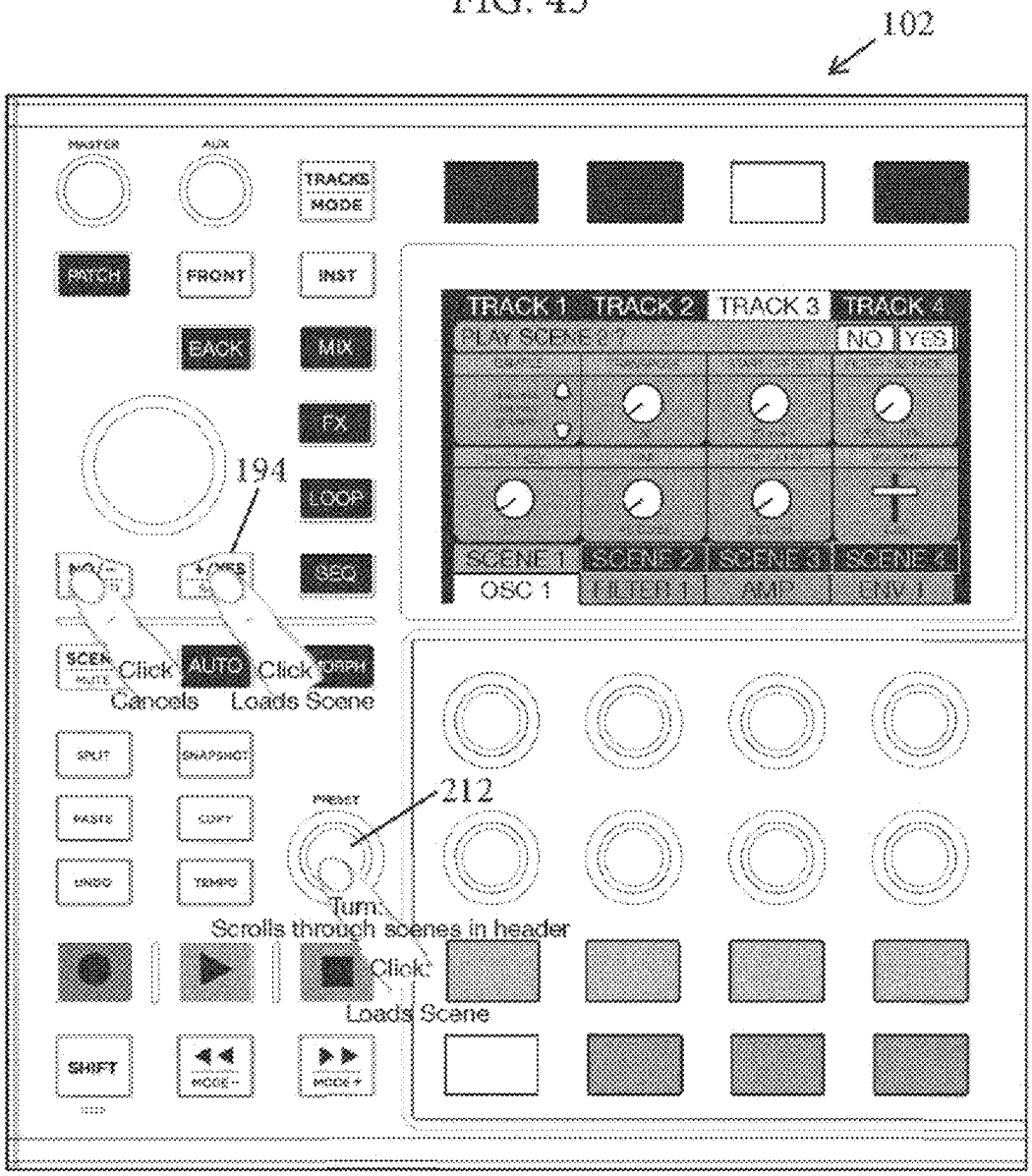
Figure 46:
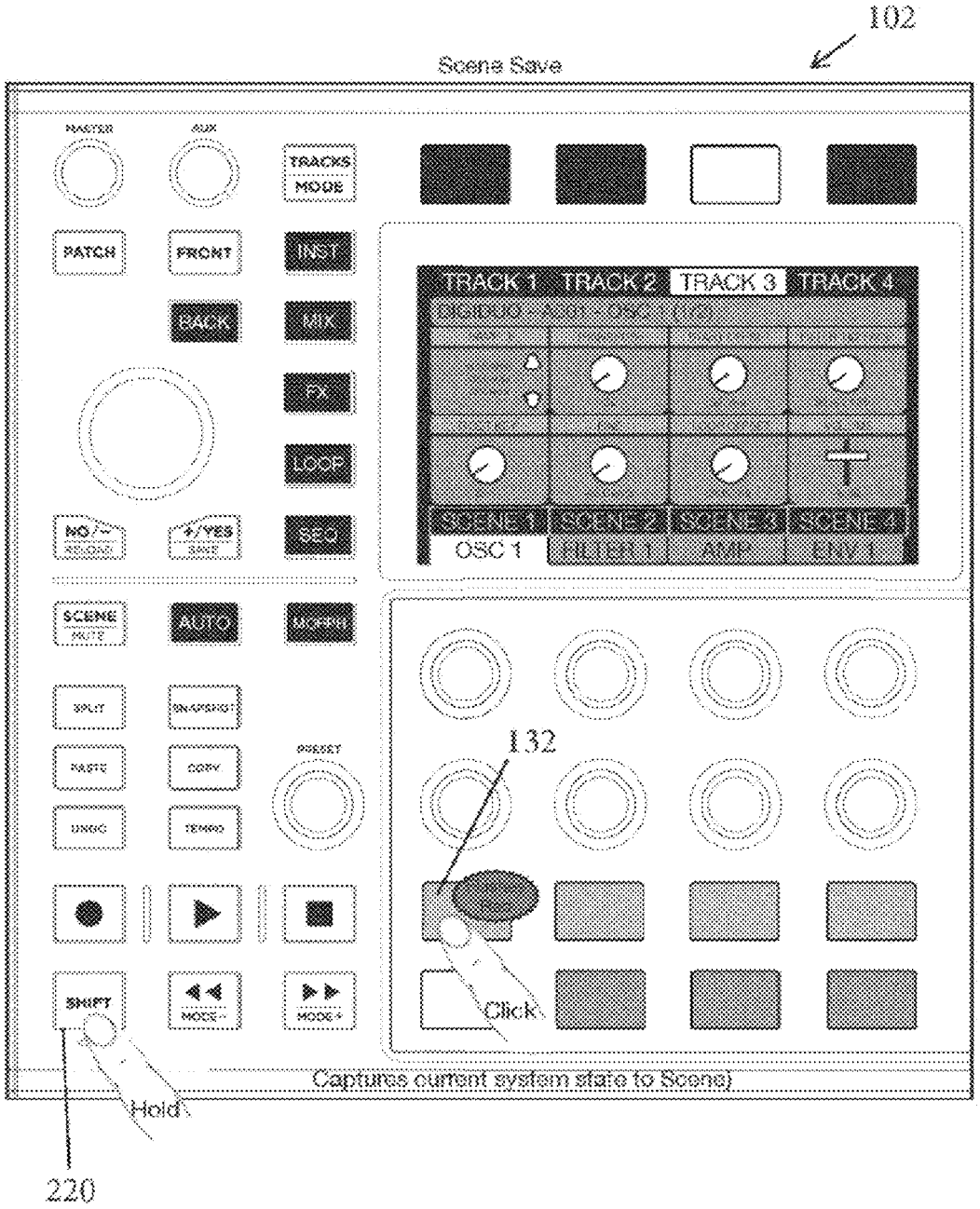
Figure 47:
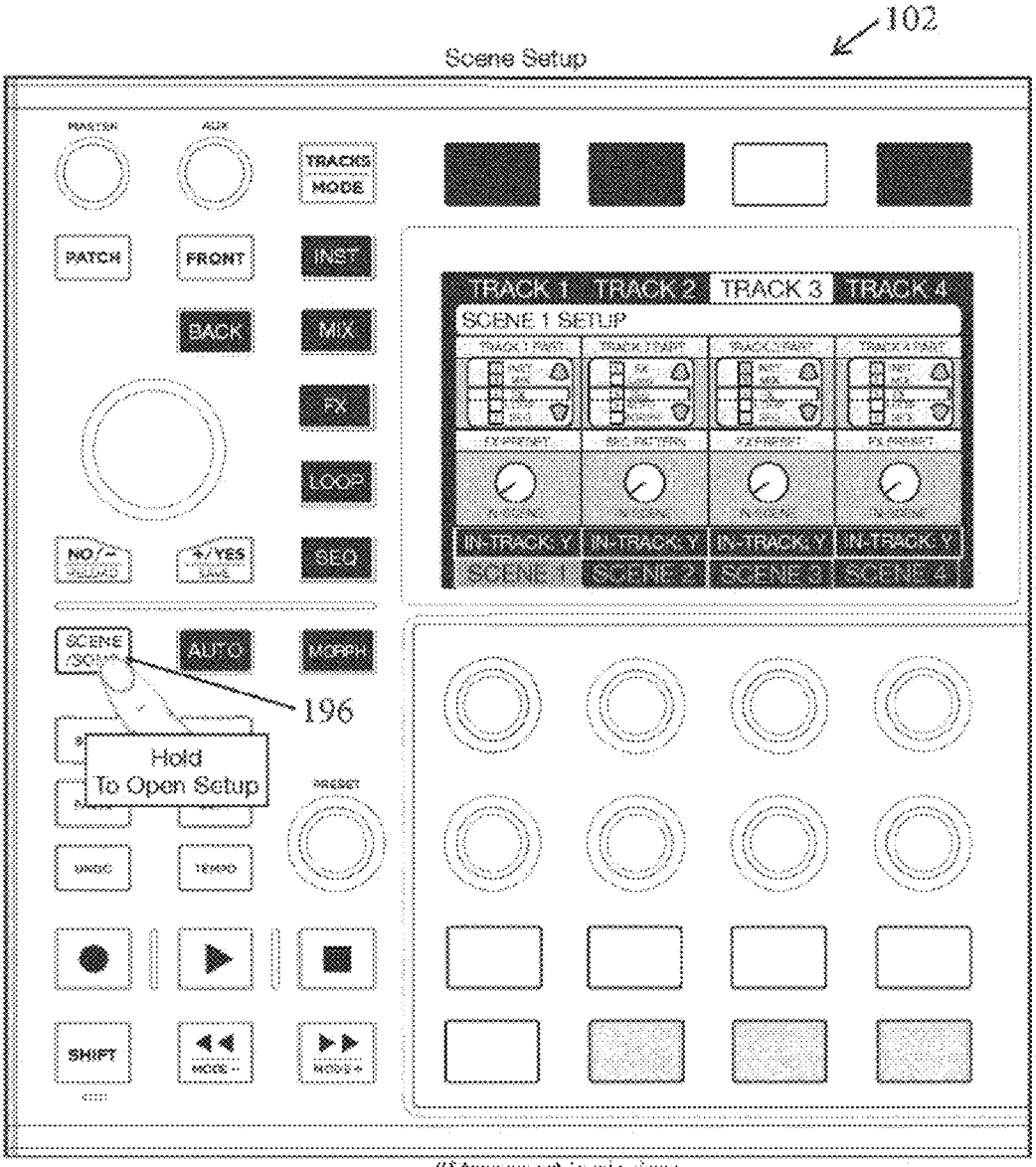

Referring to FIG. 44, user actuation of the scene selection user input 196 causes a scene overlay to be displayed on the display 110. As shown in FIG. 45, turning the preset user input 212 scrolls through a plurality of scenes, and user actuation of the "YES" user input 194 loads a selected scene. In general, a scene is a snap shot of parameter values at a point in time, and loading a scene causes parameters defined by the scene to have respective values defined by the scene. As shown in FIG. 46, holding the shift user input 220 and pressing or clicking the user input 132 captures a current state of parameter values as a scene. As shown in FIG. 47, holding the scene selection user input 196 opens a scene setup display on the display screen 110, which allows configuration and set up of scenes.

However, in some embodiments, recalling a scene may not only recall and apply parameter values, but may also recall and apply associations of user inputs with parameters. For example, saving a scene may save selections of tracks, track parts, and parameter subsets (as control panel tabs, for example) so that user inputs become associated with parameters according to associations of user inputs that are saved as part of a scene. Additionally or alternatively, in some embodiments, recalling a scene may also recall and apply track part models (such as instrument types, sound effect types, or control layouts, for example), simulated interconnections between model elements, or both.

Figure 56:
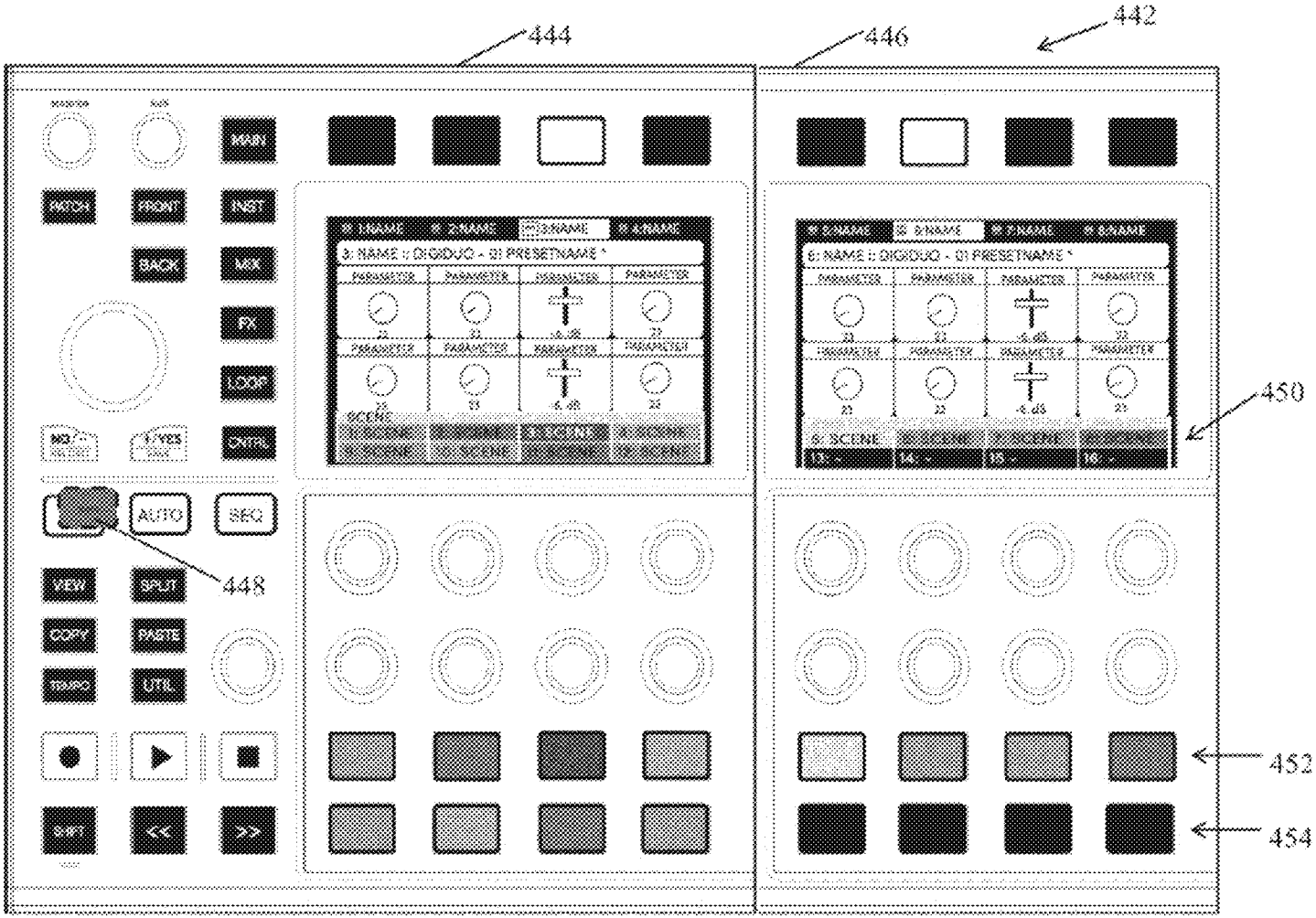

In a track, previously stored scenes may be associated with respective user inputs so that user selection of one of the user inputs causes a scene associated with the selected one of the user inputs to be recalled and applied. Referring to FIG. 56, a music control device according to another embodiment is shown generally at 442 and includes a main module 444 and an expansion module 446. The main module 444 is similar to the main module 102 or the main module 358 and includes a scene user input 448. The expansion module 446 is similar to the expansion module 104 or the expansion module 360. User selection of the scene user input 448 causes a scene overlay shown generally at 450 to appear on displays of the music control device 442. The scene overlay 450 includes scene icons aligned and associated with respective user inputs in rows 452 and 454, and user selection of one of the user inputs in the rows 452 and 454 causes a scene associated with the selected user input to be recalled and applied.

Figure 57:
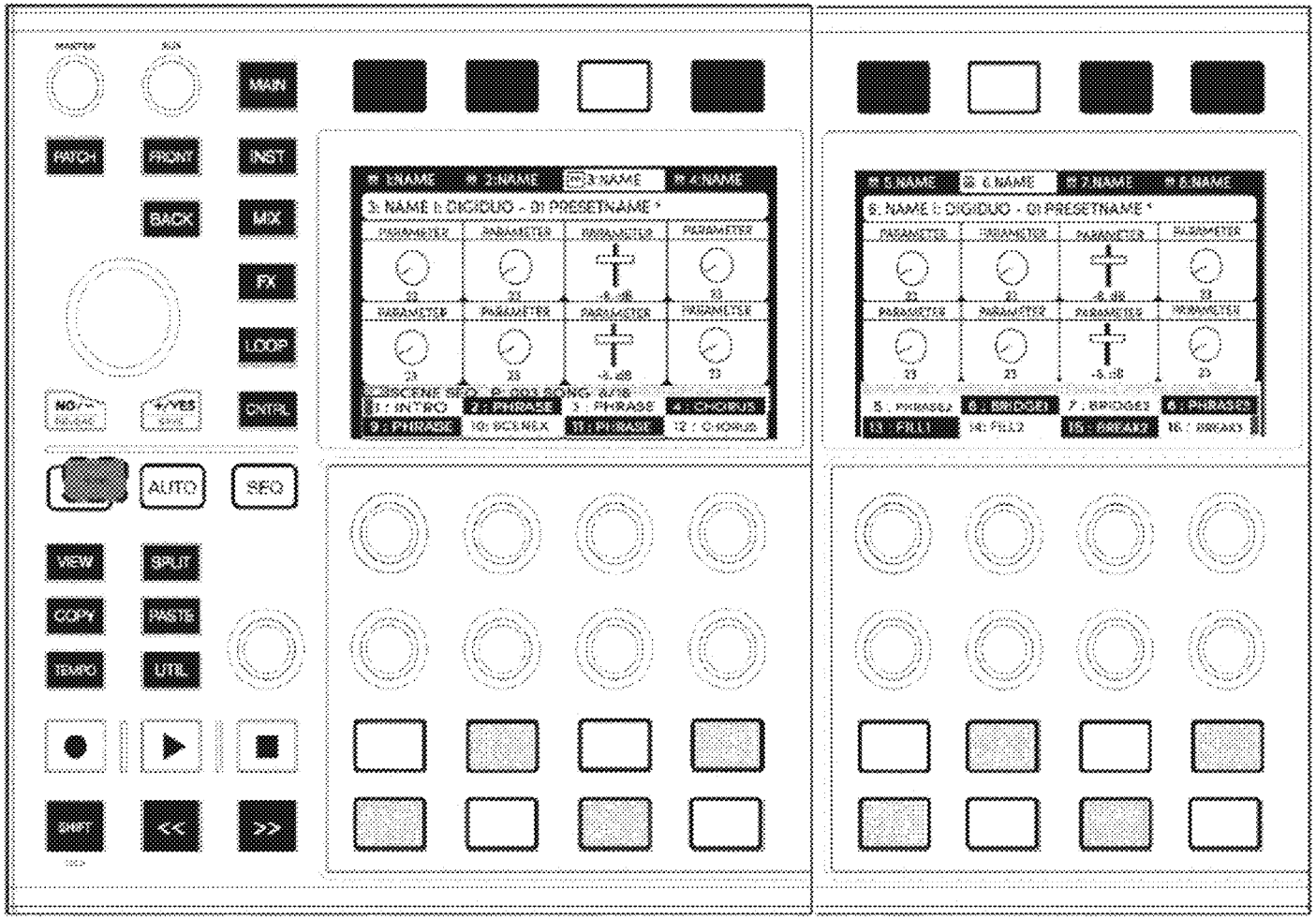
Figure 82:
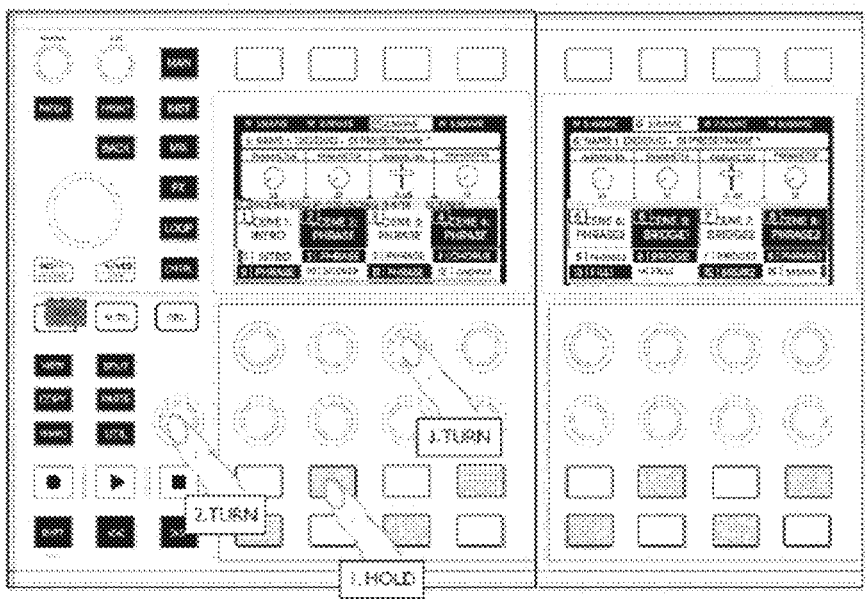
Figure 83:
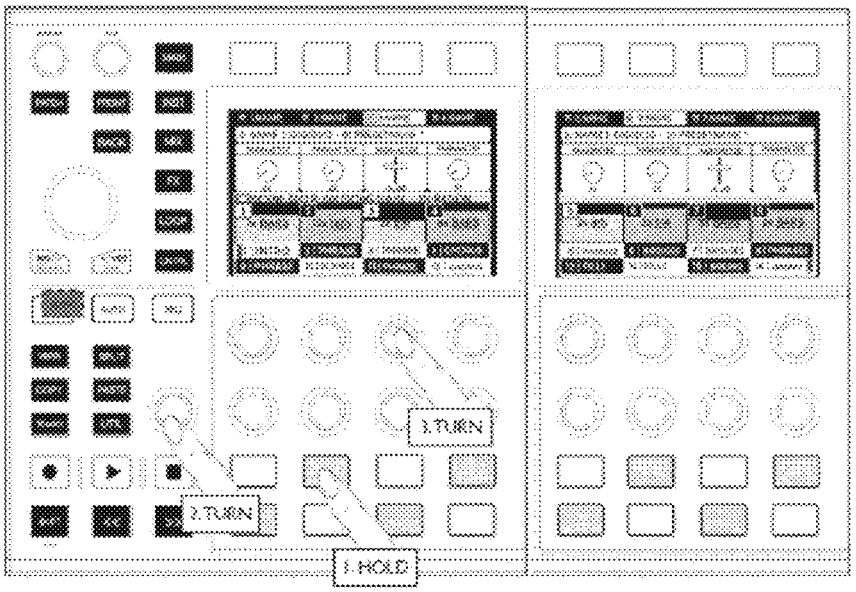

In some embodiments, scenes may recalled and applied using a scene overlay such as the scene overlay 450, but scenes may also recalled and applied at defined steps in a sequence. For example, FIG. 57 illustrates a scene overlay having scenes associated with sections (such as introduction, phrase, phrase, chorus, phrase, bridge, phrase, and so on) of a sequence, and such scenes may be recalled and applied automatically at the first step of each such section in the sequence. By recalling and applying scenes automatically at such defined steps in a sequence, parameter values may automatically be adjusted for each of the sections of the sequence, and further controls may be associated with parameters that may be most likely to be varied for each of the sections of the sequence. FIG. 82 illustrates a user interface according to one embodiment for selecting a scene for a step in a sequencer first by holding a user input associated with an icon associated with a step, and then by turning a "pattern" knob to select scene selection. Then other user inputs may be associated with respective steps in the sequence, and turning one of the other user inputs may select a scene for the associated step. As shown in FIG. 83, duration may be selected instead by turning the "pattern" knob to select duration. Then other user inputs may be associated with respective steps in the sequence, and turning one of the other user inputs may select a duration for the associated step.

As scenes are recalled, scenes may be applied to all tracks, or only to a selected one or more tracks. Further, as scenes are recalled, scenes may be applied to only one module, to some but not all of a plurality of modules, or to all of a plurality of modules.

Figure 79:
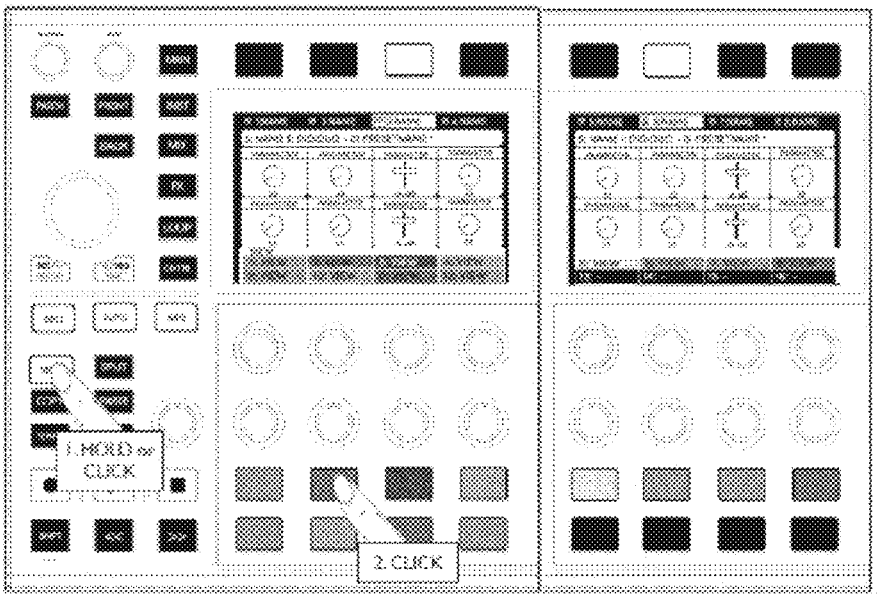
Figure 80:
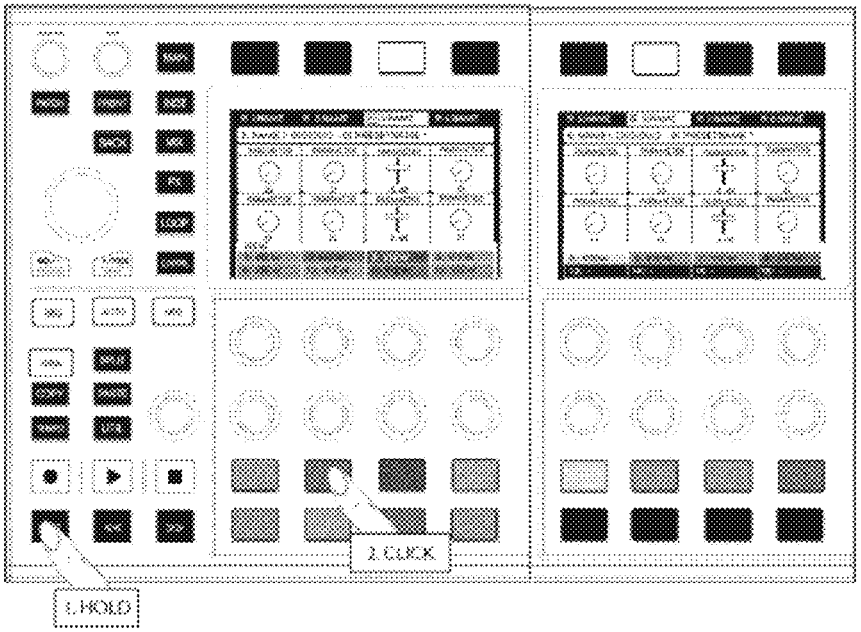
Figure 81:
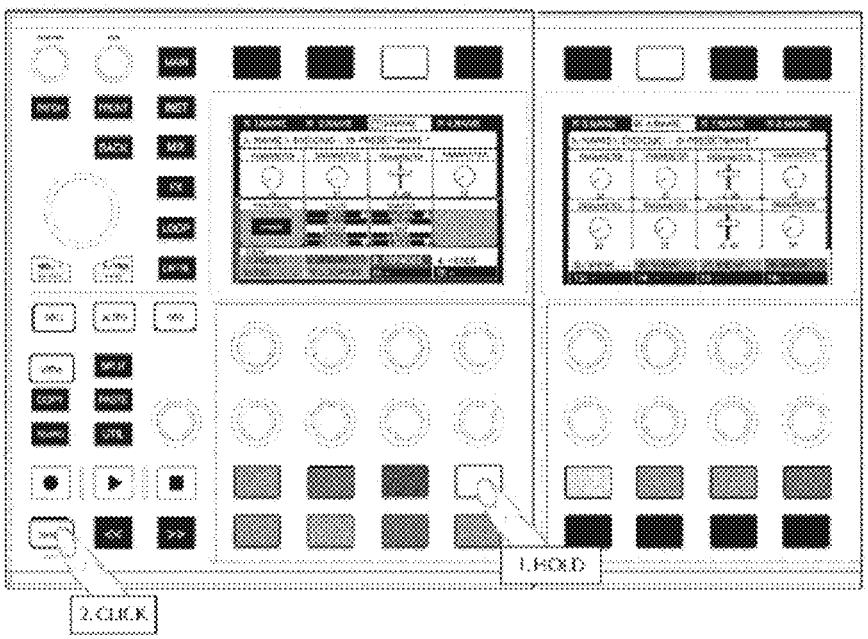

Further, views may be recalled and applied in the same way as described above for scenes. Recalling and applying a view involves applying previously stored associations of parameters and user inputs (on all modules, for example) without applying previously stored values of the parameters. Views may also store which tracks are selected in each module, which track part is selected per track, and which tab or multi tab is selected per track and per track part. A view may also store which overlays (such as sequencing, automation, scene, or view, for example) are displayed. For example, FIG. 79 illustrates a user interface according to one embodiment for recalling and applying a view by holding or clicking a "view" user input, which causes an overlay to be displayed, the overlay including icons associated with respective user inputs and with respective views. A view can then be selected by user actuation of the user input associated with the icon associated with the view. FIG. 80 illustrates a user interface according to one embodiment saving a view by holding a "shift" user input and actuating a user input associated with an icon associated with a view, which causes the current associations of parameters and user inputs to be stored as the view associated with the icon associated with the actuated user input. FIG. 81 illustrates a user interface according to one embodiment for accessing and varying settings for a view. By holding a user input associated with an icon associated with a view for a predetermined period of time (such as one or two seconds, for example) and then by actuating the "shift" user input, settings for the view may be accessed and varied.

Figure 58:
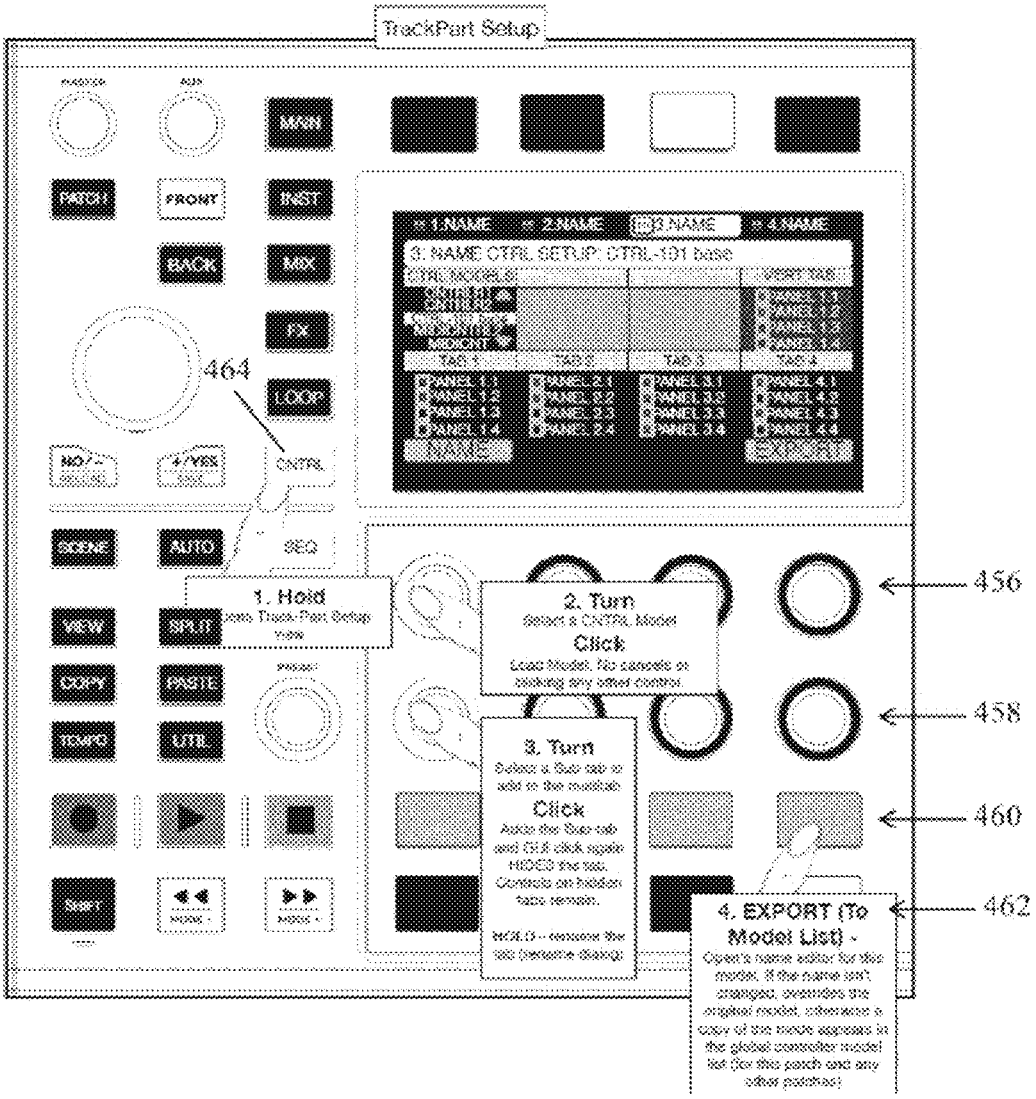

Previously stored associations of user inputs with parameters may be recalled and applied as part of scenes or views, but may also be recalled and applied from a control track part of a track. FIG. 58 illustrates a setup interface for a control track part of a track, which allows a user to select sets of associations of parameters with user inputs. Each such set of associations of parameters with user inputs defines which parameters, which may be from more than one track part, are associated with the user inputs in the rows 456 and 458. Further, using the setup interface of FIG. 58, each such set of associations may be associated with a respective one of the user inputs in the rows 460 and 462 so that user selection of one of the user inputs in the rows 460 and 462 recalls and applies an association, of parameters with the user inputs in the rows 456 and 458, that is associated with the selected one of the user inputs in the rows 460 and 462.

Figure 59:
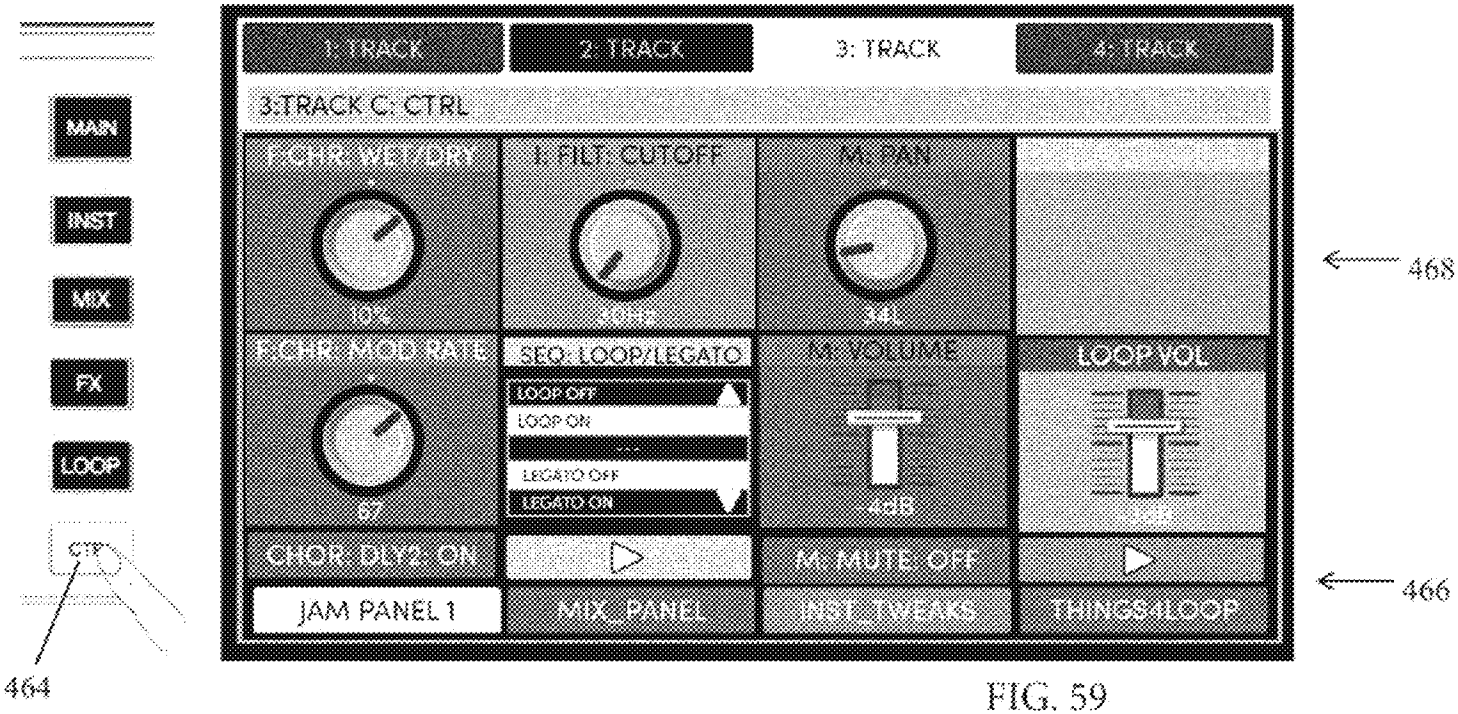

Referring to FIGS. 58 and 59, when the control track part is selected using a control track part selection user input 464, control icons shown generally at 466 are associated with respective user inputs in the rows 460 and 462 and with respective previously stored associations of parameters with the user inputs in the rows 456 and 458, so that selection of one of the user inputs in the rows 460 and 462 recalls and applies a respective previously stored association of parameters with the user inputs in the rows 456 and 458 that is associated with the selected user input in the rows 460 and 462. Therefore, selection of previously stored associations of parameters in a control track part of a track allows user inputs to be associated with selected parameters that may be convenient to be able to vary at one time. FIG. 59 illustrates an example of parameter icons shown generally at 468 that are associated with respective parameters (that may be from more than one track part) and that are associated with respective ones of the user inputs in the rows 456 and 458 and that are recalled from the control part of a track by user selection of one of the user inputs in the rows 460 and 462. Control panel assignments can be stored and recalled in scenes and can allow dynamic re-assigned of control in every panel for specific purposes at specific times.

Music control devices such as those described herein may have various different applications as music synthesizers, as music mixers, as music sampling devices, as music arranging devices, or as music sequencing or composition devices. Further, music control devices such as those described herein may function as a hub to coordinate musical instruments for performance, recording, or other production or presentation of music. In general, music control devices as described herein, and interaction with music control devices as described herein, may be more efficient by permitting greater user control with a limited number of user inputs when compared to other music control devices.

Without limiting any of the embodiments described herein, ornamental designs of the music control devices as shown in the drawings are also disclosed, and icons, combinations of icons, user interfaces, display elements, combinations of display elements, and other contents of displays of the music control devices as shown in the drawings, both on their own and in combination with the music control devices, are also disclosed.

Although specific embodiments have been described and illustrated, such embodiments should be considered illustrative only and not as limiting the invention as construed according to the accompanying claims.

The invention claimed is:

1. A music control device comprising:

a first module comprising a first plurality of controls;

a second module attachable to and detachable from the first module and comprising a second plurality of controls;

an audio output interface; and at least one processor circuit configured to, at least:

in response to user actuation of at least one of the first plurality of controls, vary at least one parameter of a first track of music of a first plurality of tracks of music independently from at least a second track of music of the first plurality of tracks of music;

in response to user actuation of at least one of the second plurality of controls, vary at least one parameter of a first track of music of a second plurality of tracks of music independently from at least a second track of music of the second plurality of tracks of music; and cause the audio output interface to produce at least one audio output signal in response to, at least, the at least one parameter of the first track of music of the first plurality of tracks of music and the at least one parameter of the first track of music of the second plurality of tracks of music.

2. The music control device of claim 1 further comprising a third module attachable to and detachable from the second module and comprising a third plurality of controls, wherein the at least one processor circuit is further configured to, at least, in response to user actuation of at least one of the third plurality of controls, vary at least one parameter of a first one of a third plurality of tracks of music independently from at least a second one of the third plurality of tracks of music.

3. The music control device of claim 1 wherein:

the first module comprises first and second rails;

the second module comprises third and fourth rails; and the music control device further comprises a joining body attachable to the first and second rails and to the third and fourth rails to permit the second module to be attachable to and detachable from the first module.

4. The music control device of claim 1 wherein:

the at least one processor circuit comprises a first processor circuit in the first module and a second processor circuit in the second module; and when the second module is attached to the first module, the first and second processor circuits are connected to each other to allow the first and second modules to function together as one multi-track synthesizer platform.

5. The music control device of claim 1 wherein:

the at least one processor circuit comprises a first processor circuit in the first module and a second processor circuit in the second module; and when the second module is attached to the first module, the first and second processor circuits are connected to each other to allow the first and second modules to function together as one mixing platform.

6. The music control device of claim 1 wherein:

the at least one processor circuit comprises a first processor circuit in the first module and a second processor circuit in the second module; and when the second module is attached to the first module, the first and second processor circuits are connected to each other to allow the first and second modules to function together as one signal processing platform.

7. The music control device of claim 1 wherein:

the at least one processor circuit comprises a first processor circuit in the first module and a second processor circuit in the second module; and when the second module is attached to the first module, the first and second processor circuits are connected to each other to allow the first and second modules to function together as one audio recording platform.

8. The music control device of claim 1 wherein:

the at least one processor circuit comprises a first processor circuit in the first module and a second processor circuit in the second module; and when the second module is attached to the first module, the first and second processor circuits are connected to each other to allow the first and second modules to function together as one sequencer platform.

9. The music control device of claim 1 wherein:

the at least one processor circuit comprises a first processor circuit in the first module and a second processor circuit in the second module; and when the second module is attached to the first module, the first and second processor circuits are connected to each other to allow the first and second modules to function together as one platform that is a combination of two or more of a multi-track synthesizer platform, a mixing platform, a signal processing platform, an audio recording platform, and a sequencer platform.

10. The music control device of claim 1 wherein:

the at least one processor circuit comprises a first processor circuit in the first module and a second processor circuit in the second module;

the first processor circuit comprises a first central processing unit ("CPU") and a first digital signal processor ("DSP"), wherein at least the first CPU and the first DSP are in communication with a first field-programmable gate array ("FPGA");

the second processor circuit comprises a second CPU and a second DSP, wherein at least the second CPU and the second DSP are in communication with a second FPGA; and when the second module is attached to the first module, the first and second FPGAs are connected at least to each other to allow one or both of the first CPU and the first DSP to be connected to one or both of the second CPU and the second DSP through the first and second FPGAs.

11. The music control device of claim 1 wherein:

the at least one processor circuit comprises a first processor circuit in the first module and a second processor circuit in the second module; and the first processor circuit is configured to, at least:

mix audio signals produced by the first processor circuit with, at least, audio signals produced by the second processor circuit to produce mixed audio signals; and produce at least one audio output signal in response to at least the mixed audio signals.

12. The music control device of claim 1 wherein each track of music of the first and second pluralities of tracks of music is associated with a respective different at least one source of music.

13. The music control device of claim 12 wherein each of the sources of music is a musical instrument either synthesized by the music control device or external to the music control device.

14. The music control device of claim 1 wherein the at least one processor circuit is further configured to, at least, produce at least one track selection signal representing user selection of the first track of music of the first plurality of tracks of music.

15. The music control device of claim 14 wherein the at least one processor circuit is configured to, at least:

produce the at least one track selection signal in response to user selection of one of a plurality of track selection user inputs each aligned with a respective track icon on the music control device and indicating a respective one of the first plurality of tracks of music; and when the first track of music of the first plurality of tracks of music is selected, vary the at least one parameter of the first track of music of the first plurality of tracks of music in response to user actuation of at least one of the first plurality of controls aligned with the one of the plurality of track selection user inputs and in response to user actuation of at least one of the first plurality of controls not aligned with the one of the plurality of track selection user inputs.

16. The music control device of claim 14 wherein, when no track of music of the first plurality of tracks of music is selected:

the at least one processor circuit is configured to, at least, vary the at least one parameter of the first track of music of the first plurality of tracks of music in response to user actuation of at least one of the first plurality of controls aligned with a first track icon on the music control device and indicating the first track of music of the first plurality of tracks of music; and the at least one processor circuit is further configured to, at least, vary at least one parameter of the second track of music of the first plurality of tracks of music in response to user actuation of at least one of the first plurality of controls aligned with a second track icon on the music control device and indicating the second track of music of the first plurality of tracks of music.

17. The music control device of claim 1 wherein the at least one processor circuit is further configured to, at least:

produce at least one track-part selection signal representing user selection of a track part from a plurality of track parts of the first track of music of the first plurality of tracks; and produce at least one parameter subset selection signal representing user selection of a selected subset of parameters from a plurality of subsets of parameters in the track part;

wherein the at least one parameter of the first track of music of the first plurality of tracks of music is in the selected subset.

18. The music control device of claim 17 wherein the track part is an instrument part, a mixer part, a sound effects part, a looping part, a sequencing part, or an automation part.

19. The music control device of claim 17 wherein the at least one processor circuit is configured to, at least, produce the at least one parameter subset selection signal in response to user selection of one of a plurality of parameter subset selection user inputs each aligned with a respective parameter subset icon indicating a respective one of the plurality of subsets of parameters.

20. The music control device of claim 17 wherein the at least one processor circuit is configured to, at least, produce the at least one parameter subset selection signal in response to user selection of one of a plurality of parameter subset selection user inputs aligned with a respective parameter subset icon indicating more than one of the plurality of subsets of parameters.

21. The music control device of claim 17 further comprising a display, wherein the at least one processor circuit is further configured to, at least, in response to the at least one track-part selection signal representing user selection of a sequencing part from the plurality of track parts of the first track of music of the first plurality of tracks:

cause the display to display a timeline comprising representations of respective ones of a plurality of steps in a sequencer of the first track of music of the first plurality of tracks;

associate at least some controls of the first and second pluralities of controls with respective ones of the plurality of steps; and in response to user actuation of at least one control of the at least some controls, vary at least one parameter of the at least one step associated with the at least one control.

22. The music control device of claim 21 wherein the at least one processor circuit is configured to, at least, in response to the at least one track-part selection signal representing user selection of a sequencing part from the plurality of track parts of the first track of music of the first plurality of tracks, cause the display to display the timeline on at least the first and second modules simultaneously.

23. The music control device of claim 21 wherein the at least one processor circuit is configured to, at least, in response to the at least one track-part selection signal representing user selection of a sequencing part from the plurality of track parts of the first track of music of the first plurality of tracks, and in response to user selection of a selected portion of at least some of the plurality of steps:

associate the first plurality of controls with respective ones of the selected portion of the at least some of the plurality of steps; and cause the display to indicate the selected portion of the at least some of the plurality of steps.

24. The music control device of claim 21 wherein the at least one parameter of the at least one step comprises a pitch of the step, a chord of the step, or a duration of the step.

25. The music control device of claim 21 wherein the at least one parameter of the at least one step comprises a respective at least one variation of at least one parameter of at least one of the plurality of steps.

26. The music control device of claim 21 wherein the at least one processor circuit is further configured to, at least, at each of one or more defined ones of the plurality of steps:

retrieve, from at least one computer-readable storage medium, codes associated with the one of the one or more defined ones of the plurality of steps and representing at least a previously stored association of at least some controls of the first and second pluralities of controls with respective parameters of at least one track of music of the first and second pluralities of tracks of music; and associate the at least some controls with the respective parameters.

27. The music control device of claim 1 wherein:

each track of music of the first and second pluralities of tracks of music is associated with at least one model element; and the at least one processor circuit is further configured to, at least, vary at least one simulated interconnection between a pair of the plurality of model elements in response to user actuation of at least one control of the first and second pluralities of controls.

28. The music control device of claim 27 wherein the simulated interconnection between the pair of the plurality of model elements comprises a simulation of an interconnection transmitting at least one audio signal or at least one control signal between the pair of the plurality of model elements.

* * * * *